US011464335B2

(12) United States Patent
Brunner et al.

(10) Patent No.: US 11,464,335 B2
(45) Date of Patent: Oct. 11, 2022

(54) RACKING SYSTEM AND COUPLER

(71) Applicants: Keter Plastic Ltd., Herzliya (IL); Milwaukee Electric Tool Corporation, Brookfield, WI (US)

(72) Inventors: Yaron Brunner, Kibutz Gvat (IL); Izhar Shany, Kibutz Gvat (IL); Uri Parizer, Kibbutz Hukok (IL); Ayala Vardi Bougay, Kefar Veradim (IL); George Barton, Mequon, WI (US)

(73) Assignees: Keter Plastic Ltd., Herzliya (IL); Milwaukee Electric Tool Corporation, Brookfield, WI (US)

( * ) Notice: Subject to any disclaimer, the term of this patent is extended or adjusted under 35 U.S.C. 154(b) by 0 days.

(21) Appl. No.: 17/594,095

(22) PCT Filed: Apr. 12, 2020

(86) PCT No.: PCT/IL2020/050433
§ 371 (c)(1),
(2) Date: Oct. 1, 2021

(87) PCT Pub. No.: WO2020/208640
PCT Pub. Date: Oct. 15, 2020

(65) Prior Publication Data

US 2022/0087420 A1 Mar. 24, 2022

(30) Foreign Application Priority Data

Apr. 11, 2019 (IL) ..... 265964

(51) Int. Cl.
*A47B 96/02* (2006.01)
*A47B 57/42* (2006.01)
(Continued)

(52) U.S. Cl.
CPC ..... *A47B 96/027* (2013.01); *A47B 57/42* (2013.01); *A47B 96/061* (2013.01); *A47F 5/0846* (2013.01)

(58) Field of Classification Search
CPC ..... A47B 96/027; A47B 57/42; A47B 96/061; A47F 5/0846
See application file for complete search history.

(56) References Cited

U.S. PATENT DOCUMENTS 495,537 A 4/1893 Westerman
509,839 A 11/1893 Bowley
(Continued)

FOREIGN PATENT DOCUMENTS

CA 2 562 993 A1 4/2007
CN 2608238 Y 3/2004
(Continued)

OTHER PUBLICATIONS

AUER Packaging 1 2016 ("Auer-Catalog").
(Continued)

*Primary Examiner* — Ko H Chan
(74) *Attorney, Agent, or Firm* — Vorys, Sater, Seymour and Pease LLP; Anthony P. Venturino; Maryellen Feehery Hank

(57) ABSTRACT

Provided is a wall mounting system including at least one wall mount articulable to a wall, and at least one coupling member; the mounting portion includes two parallelly disposed side walls with a locking portion at a distal end thereof, for snug insertion into the locking slot of the wall mount; and the coupling member is configured with an obstructing plunger slidingly displaceable within a space between side walls, between a locked position, at which the plunger at least partially projects into the first locking recess, and an unlocked position at which the plunger is retracted
(Continued)

into the space and out of the first locking recess. Further provided is a tolerance cancelation mechanism for a wall coupling member articulable to a wall mount, including a pivotal fastener member configured with an asymmetric sector-like shape with a wall engaging arc surface for bearing against a wall surface.

20 Claims, 28 Drawing Sheets

(51) Int. Cl.
*A47B 96/06* (2006.01)
*A47F 5/08* (2006.01)

(56) References Cited

U.S. PATENT DOCUMENTS 1,081,378 A 12/1913 Freeman
1,084,360 A 1/1914 Rahm
1,112,943 A 10/1914 Stone
1,488,460 A 3/1924 Scheer
1,704,480 A 3/1929 Kicileski
D85,986 S 1/1932 Myers
2,042,387 A 5/1936 High et al.
2,100,036 A 11/1937 Michal
2,103,106 A 12/1937 Yurkovitch
2,124,541 A 7/1938 Cassey
2,210,235 A 8/1940 Filbert
2,386,343 A 10/1945 Regenhardt
2,430,200 A 11/1947 Wilson
2,558,126 A 6/1951 Davenport
2,588,009 A 3/1952 Jones
2,939,613 A 6/1960 Herman et al.
2,970,358 A 2/1961 Elsner
3,005,282 A 10/1961 Christiansen
3,117,692 A 1/1964 Carpenter et al.
3,186,585 A 6/1965 Denny
3,225,865 A 12/1965 Downey
3,351,212 A * 11/1967 McConnell ..... A47B 57/50 211/187
3,423,786 A 1/1969 Arias, Jr. et al.
3,424,334 A 1/1969 Goltz
3,506,321 A 4/1970 Hampel
3,514,170 A 5/1970 Shewchuk
3,550,908 A 12/1970 Propst et al.
3,552,817 A 1/1971 Marcolongo
3,567,298 A 3/1971 Ambaum et al.
3,743,372 A 7/1973 Ruggerone
D232,798 S 9/1974 Roche
3,851,936 A 12/1974 Muller
3,935,613 A 2/1976 Kaneko
3,974,898 A 8/1976 Tullis et al.
3,999,818 A 12/1976 Schankler
4,043,566 A 8/1977 Johnson
4,122,925 A 10/1978 Schultheiss
4,168,076 A 9/1979 Johnson
4,171,789 A * 10/1979 Vander Hoek ..... A47B 57/42 108/108
4,243,279 A 1/1981 Ackeret
4,491,231 A 1/1985 Heggeland et al.
4,524,985 A 6/1985 Drake
4,564,732 A 1/1986 Lancaster et al.
4,577,772 A 3/1986 Bigliardi
D285,986 S 10/1986 Huang
4,639,005 A 1/1987 Birkley
4,643,494 A 2/1987 Marleau
4,660,725 A 4/1987 Fishman et al.
4,673,070 A 6/1987 Ambal
4,684,034 A 8/1987 Ono et al.
4,693,345 A 9/1987 Mittelmann
4,735,107 A 4/1988 Winkie
4,805,859 A 2/1989 Hudson
4,817,237 A 4/1989 Murphy
4,929,973 A 5/1990 Nakatani
4,971,201 A 11/1990 Sathre
5,022,621 A * 6/1991 Quest ..... A47B 57/42 248/222.13
5,035,389 A 7/1991 Wang
5,035,445 A 7/1991 Poulin
D319,016 S 8/1991 Kahl
5,098,235 A 3/1992 Svetlik
D325,324 S 4/1992 Kahl
5,104,269 A * 4/1992 Hardison ..... B60P 7/15 211/105.6
5,105,947 A 4/1992 Wise
D326,815 S 6/1992 Meisner et al.
5,154,291 A 10/1992 Sur
5,185,971 A * 2/1993 Johnson, Jr. ..... A47F 5/0846 52/36.6
5,240,264 A 8/1993 Williams
D340,167 S 10/1993 Kahl
5,282,554 A 2/1994 Thomas
5,301,829 A 4/1994 Chrisco
5,325,966 A 7/1994 Chang
5,356,038 A 10/1994 Banks
5,356,105 A 10/1994 Andrews
D352,208 S 11/1994 Brookshire
5,375,709 A 12/1994 Petro
5,429,235 A 7/1995 Chen
5,429,260 A 7/1995 Vollers
5,433,416 A 7/1995 Johnson
D361,511 S 8/1995 Dickinson et al.
5,454,634 A 10/1995 Herbst et al.
5,494,246 A * 2/1996 McCarthy ..... A47B 96/06 248/221.11
5,538,213 A * 7/1996 Brown ..... A47B 57/42 248/250
5,595,228 A 1/1997 Meisner et al.
5,608,603 A 3/1997 Su
5,622,296 A 4/1997 Pirhonen et al.
5,628,443 A 5/1997 Deutsch
5,653,366 A 8/1997 Liserre
5,664,292 A 9/1997 Chen
D395,533 S 6/1998 Morison et al.
5,775,046 A 7/1998 Fanger et al.
5,797,617 A 8/1998 Lin
5,807,047 A * 9/1998 Cox ..... B60P 1/00 410/152
5,850,996 A 12/1998 Liang
5,890,613 A 4/1999 Williams
5,951,037 A 9/1999 Hsieh et al.
5,957,421 A 9/1999 Barbour
D415,393 S 10/1999 Kei
5,988,473 A 11/1999 Hagan et al.
D420,860 S 2/2000 Golichowski et al.
6,036,071 A 3/2000 Hartmann et al.
6,050,660 A 4/2000 Gurley
6,082,539 A 7/2000 Lee
6,082,687 A 7/2000 Kump et al.
6,085,925 A 7/2000 Chung
6,098,858 A 8/2000 Laugesen
6,109,627 A 8/2000 Be
6,123,344 A 9/2000 Clegg
6,131,926 A 10/2000 Harlan
6,132,819 A 10/2000 Ober et al.
6,176,558 B1 1/2001 Hlade et al.
6,176,559 B1 1/2001 Tiramani et al.
D437,484 S 2/2001 Tiramani et al.
D437,669 S 2/2001 Blason et al.
6,305,498 B1 10/2001 Itzkovitch
6,347,847 B1 2/2002 Tiramani et al.
6,354,759 B1 3/2002 Leicht
6,367,631 B1 4/2002 Steigerwald
6,371,320 B2 4/2002 Sagol
6,371,321 B1 4/2002 Lee
6,371,424 B1 4/2002 Shaw
D456,972 S 5/2002 Blason et al.
6,431,580 B1 8/2002 Kady
6,497,395 B1 12/2002 Croker
6,547,347 B2 4/2003 Saito et al.
6,601,930 B2 8/2003 Tiramani et al.
6,619,772 B2 9/2003 Dierbeck
6,637,707 B1 10/2003 Gates et al.

(56) References Cited

U.S. PATENT DOCUMENTS 6,641,013 B2 11/2003 Dise
6,889,838 B2 5/2005 Meier et al.
6,945,546 B2 9/2005 Guirlinger
6,948,691 B2 9/2005 Brock et al.
6,983,946 B2 1/2006 Sullivan et al.
7,007,903 B2 3/2006 Turner
7,044,484 B2 5/2006 Wang
7,066,475 B2 6/2006 Barnes
7,077,372 B2 7/2006 Moran
D525,789 S 8/2006 Hosking
D527,225 S 8/2006 Krieger et al.
7,083,061 B2 8/2006 Spindel et al.
7,090,085 B1 8/2006 Vicendese et al.
7,121,417 B2 10/2006 Magnusson et al.
7,147,243 B2 12/2006 Kady
7,152,752 B2 12/2006 Kurtenbach
D536,580 S 2/2007 Krieger et al.
7,172,164 B2 2/2007 Fuelling et al.
7,219,969 B2 5/2007 Bezzubov
D545,697 S 7/2007 Martin
7,263,742 B2 9/2007 Valentini
7,350,648 B2 4/2008 Gerstner et al.
7,367,571 B1 5/2008 Nichols
7,431,172 B1 10/2008 Spindel et al.
7,448,115 B2 11/2008 Howell et al.
7,490,800 B2 2/2009 Tu
7,503,569 B2 3/2009 Duvigneau
7,658,887 B2 2/2010 Hovatter
7,690,856 B2 4/2010 Mortensen
7,757,913 B2 7/2010 Fichera
7,779,764 B2 8/2010 Naidu et al.
7,780,026 B1 8/2010 Zuckerman
D627,967 S 11/2010 Kuhls
7,837,165 B2 11/2010 Stone
7,841,144 B2 11/2010 Pervan
D630,851 S 1/2011 Landau et al.
8,028,845 B2 10/2011 Himes
D649,350 S 11/2011 Shitrit
D649,783 S 12/2011 Brunner
D653,832 S 2/2012 Vilkomirski et al.
8,132,819 B2 3/2012 Landau et al.
8,177,463 B2 5/2012 Walker
D661,858 S 6/2012 Lifshitz et al.
8,191,910 B2 6/2012 Landau et al.
D663,952 S 7/2012 Crevling, Jr. et al.
D664,354 S 7/2012 Crevling, Jr. et al.
D668,869 S 10/2012 Yamamoto et al.
8,292,244 B2 10/2012 Okada
D674,605 S 1/2013 Vilkomirski et al.
8,448,829 B2 5/2013 Watanabe
8,454,033 B2 6/2013 Tsai
8,459,495 B2 6/2013 Koenig et al.
8,505,729 B2 8/2013 Sosnovsky et al.
8,567,796 B2 10/2013 Bar-Erez et al.
8,602,217 B2 12/2013 Sosnovsky et al.
8,640,913 B2 2/2014 Berendes
8,677,661 B2 3/2014 Michels et al.
D701,696 S 4/2014 Shitrit et al.
8,689,396 B2 4/2014 Wolfe et al.
8,714,355 B2 5/2014 Huang
8,813,960 B2 8/2014 Fjelland
8,851,282 B2 10/2014 Brunner
8,875,888 B2 11/2014 Koenig et al.
8,894,160 B1 11/2014 Christensen
8,924,752 B1 12/2014 Law et al.
8,925,752 B2 1/2015 Smith
8,979,100 B2 3/2015 Bensman et al.
8,985,922 B2 3/2015 Neumann
D738,105 S 9/2015 Shitrit
D738,106 S 9/2015 Shitrit
D738,622 S 9/2015 Sabbag et al.
9,132,543 B2 9/2015 Bar-Erez et al.
D753,394 S 4/2016 Brunner
D753,395 S 4/2016 Brunner
D753,396 S 4/2016 Brunner
D753,982 S 4/2016 Guirlinger
9,346,392 B1 * 5/2016 Neal ..... B60P 7/0815
D765,974 S 9/2016 Tonelli et al.
D770,179 S 11/2016 Menirom
9,506,489 B2 11/2016 Ko
9,511,491 B2 12/2016 Brunner
D777,426 S 1/2017 Dahl
9,551,367 B1 1/2017 Shieh
9,566,990 B2 2/2017 Bar-Erez et al.
D784,089 S 4/2017 Furneaux et al.
9,616,562 B2 4/2017 Hoppe et al.
9,643,629 B2 5/2017 Bar-Erez et al.
D790,221 S 6/2017 Yahav et al.
9,701,443 B2 7/2017 Wang
9,725,209 B1 8/2017 Ben-Gigi
D803,631 S 11/2017 Min et al.
9,850,029 B2 12/2017 Brunner
D806,483 S 1/2018 Stanford et al.
9,872,562 B2 1/2018 Brunner
9,888,752 B2 2/2018 Den Boer et al.
D814,187 S 4/2018 Caglar
D815,831 S 4/2018 Tonelli
D816,334 S 5/2018 Brunner
10,017,134 B2 7/2018 Pickens et al.
D826,510 S 8/2018 Brunner
RE47,022 E 9/2018 Sosnovsky et al.
D828,671 S 9/2018 Cope et al.
D831,352 S 10/2018 Brunner
10,106,180 B2 10/2018 Bar-Erez et al.
D833,744 S 11/2018 Yahav et al.
D836,995 S 1/2019 Carey et al.
D837,515 S 1/2019 Shpitzer
D839,681 S 2/2019 Evron et al.
10,222,172 B2 3/2019 Melville
D845,080 S 4/2019 Jacobsen et al.
D845,081 S 4/2019 Jacobsen
10,336,359 B1 7/2019 Asbille
D857,387 S 8/2019 Shpitzer
10,406,387 B2 9/2019 Krepel et al.
10,434,638 B1 10/2019 Tsai
D871,013 S 12/2019 Liu
10,517,398 B2 * 12/2019 Sosso ..... A47B 57/04
D873,085 S 1/2020 Defrancia
D876,833 S 3/2020 Brunner et al.
10,583,962 B2 3/2020 Brunner
10,593,962 B2 3/2020 Herchen et al.
10,603,783 B2 3/2020 Brocket et al.
D880,252 S 4/2020 Jacobsen
D880,951 S 4/2020 Jacobsen
D883,752 S 5/2020 Carey et al.
D887,788 S 6/2020 Meda et al.
D888,422 S 6/2020 Yang
D888,503 S 6/2020 Meda et al.
D891,193 S 7/2020 Stanford et al.
D891,195 S 7/2020 Zhou
10,703,534 B2 7/2020 Brunner et al.
D891,875 S 8/2020 Olson
D892,565 S 8/2020 Astle et al.
D895,375 S 8/2020 Astle et al.
10,750,833 B2 8/2020 Burchia
10,752,150 B2 * 8/2020 Johnson ..... B60P 3/073
D895,966 S 9/2020 Brunner
D895,967 S 9/2020 Brunner
D896,517 S 9/2020 Brunner et al.
D896,518 S 9/2020 Brunner et al.
D897,103 S 9/2020 Brunner et al.
10,758,065 B2 9/2020 Penalver, Jr.
D898,320 S 10/2020 Brunner et al.
10,793,172 B2 10/2020 Brunner
10,829,268 B2 11/2020 Sommer
10,829,269 B2 11/2020 Gonitianer et al.
10,894,314 B2 1/2021 Hocine et al.
10,933,501 B2 3/2021 Bisson
10,962,218 B2 3/2021 Plato et al.
10,981,696 B2 4/2021 Brunner et al.
D917,977 S 5/2021 Brunner et al.
D918,584 S 5/2021 Brunner et al.
D919,296 S 5/2021 Brunner et al.
11,008,136 B2 5/2021 Brunner et al.

(56) References Cited

U.S. PATENT DOCUMENTS

D920,671 S 6/2021 Brunner et al.
D923,935 S 7/2021 Brunner et al.
11,059,631 B1 7/2021 Brunner et al.
11,066,089 B2 7/2021 Brunner
D932,186 S 10/2021 Brunner et al.
11,155,382 B1 10/2021 Cai
D936,030 S 11/2021 Lee et al.
D941,020 S 1/2022 Brunner et al.
11,230,410 B2 1/2022 Brunner
11,283,117 B2 3/2022 Polakowski et al.
2002/0000440 A1 1/2002 Sagol
2002/0030425 A1 3/2002 Tiramani et al.
2002/0117464 A1* 8/2002 Ehrgott ..... B60P 7/15 211/175
2002/0117465 A1* 8/2002 Ehrgott ..... B60P 7/15 211/189
2002/0125072 A1 9/2002 Levy
2002/0171228 A1 11/2002 Kady
2003/0075468 A1 4/2003 Story et al.
2003/0094392 A1 5/2003 Meier et al.
2003/0094393 A1 5/2003 Sahm
2003/0115715 A1 6/2003 Valentini
2003/0146589 A1 8/2003 Jarko et al.
2003/0184034 A1 10/2003 Pfeiffer
2003/0205877 A1 11/2003 Verna et al.
2004/0074725 A1 4/2004 Shih
2004/0103494 A1 6/2004 Valentini
2004/0149754 A1 8/2004 Diamant
2004/0195793 A1 10/2004 Sullivan et al.
2004/0206656 A1 10/2004 Dubois et al.
2004/0256529 A1 12/2004 Richter
2005/0015928 A1 1/2005 Arsenault et al.
2005/0062244 A1 3/2005 Guirlinger
2005/0082775 A1 4/2005 Slager
2005/0104308 A1 5/2005 Barnes
2005/0139745 A1 6/2005 Liao et al.
2005/0242144 A1 11/2005 Panosian et al.
2006/0006770 A1 1/2006 Valentini
2006/0027475 A1 2/2006 Gleason et al.
2006/0038367 A9 2/2006 Ferraro et al.
2006/0076261 A1 4/2006 Kurtenbach
2006/0113303 A1 6/2006 Huruta
2006/0119060 A1 6/2006 Sullivan et al.
2006/0165482 A1 7/2006 Olberding
2006/0186624 A1 8/2006 Kady
2006/0254946 A1 11/2006 Becklin
2007/0006542 A1 1/2007 Duke
2007/0012694 A1 1/2007 Duvigneau
2007/0045505 A1 3/2007 Chen
2007/0068757 A1 3/2007 Tan
2007/0090616 A1 4/2007 Tompkins
2007/0145700 A1 6/2007 Ambrose et al.
2007/0194543 A1 8/2007 Duvigneau
2007/0273114 A1 11/2007 Katz
2008/0060953 A1 3/2008 Ghassan
2008/0067909 A1* 3/2008 Hanson ..... A47B 96/061 312/215
2008/0104921 A1 5/2008 Pervan et al.
2008/0115312 A1 5/2008 DiPasquale et al.
2008/0121547 A1 5/2008 Dur et al.
2008/0134607 A1 6/2008 Pervan et al.
2008/0136133 A1 6/2008 Takahashi
2008/0169739 A1 7/2008 Goldenberg
2008/0271280 A1 11/2008 Tiede et al.
2008/0277221 A1 11/2008 Josefson et al.
2008/0280523 A1 11/2008 Bishop
2008/0296443 A1 12/2008 Lunitz et al.
2008/0308369 A1 12/2008 Louis, Sr.
2009/0026901 A1 1/2009 Nies, III et al.
2009/0071990 A1 3/2009 Jardine et al.
2009/0127146 A1 5/2009 Krebs et al.
2009/0145790 A1 6/2009 Panosian et al.
2009/0145866 A1 6/2009 Panosian et al.
2009/0145913 A1 6/2009 Panosian et al.
2009/0178946 A1 7/2009 Patsone et al.
2009/0236482 A1 9/2009 Winig et al.
2009/0288970 A1 11/2009 Katz et al.
2010/0052276 A1 3/2010 Brunner
2010/0139566 A1 6/2010 Lopuszanski
2010/0147642 A1 6/2010 Andochick
2010/0176261 A1 7/2010 Chen et al.
2010/0219193 A1 9/2010 Becklin
2010/0224528 A1 9/2010 Madsen
2010/0290877 A1 11/2010 Landau et al.
2011/0049824 A1 3/2011 Bar-Erez et al.
2011/0073516 A1 3/2011 Zelinskiy
2011/0139665 A1 6/2011 Madsen
2011/0139777 A1 6/2011 Sosnovsky et al.
2011/0155613 A1 6/2011 Koenig et al.
2011/0174939 A1 7/2011 Taylor
2011/0181008 A1 7/2011 Bensman et al.
2011/0220531 A1 9/2011 Meether et al.
2012/0073995 A1 3/2012 Parker
2012/0074022 A1 3/2012 McTavish
2012/0074158 A1 3/2012 Lafleur
2012/0080432 A1 4/2012 Bensman et al.
2012/0152800 A1 6/2012 Parzy et al.
2012/0152944 A1 6/2012 Vilkomirski et al.
2012/0160886 A1 6/2012 Henny et al.
2012/0180250 A1 7/2012 Ricklefsen et al.
2012/0207571 A1 8/2012 Scott
2012/0292213 A1 11/2012 Brunner
2012/0326406 A1 12/2012 Lifshitz et al.
2013/0024468 A1 1/2013 Kocsis
2013/0031731 A1 2/2013 Hess
2013/0031732 A1 2/2013 Hess et al.
2013/0068903 A1 3/2013 O'Keene
2013/0121783 A1 5/2013 Kelly
2013/0127129 A1 5/2013 Bensman et al.
2013/0146551 A1 6/2013 Simpson et al.
2013/0154218 A1 6/2013 Tiilikaninen
2013/0206139 A1 8/2013 Krepel et al.
2013/0223971 A1 8/2013 Grace, IV
2014/0062042 A1 3/2014 Wagner et al.
2014/0069832 A1 3/2014 Roehm
2014/0076759 A1 3/2014 Roehm et al.
2014/0123478 A1 5/2014 Gylander et al.
2014/0161518 A1 6/2014 Ko
2014/0166516 A1 6/2014 Martinez et al.
2014/0197059 A1 7/2014 Evans et al.
2014/0360957 A1* 12/2014 Himes ..... B60P 7/0815 211/87.01
2015/0014949 A1 1/2015 Dittman
2015/0034515 A1 2/2015 Monyak et al.
2015/0151427 A1 6/2015 Ben-Gigi
2015/0274362 A1 10/2015 Christopher et al.
2015/0310842 A1 10/2015 Coburn et al.
2015/0376917 A1 12/2015 Brunner
2016/0023349 A1 1/2016 Hoppe et al.
2016/0130034 A1 5/2016 Kuhls et al.
2016/0144500 A1 5/2016 Chen
2016/0168880 A1 6/2016 Phelan
2016/0207441 A1* 7/2016 Khan ..... B60P 7/15
2016/0213115 A1 7/2016 Gonitianer et al.
2016/0221177 A1 8/2016 Reinhart
2017/0065355 A1 3/2017 Ross et al.
2017/0098513 A1 4/2017 Horváth et al.
2017/0121056 A1 5/2017 Wang
2017/0138382 A1 5/2017 Ko
2017/0158216 A1 6/2017 Yahav et al.
2017/0165828 A1 6/2017 Fleischmann
2017/0166352 A1 6/2017 Hoppe et al.
2017/0174392 A1 6/2017 De Loynes
2017/0217464 A1 8/2017 Bar-Erez et al.
2017/0239808 A1 8/2017 Hoppe et al.
2017/0257958 A1 9/2017 Sabbag et al.
2017/0266804 A1 9/2017 Kinskey
2017/0318927 A1 11/2017 Kraus et al.
2017/0349013 A1 12/2017 Gronholm
2018/0000234 A1 1/2018 White
2018/0044059 A1 2/2018 Brunner
2018/0099405 A1 4/2018 Reinhart
2018/0127007 A1 5/2018 Kravchenko
2018/0153312 A1 6/2018 Buck et al.

(56) References Cited

U.S. PATENT DOCUMENTS

| | | | |
|---|---|---|---|
| 2018/0161975 | A1 | 6/2018 | Brunner |
| 2018/0186513 | A1 | 7/2018 | Brunner |
| 2018/0213934 | A1 | 8/2018 | Wolle et al. |
| 2018/0220758 | A1 | 8/2018 | Burchia |
| 2018/0229889 | A1 | 8/2018 | Li |
| 2018/0290288 | A1 | 10/2018 | Brunner |
| 2019/0001482 | A1 | 1/2019 | Wolle et al. |
| 2019/0002004 | A1 | 1/2019 | Brunner |
| 2019/0031222 | A1 | 1/2019 | Takyar et al. |
| 2019/0039781 | A1 | 2/2019 | Kogel et al. |
| 2019/0106244 | A1 | 4/2019 | Brunner et al. |
| 2019/0168376 | A1 | 6/2019 | Brocket et al. |
| 2019/0225371 | A1 | 7/2019 | Hoppe et al. |
| 2019/0225374 | A1 | 7/2019 | McCrea et al. |
| 2020/0029543 | A1 | 1/2020 | Householder |
| 2020/0055534 | A1 | 2/2020 | Hassell |
| 2020/0078929 | A1 | 3/2020 | Liu |
| 2020/0147781 | A1 | 5/2020 | Squiers |
| 2020/0165036 | A1 | 5/2020 | Squiers |
| 2020/0223585 | A1 | 7/2020 | Brunner et al. |
| 2020/0243925 | A1 | 7/2020 | Polakowski et al. |
| 2020/0299027 | A1 | 9/2020 | Brunner et al. |
| 2020/0346819 | A1 | 11/2020 | Kogel |
| 2021/0025706 | A1 | 1/2021 | Millane |
| 2021/0031975 | A1 | 2/2021 | Brunner |
| 2021/0039831 | A1 | 2/2021 | Brunner |
| 2021/0094600 | A1 | 4/2021 | Brunner et al. |
| 2021/0104909 | A1 | 4/2021 | Mantych |
| 2021/0155373 | A1 | 5/2021 | Cai |
| 2021/0187725 | A1 | 6/2021 | Brunner |
| 2021/0221561 | A1 | 7/2021 | Dian et al. |
| 2021/0267368 | A1 | 9/2021 | Bruins |
| 2021/0316909 | A1 | 10/2021 | Vargo et al. |

FOREIGN PATENT DOCUMENTS

| | | | |
|---|---|---|---|
| CN | 200947356 | Y | 9/2007 |
| CN | 101068661 | A | 11/2007 |
| CN | 102137795 | A | 7/2011 |
| CN | 102248523 | A | 11/2011 |
| CN | 102469899 | A | 5/2012 |
| CN | 102608238 | A | 7/2012 |
| CN | 102834035 | A | 12/2012 |
| CN | 302371147 | S | 3/2013 |
| CN | 103118578 | A | 5/2013 |
| CN | 103659777 | A | 3/2014 |
| CN | 204161752 | U | 2/2015 |
| DE | 3510307 | A1 | 9/1986 |
| DE | 9313802 | U1 | 12/1993 |
| DE | 4415638 | A1 | 11/1995 |
| DE | 29708343 | U1 | 7/1997 |
| DE | 19750543 | A1 | 5/1999 |
| DE | 20218996 | U1 | 3/2003 |
| DE | 102004057870 | A1 | 6/2006 |
| DE | 202011002617 | U1 | 4/2011 |
| DE | 102010003754 | A1 | 10/2011 |
| DE | 102010003756 | A1 | 10/2011 |
| DE | 102012106482 | A1 | 1/2014 |
| DE | 102012220837 | A1 | 5/2014 |
| DE | 202014103695 | U1 | 12/2014 |
| DE | 202015105053 | U1 | 10/2016 |
| DE | 202015005752 | U1 | 11/2016 |
| DE | 102015112204 | A1 | 2/2017 |
| DE | 102015013053 | A1 | 4/2017 |
| DE | 402018201520 | | 11/2018 |
| EM | 000705231-0001 | | 4/2007 |
| EM | 002419283-0001 | | 3/2014 |
| EP | 0916302 | A2 | 5/1999 |
| EP | 1321247 | A2 | 6/2003 |
| EP | 1428764 | B1 | 6/2006 |
| EP | 1819487 | A1 | 8/2007 |
| EP | 1 925 406 | A1 | 5/2008 |
| EP | 2289671 | A2 | 3/2011 |
| EP | 2346741 | A1 | 7/2011 |
| EP | 2456341 | A1 | 5/2012 |
| EP | 2 543 297 | A2 | 1/2013 |
| EP | 2555660 | A2 | 2/2013 |
| EP | 2555661 | A1 | 2/2013 |
| EP | 2805799 | A2 | 11/2014 |
| EP | 3141354 | A1 | 3/2017 |
| FR | 3 043 970 | A1 | 5/2017 |
| GB | 694707 | A | 7/1953 |
| GB | 2047181 | B | 2/1983 |
| GB | 2 110 076 | A | 6/1983 |
| GB | 2330521 | A | 4/1999 |
| GB | 2406331 | A | 3/2005 |
| GB | 2413265 | A | 10/2005 |
| GB | 2 449 934 | A | 12/2008 |
| JP | 2003194020 | A | 7/2003 |
| JP | D1180963 | S | 8/2003 |
| JP | 1276744 | S | 7/2006 |
| JP | D1395115 | S | 8/2010 |
| JP | D1395116 | S | 8/2010 |
| JP | D1455321 | S | 11/2012 |
| JP | 2013022972 | A | 2/2013 |
| JP | 2013022976 | A | 2/2013 |
| JP | 1477050 | S | 8/2013 |
| JP | D1503434 | S | 7/2014 |
| JP | D1625407 | S | 2/2019 |
| JP | D1665028 | S | 8/2020 |
| KR | 300271616 | | 2/2000 |
| KR | 300320243 | | 6/2002 |
| KR | 300806604 | | 7/2015 |
| KR | 300842236 | | 3/2016 |
| KR | 300849600 | | 4/2016 |
| KR | 300859965 | | 6/2016 |
| KR | 3008881296 | | 11/2016 |
| KR | 300999599 | | 3/2019 |
| TW | I324578 | B | 5/2010 |
| TW | D135074 | S | 6/2010 |
| TW | D168686 | S | 7/2015 |
| TW | D174412 | S1 | 3/2016 |
| TW | D192092 | | 8/2018 |
| TW | D206875 | | 9/2020 |
| WO | 2005045886 | A2 | 5/2005 |
| WO | 2006099638 | A1 | 9/2006 |
| WO | 2007121745 | A1 | 11/2007 |
| WO | 2007121746 | A2 | 11/2007 |
| WO | 2008/090546 | A1 | 7/2008 |
| WO | 2009140965 | A1 | 11/2009 |
| WO | 2011/000387 | A1 | 1/2011 |
| WO | 2011009480 | A1 | 1/2011 |
| WO | 2011/032568 | A1 | 3/2011 |
| WO | 2013026084 | A1 | 2/2013 |
| WO | 2014125488 | A2 | 8/2014 |
| WO | 2016142935 | A1 | 9/2016 |
| WO | 2016/187652 | A1 | 12/2016 |
| WO | 2017028845 | A1 | 2/2017 |
| WO | 2017098513 | A1 | 6/2017 |
| WO | 2017191628 | A1 | 11/2017 |
| WO | 2017212840 | A1 | 12/2017 |
| WO | 2018/213560 | A1 | 11/2018 |
| WO | 2019/028041 | A1 | 2/2019 |

OTHER PUBLICATIONS

AUER Packaging 2 2016.

Amazon. Hopkins FloTool 91002 Thino Box with Mount, https://www.amazon.com/exec/obidos/ASIN/B003K15F31/20140000-20, accessed Jun. 17, 2019.

Batavia Gmbh. BluCave Storage System. https://protect-us.mimecast.com/s/5XIGCR6KypcgJnlKi9EDoim?domain=batavia.eu, accessed Jun. 17, 2019.

Batavia. BluCave Universal Storage System, https://batavia.eu/blucave-storage-system/, accessed Jun. 17, 2019.

BluCave Video?. https://www.youtube.com/watch?v=Sw7fQQPw0tY&feature=youtu.be&t=32.

Cain, Tristan. "Bird Balder, er—Builder." Brick Journal, Nov. 2013 (Issue 26), pp. 15-16.

"Cavity". Merriam-Webster's Collegiate Dictionary (11th Ed.), Merriam-Webster, Incorporated, 2020, p. 197.

Certified Translations of the Cover Pages of DE102015112204A1 and DE202015105053U1.

(56) References Cited

OTHER PUBLICATIONS

Final Rejection dated Nov. 28, 2018 in U.S. Appl. No. 15/826,201 (17 Pages).
Forum Post: Systainer clone (dated Feb. 15, 2016).
General Design Principles for DuPont Engineering Polymers, E.I. du Pom de Nemours and Company, 2000.
Get Tools Direct. TSTAC Vac Rack (Suits DWV902M & DWV900L) DwV9500-XJ, https://www.gettoolsdirect.com.au/dewalt-tstak-vac-rack-suits-dwv902m-and-dwv9001-dwv9500-xj.html, accessed Jun. 17, 2019.
International Search Report and Written Opinion for International Application No. PCT/US2018/044629, dated Jan. 9, 2019.
International Search Report and Written Opinion for International Application No. PCT/US2018/033161, dated Aug. 6, 2018 (14 pages).
ITS. Dewalt 171229 Dewalt TSTAK Carrier Trolley, https://www.its.co.uk/pd/171229-Dewalt-TSTAK-Carrier-Trolley-DEW171229.htm, accessed Jun. 17, 2019.
Kazmer, David. "Design of Plastic Parts." Applied Plastics Engineering Handbook Processing and Materials, edited by Myer Kutz, Elsevier Inc., 2011, pp. 535-551.
Milwaukee Dolly, announced 2019 (online), (site visited Mar. 9, 2020). Available from internet, URL: https://www.zoro.com/milwaukee-tool-box-dolly-7-4164-h-18-2932-w-48-22-8410/i/G3958724/ (Year: 2019).
Messetermine 2016 (dated Feb. 18, 2016), Wayback machine archive (dated Apr. 4, 2016), AUER Packaging 1111 In-and Ausland present (dated Feb. 2016), and photograph, with certified translations.
Neue Produktfamilie: Systemboxen Durchdacht, Komfortabel und in Wertigem Design (dated Oct. 19, 2015), Wayback machine archive (dated Dec. 16, 2015), AUER Packaging prSsentiert neue Produktfamilie Systernboxen (dated Sep. 2015), and images ("Auer-Press"), with certified translations.
Nugent, Paul. "Rotational Molding," Applied Plastics Engineering Handbook Processing and Materials, edited by Myer Kutz, Elsevier Inc., 2011, pp. 311-332.
Sortimo Logistbm Sortimo International GmbH, Mobile Sortimente, http://p125638.mittwaldserver.info/fileadmin/media/PDFs/Logistixx_Broschuere_DE_WEB.pdf, accessed Jun. 17, 2019.
'Structure Design', Design Solutions Guide, BASF Corporation. 2007.
The Greenhead. Blitz Box—Portable Storage Box/Shelf, https://www.thegreenhead.com/2013/03/blitz-box-portable-storage-box-shelf.php, accessed Jun. 17, 2019.
ToolGuyd. RYOBI ToolBlox Tool Cabinet System, https://toolguyd.com/ryobi-toolblox-cabinets/, accessed Jun. 17, 2019.
Vertak. https://www.alibaba.com/product-detail/Vertak-global-patented-multi-funciton-portable_60217794260.html.
Wheel board, announced 2019 (online), (site visited Mar. 9, 2020). Available from internet, URL: https://www.gearooz.com accu-case-aca-wheel-board (Year: 2019).
Youtube. TSTAK Phase 2 Upgrades Video. https://www.youtube.com/watch?v=jb06y6J1dr4&feature=youtu.be&t=197, accessed Jun. 17, 2019.
Inter Partes Review No. 2021-00373, "Petition for Inter Partes Review of U.S. Pat. No. 10,583,962" Filed Jan. 5, 2021, 198 pages.
Exhibit 1001 in Petition for Inter Partes Review of U.S. Pat. No. 10,583,962, filed Jan. 5, 2021, 64 Pages.
Exhibit 1002 in Petition for Inter Partes Review of U.S. Pat. No. 10,583,962, filed Jan. 5, 2021, 75 Pages.
Exhibit 1003 in Petition for Inter Partes Review of U.S. Pat. No. 10,583,962, filed Jan. 5, 2021, 13 Pages.
Exhibit 1004 in Petition for Inter Partes Review of U.S. Pat. No. 10,583,962, filed Jan. 5, 2021, 18 Pages.
Exhibit 1005 in Petition for Inter Partes Review of U.S. Pat. No. 10,583,962, filed Jan. 5, 2021, 9 Pages.
Exhibit 1006 in Petition for Inter Partes Review of U.S. Pat. No. 10,583,962, filed Jan. 5, 2021, 176 Pages.
Exhibit 1007 in Petition for Inter Partes Review of U.S. Pat. No. 10,583,962, filed Jan. 5, 2021, 22 Pages.
Exhibit 1008 in Petition for Inter Partes Review of U.S. Pat. No. 10,583,962, filed Jan. 5, 2021, 6 Pages.
Exhibit 1009 in Petition for Inter Partes Review of U.S. Pat. No. 10,583,962, filed Jan. 5, 2021,24 Pages.
Exhibit 1010 in Petition for Inter Partes Review of U.S. Pat. No. 10,583,962, filed Jan. 5, 2021, 19 Pages.
Exhibit 1011 in Petition for Inter Partes Review of U.S. Pat. No. 10,583,962, filed Jan. 5, 2021, 26 Pages.
Exhibit 1012 in Petition for Inter Partes Review of U.S. Pat. No. 10,583,962, filed Jan. 5, 2021, 3 Pages.
Exhibit 1013 in Petition for Inter Partes Review of U.S. Pat. No. 10,583,962, filed Jan. 5, 2021, 168 Pages.
Exhibit 1014 in Petition for Inter Partes Review of U.S. Pat. No. 10,583,962, filed Jan. 5, 2021, 481 Pages.
Exhibit 1015 in Petition for Inter Partes Review of U.S. Pat. No. 10,583,962, filed Jan. 5, 2021, 6 Pages.
Exhibit 1016 in Petition for Inter Partes Review of U.S. Pat. No. 10,583,962, filed Jan. 5, 2021, 242 Pages.
Exhibit 1017 in Petition for Inter Partes Review of U.S. Pat. No. 10,583,962, filed Jan. 5, 2021, 6 Pages.
Exhibit 1018 in Petition for Inter Partes Review of U.S. Pat. No. 10,583,962, filed Jan. 5, 2021, 250 Pages.
Exhibit 1019 in Petition for Inter Partes Review of U.S. Pat. No. 10,583,962, filed Jan. 5, 2021, 44 Pages.
Exhibit 1020 in Petition for Inter Partes Review of U.S. Pat. No. 10,583,962, filed Jan. 5, 2021, 5 Pages.
Exhibit 1021 in Petition for Inter Partes Review of U.S. Pat. No. 10,583,962, filed Jan. 5, 2021, 1 Pages.
Exhibit 1022 in Petition for Inter Partes Review of U.S. Pat. No. 10,583,962, filed Jan. 5, 2021, 1 Pages.
Exhibit 1023 in Petition for Inter Partes Review of U.S. Pat. No. 10,583,962, filed Jan. 5, 2021, 24 Pages.
Exhibit 1024 in Petition for Inter Partes Review of U.S. Pat. No. 10,583,962, filed Jan. 5, 2021, 28 Pages.
International Search Report and Written Opinion for International Application No. PCT/US2019/014940, dated Jul. 26, 2019.
International Search Report for International Application No. PCT/IL2019/050689, dated Aug. 23, 2019.
International Search Report for International Application No. PCT/IL2020/050433, dated Jun. 21, 2020.
Non-Final Rejection dated Apr. 12, 2018, in U.S. Appl. No. 15/826,201.
Non-Final Rejection dated Jan. 24, 2019, in U.S. Appl. No. 16/216,724.
Extended European search report for application No. 18892505.1 dated Sep. 17, 2021.
ToolGuyd, Sys-Cart Base, a Systainer Mounting Platform, Jul. 28, 2014, 9 pages, available online: https://toolguyd.com/systainer-sys-cart-mounting-base/.

* cited by examiner

RACKING SYSTEM AND COUPLER

TECHNOLOGICAL FIELD

The present disclosure is concerned with a wall mounting system, and more particularly it is concerned with an E-track coupling/fastener mechanism for a racking system. The disclosure is further concerned with a coupler for used in conjunction with an E-track system.

BACKGROUND ART

References considered to be relevant as background to the presently disclosed subject matter are listed below:

U.S. Pat. No. 2,970,358
U.S. Pat. No. 6,948,691
U.S. Pat. No. 8,028,845
U.S. Pat. No. 8,985,922

Acknowledgement of the above references herein is not to be inferred as meaning that these are in any way relevant to the patentability of the presently disclosed subject matter.

BACKGROUND

E-Track is a versatile mounting system that can be mounted vertically or horizontally on any carrying wall surface, for anchoring and fastening thereto different utility modules, such as storage and display facilities, load bars, fastener straps, cargo securing arrangements, and the like. The system can be used for erecting truss systems, scaffolding, stages, different enclosures, etc.

E-track Systems provide reliable articulation and are fit for withstanding heavy loads, and yet are easily attachable and detachable from a wall mount, offering great versatility and modulation whereby a wide variety of bars, straps, beams and the like can be articulated with the wall mount.

U.S. Pat. No. 2,970,358 discloses a fastening mechanism employed to connect releasably a strap or webbing to an anchor member.

U.S. Pat. No. 6,948,691 discloses a mounting apparatus is provided for mounting a computer server in a server rack structure. The server rack defines a first and second mounting apertures. A slide is provided having a bracket mounted to one end thereof. The bracket includes a first wall abutting the rack, and a second wall transverse to the first wall. A portion of the bracket extends into the first mounting aperture. A latch is mounted on the second wall of the bracket. The latch is movable between a first position wherein the latch extends into the second mounting aperture, and a second position wherein the latch does not extend into the mounting aperture. The latch cooperates with the portion of the bracket extending into the first mounting aperture to limit vertical movement of the bracket with respect to the rack.

U.S. Pat. No. 8,028,845 discloses, by one of its aspects, a rack for an E-track, comprising: a member; said member having a clip portion; said clip portion having a wall, said wall having a bottom indent and a top indent; whereby said top indent and said bottom indent are capable of being removably secured to an E-track. wherein said clip has a shoulder that is capable of contacting said wall; said shoulder is capable of biasing toward a clip portion distal side further comprising said clip having a clip spring receiving member that extends from said clip towards said wall; said clip having a neck that extends upwardly from said shoulder; said wall having a wall spring receiving member; whereby a spring may be disposed on said clip spring receiving member and said wall spring receiving member, and said spring capable of biasing said shoulder against said wall; and said clip portion having a clip portion distal side and a clip portion proximal side; said clip portion proximal side being disposed between said clip portion distal side and said member; and said neck may be capable of being pulled away from said clip portion distal side.

U.S. Pat. No. 8,985,922 discloses a rack having a member; the member having a clip portion; the clip portion having a wall, the wall having a bottom indent and a top indent; whereby the top indent and the bottom indent are capable of being removably secured to an E-track.

GENERAL DESCRIPTION

According to a first aspect of the present disclosure there is provided a wall mounting system comprising at least one wall mount articulable to a wall, and at least one coupling member; the at least one wall mount has a mounting wall configured with rectangle locking slot; the at least one coupling member has at a proximal side a utility portion attachable to a utility module, and at a distal side a mounting portion attachable to the wall mount; said mounting portion comprises two parallelly disposed side walls with a locking portion at a distal end thereof, for snug insertion into the locking slot; said side walls comprise a first locking lug with an associated first locking recess, and a second locking lug with an associated second locking recess, disposed in register with one another, said first locking recess being deeper than said second locking recess;

and wherein the coupling member is further configured with an obstructing plunger slidingly displaceable within a space between the side walls, between a locked position, at which the plunger at least partially projects into the first locking recess, and an unlocked position at which the plunger is retracted into the space and out of the first locking recess.

A second aspect of the present disclosure is directed to a coupling member having at a proximal side a utility portion attachable to a utility module, and at a distal side a mounting portion attachable to a wall mount, said mounting portion comprises two parallelly disposed side walls with a locking portion at a distal end thereof, configurable for snug arresting within a locking slot of a wall mount; said side walls comprise a first locking lug with an associated first locking recess, and a second locking lug with an associated second locking recess, disposed in register with one another, said first locking recess is deeper than said second locking recess;

wherein the coupling member is further configured with an obstructing plunger slidingly displaceable within a space between the side walls, between a locked position, at which the plunger at least partially projects into the first locking recess, and an unlocked position at which the plunger is retracted into the space and out of the first locking recess.

The arrangement is such that articulation or detaching of the coupling member from the wall mount takes place by displacing the coupling member so that the first locking recess encounters a first narrow edge of the rectangle locking slot, thereby facilitating tilting of the coupling member so that an opposite narrow edge of the rectangle locking slot can swing over the second locking lug, into or out of the second locking recess, i.e. into respective articulation or detaching from the wall mount.

However, the arrangement is further such, that displacing the coupling member so that the first locking recess encounters a first narrow edge of the rectangle locking slot can be facilitated only when the plunger is at the retracted, unlocked position.

The distance between respective edges of the first locking lug and the second locking lug is greater than the length of the rectangle locking slot, whereby the coupling member is barred from axial displacement, i.e. prevented from articulation or detaching from the wall mount, respectively.

The arrangement is such that at the locked position the obstructing plunger is disposed within the top locking recess thus preventing lateral displacement of coupling member so that the first locking recess displaces towards encountering with the edge of the locking slot of the wall mount, thus prohibiting engagement with or disengagement from, the wall mount, respectively.

At an articulated position the narrow edges of the locking slot are received within the first locking recess and the second locking recess, respectively, wherein a portion of a front wall face and a portion of a back wall face of the mounting wall are disposed between respective walls of the first locking recess and the second locking recess, thereby providing axial support oriented in both forward and backward direction.

The at least one wall mount is configured with a receiving space disposed behind the mounting wall, wherein upon attaching thereto a coupling member the locking portion extends through the locking slot with the first locking lug and the second locking lug disposed within said receiving space.

According to yet an aspect of the present disclosure there is a tolerance cancelation mechanism, for use with a wall mounting system, such as an E-track coupling system, and configured for eliminating or substantially reducing freedom degree between a wall mount and a designated coupling member articulable thereto. The tolerance cancelation mechanism can be used in conjunction with a variety of E-track coupling systems and is not restricted to the wall mounting system disclosed herein or to any other configuration.

According to the disclosure there is a wall coupling member articulable to a wall mount, the wall coupling member comprising a tolerance cancelation mechanism comprising a fastener member pivotally articulated at a pivot point to a portion of a wall coupling member; said fastener member configured with an asymmetric sector-like shape having a wall engaging arc surface, wherein the fastener member is pivotable between at least one locked position at which a locking portion of the arc surface extends beyond a proximal bearing wall portion of the wall coupling member, and an unlocked position at which the locking portion does not exceed said proximal wall portion.

According to a specific configuration the wall engaging arc surface is defined by at least a first radii and a second radii, wherein said first radii originates at the pivot point and said second radii is longer than said first radii and originating at an imaginary point extending behind said pivot point.

The wall engaging arc surface of the fastener member is eccentrically pivotal about the pivot point, whereby the fastener member is swingable between the at leas one locked position at which the locking portion projects beyond the proximal bearing wall portion of the wall coupling member and gradually into the unlocked position at which the locking portion retracts from the proximal bearing wall portion.

The proximal bearing wall portion of the wall coupling member is defined as a most proximal wall surface of the wall coupling member, facing a wall mount.

According to yet an aspect of the disclosure there is a wall mounting system comprising a wall mount and at least one designated coupling member articulable thereto, said wall mount comprising one or more locking slots disposed at a front wall surface thereof; said coupling member comprising a tolerance cancelation mechanism comprising a fastener member pivotally articulated at a pivot point to a portion of a wall coupling member; said fastener member configured with an asymmetric sector-like shape having a wall engaging arc surface, wherein the fastener member is pivotable between at least one locked position at which a locking portion of the arc surface extends beyond a proximal bearing wall portion of the wall coupling member and said locking portion bears against the front wall surface of the wall mount, and an unlocked position at which the locking portion does not exceed said proximal wall portion, at which the locking portion is spaced form the front wall surface of the wall mount.

The arrangement is such that upon articulating a coupling member with a locking slot of a wall mount the tolerance cancelation mechanism is activated allowing the wall engaging arc surface so slide over a front wall surface of the wall mount, bearing against it and thus eliminating or substantially reducing freedom degree between therebetween, wherein further the eccentric wall engaging arc surface is pivoted into the locked position entails greater contact force and enhanced tolerance cancelation.

Any one or more of the following features, designs and configurations can be encompassed in any of the aspects of the present disclosure, solely or in various combinations thereof.

- The wall mounting system according to the present disclosure can be used in conjunction with a so-called E-track mounting system;
- The coupling member according to the present disclosure can be used in conjunction with a so-called E-track mounting system;
- The at least one wall mount can extend on a wall mountable rack;
- The at least one wall mount can be a singular article integral with or attached to a carrying wall, stationary or mobile;
- The at least one wall mount can be configured over a utility module, such as tool boxes, work benches, etc.;
- The at least one wall mount can be articulable to a wall at any desired orientation, e.g. a vertical orientation, at a horizontal orientation, inclined, ground mounted, celling mounted, etc.;
- At an articulated position the at least one coupling member is disposed substantially normal to the mounting wall of the wall mount;
- The length of the second locking lug can be similar to the obstruction depth of the obstructing plunger;
- The distance between the second locking lug and the first locking recess is similar to the distance between the second locking recess and an obstruction depth of the obstructing plunger;
- At the locked position of the obstructing plunger, a lateral face thereof can extend between the first locking lug and the first locking recess;
- At a vertical mounting orientation the coupling member can be disposed such that the first locking lug is disposed above the second locking lug and wherein the second recess rests over the second narrow edge of the rectangle locking slot;
- The obstructing plunger can be configured a sliding rod having a round cross section;

The obstructing plunger can be configured with a chamfered distal end;

The obstructing plunger can be slidingly supported over a support surface within the space between the side walls of the coupling member;

The obstructing plunger can be configured for displacing substantially normal to the mounting wall of the wall mount;

The obstructing plunger can be axially displaceable along an axis normal to a proximal wall of the first locking lug;

The proximal wall of the first locking lug can be parallel and coplanar with the proximal wall of the second locking lug;

The obstructing plunger can be biased into its locked position;

Biasing the obstructing plunger into its locked position can be facilitated by a biasing element disposed within the coupling member;

The obstructing plunger can be manipulated by an axially displaceable manipulating member disposed at a distal portion of the coupling member;

The manipulating member can be a trigger-like member;

The biasing element of the obstructing plunger can be articulated to the manipulating member;

The trigger-like manipulating member is axially displaceable within a finger-safe opening;

The side walls of the coupling member can be configured with a front wall portion, assuming a U-like shaped section;

At the locked position a distal end portion of the obstructing plunger can project into support opening configured at a front wall portion extending between side walls of the coupling member;

The side walls of the coupling member can be integral or integrated with one another;

At least proximal facing edges of one or both of the first locking lug and the second locking lug can be chamfered, to facilitate easy attaching and detaching from the wall mount;

The utility portion of the coupling member can be integral with or detachable attachable to a utility module;

The utility module can be a shelving system, a support rack, a belt, a harness, cargo securing arrangements, load bars, structure frames, etc.;

The tolerance cancelation mechanism can be a cam-like mechanism, displaceable between at least one locked position and an unlocked position;

The cam-like mechanism of the tolerance cancelation mechanism can be continuously pivotally displaceable, between respective angular positions, whereby the wall engaging arc surface displaces over the wall surface to hereby tighten contact therebetween and cancel tolerances therebetween;

The tolerance cancelation mechanism can be an automatic mechanism, whereby the fastener member can be configured for spontaneous displacing into the locked position;

The fastener member can be pivotally articulated to the wall coupling member over a horizontally extending pivot axis, whereby the fastener member is configured for spontaneous displacing into the locked position under force of gravity;

The fastener member can be spring biased into the locked position, whereby articulating the wall coupling member on a wall mount requires momentarily displacing the fastener member into the unlocked position;

The fastener member can be configured for manually displacement into the unlocked position;

The pivot axis can be disposed at any orientation with the fastener member non-biased or biased into any of its respective positions;

The fastener member can be configured with a manipulating grip for manually pivotal displacing it between the respective closed and open position;

The manipulating grip can be one or more finger grips laterally extending from a side wall of the fastener member;

The manipulating grip can be a recessed portion configured at a sidewall of the fastener member;

The manipulating grip can be a gripping surface configured at a bottom surface of the fastener member;

The fastener member can have a U-like shaped cross section;

The fastener member can have an L-like shaped cross section;

The tolerance cancelation mechanism can be configured with a clicking arrangement, wherein one or both of a surface of the fastener member and a facing surface of the coupling member is configured with one or more projections, and the other one or both of the surface of the fastener member and a facing surface of the coupling member is configured with corresponding depressions, whereby pivotal displacement of the fastener member generates light clicking motion;

An inside wall surface of the fastener member can be configured with one or more relief surfaces for overcoming lateral projection from a surface of the coupling member;

At least a portion of the wall engaging arc surface can be configured with friction enhancing arrangement, for enhancing arresting of the fastener member at a locked position;

The friction enhancing arrangement can be roughening of at least a portion of the wall engaging arc surface; such roughening can be for example knurling, ribs, projections, depressions, etc.;

Contact of the wall engaging arc surface with a front wall surface of the wall mount can be along a line or lines or a surface.

Embodiments

In the following, embodiments of the present disclosure are described by means of numbered embodiments. These numbered embodiments are intended as an addition to the above disclosure and are not limiting.

1. A wall mounting system comprising at least one wall mount articulable to a wall, and at least one coupling member; the at least one wall mount has a mounting wall configured with rectangle locking slot; the at least one coupling member has at a proximal side a utility portion attachable to a utility module, and at a distal side a mounting portion attachable to the wall mount; said mounting portion comprises two parallelly disposed side walls with a locking portion at a distal end thereof, for snug insertion into the locking slot; said side walls comprise a first locking lug with an associated first locking recess, and a second locking lug with an associated second locking recess, disposed in register with one another, said first locking recess being deeper than said second locking recess;

and wherein the coupling member is further configured with an obstructing plunger slidingly displaceable within a space between the side walls, between a locked position, at which the plunger at least partially projects into the first locking recess, and an unlocked position at which the plunger is retracted into the space and out of the first locking recess.

2. A wall mounting system according to embodiment 1, wherein the wall mounting system is used in conjunction with an E-track mounting system.
3. A wall mounting system according to embodiment 2, wherein the at least one wall mount is a singular article integral with or attached to a carrying wall, stationary or mobile.
4. A wall mounting system according to embodiment 1, wherein the at least one wall mount extends on a wall mountable rack.
5. A wall mounting system according to embodiment 1, wherein the at least one wall mount is configured over a utility module.
6. A wall mounting system according to embodiment 1, wherein the at least one wall mount is articulable to a wall disposed at an orientation selected from a vertical orientation, a horizontal orientation, an inclined orientation, a ground mounting orientation, and a celling mounted orientation.
7. A wall mounting system according to embodiment 1, wherein at an articulated position the at least one coupling member is disposed substantially normal to the mounting wall of the wall mount.
8. A wall mounting system according to embodiment 7, wherein at a vertical mounting orientation the coupling member is disposed such that the first locking lug is disposed above the second locking lug and wherein the second recess rests over a second narrow edge of the rectangle locking slot.
9. A wall mounting system according to embodiment 1, wherein the at least one wall mount is configured with a receiving space disposed behind the mounting wall, wherein upon attaching thereto a coupling member the locking portion extends through the locking slot with the first locking lug and the second locking lug disposed within said receiving space.
10. A tolerance cancelation mechanism for a wall coupling member articulable to a wall mount, the wall coupling member comprising a tolerance cancelation mechanism comprising a fastener member pivotally articulated at a pivot point to a portion of a wall coupling member; said fastener member configured with an asymmetric sector-like shape having a wall engaging arc surface, wherein the fastener member is pivotable between at least one locked position at which a locking portion of the arc surface extends beyond a proximal bearing wall portion of the wall coupling member, and an unlocked position at which the locking portion does not exceed said proximal wall portion.
11. A wall mounting system comprising a wall mount and at least one designated coupling member articulable thereto, said wall mount comprising one or more locking slots disposed at a front wall surface thereof; said coupling member comprising a tolerance cancelation mechanism comprising a fastener member pivotally articulated at a pivot point to a portion of a wall coupling member; said fastener member configured with an asymmetric sector-like shape having a wall engaging arc surface, wherein the fastener member is pivotable between at least one locked position at which a locking portion of the arc surface extends beyond a proximal bearing wall portion of the wall coupling member and said locking portion bears against the front wall surface of the wall mount, and an unlocked position at which the locking portion does not exceed said proximal wall portion, at which the locking portion is spaced form the front wall surface of the wall mount.
12. The tolerance cancelation mechanism of embodiment 10 or 11, wherein the wall engaging arc surface is defined by at least a first radii and a second radii, wherein said first radii originates at the pivot point and said second radii is longer than said first radii and originating at an imaginary point extending behind said pivot point.
13. The tolerance cancelation mechanism of embodiment 10 or 11, wherein the wall engaging arc surface of the fastener member is eccentrically pivotal about the pivot point, whereby the fastener member is swingable between the at least one locked position at which the locking portion projects beyond the proximal bearing wall portion of the wall coupling member and gradually into the unlocked position at which the locking portion retracts from the proximal bearing wall portion.
14. The tolerance cancelation mechanism of embodiment 10 or 11, wherein the proximal bearing wall portion of the wall coupling member is defined as a most proximal wall surface of the wall coupling member, facing a wall mount.
15. The tolerance cancelation mechanism of embodiment 10 or 11, wherein the arrangement is such that upon articulating a coupling member with a locking slot of a wall mount the tolerance cancelation mechanism is activated allowing the wall engaging arc surface so slide over a front wall surface of the wall mount, bearing against it and thus eliminating or substantially reducing freedom degree between therebetween, wherein further the eccentric wall engaging arc surface is pivoted into the locked position entails greater contact force and enhanced tolerance cancelation.
16. The tolerance cancelation mechanism of embodiment 10 or 11, being an automatic mechanism, whereby the fastener member is configured for spontaneous displacing into the locked position.
17. The tolerance cancelation mechanism of embodiment 10 or 11, wherein the fastener member is pivotally articulated to the wall coupling member over a horizontally extending pivot axis, whereby the fastener member is configured for spontaneous displacing into the locked position under force of gravity.
18. The tolerance cancelation mechanism of embodiment 10 or 11, wherein the fastener member is spring biased into the locked position, whereby articulating the wall coupling member on a wall mount requires momentarily displacing the fastener member into the unlocked position.
19. The tolerance cancelation mechanism of embodiment 10 or 11, wherein the fastener member is spring biased into the unlocked position, whereby articulating the wall coupling member on a wall mount requires momentarily displacing the fastener member into the locked position.
20. The tolerance cancelation mechanism of embodiment 10 or 11, wherein the fastener member is configured for manually displacement into the unlocked position.
21. The tolerance cancelation mechanism of embodiment 10 or 11, wherein the pivot axis is disposed at any orientation with the fastener member non-biased or biased into any of its respective positions.

22. The tolerance cancelation mechanism of embodiment 10 or 11, wherein the fastener member is configured with a manipulating grip for manually pivotal displacing it between the respective closed and open position.
23. The tolerance cancelation mechanism of embodiment 10 or 11, wherein the manipulating grip is one or more finger grips laterally extending from a side wall of the fastener member.
24. The tolerance cancelation mechanism of embodiment 10 or 11, wherein the manipulating grip is a recessed portion configured at a sidewall of the fastener member.
25. The tolerance cancelation mechanism of embodiment 10 or 11, wherein the manipulating grip is a gripping surface configured at a bottom surface of the fastener member.
26. The tolerance cancelation mechanism of embodiment 10 or 11, wherein the fastener member has a U-like shaped cross section.
27. The tolerance cancelation mechanism of embodiment 10 or 11, wherein the fastener member has an L-like shaped cross section.
28. The tolerance cancelation mechanism of embodiment 10 or 11, wherein the tolerance cancelation mechanism is configured with a clicking arrangement, wherein one or both of a surface of the fastener member and a facing surface of the coupling member is configured with one or more projections, and the other one or both of the surface of the fastener member and a facing surface of the coupling member is configured with corresponding depressions, whereby pivotal displacement of the fastener member generates light clicking motion.
29. The tolerance cancelation mechanism of embodiment 10 or 11, wherein an inside wall surface of the fastener member can be configured with one or more relief surfaces for overcoming lateral projection from a surface of the coupling member.
30. The tolerance cancelation mechanism of embodiment 10 or 11, wherein at least a portion of the wall engaging arc surface is configured with friction enhancing arrangement, for enhancing arresting of the fastener member at a locked position.
31. The tolerance cancelation mechanism of embodiment 10 or 11, wherein the friction enhancing arrangement is roughening of at least a portion of the wall engaging arc surface; such roughening can be for example knurling, ribs, projections, depressions, etc.
32. The tolerance cancelation mechanism of embodiment 10 or 11, wherein contact of the wall engaging arc surface with a front wall surface of the wall mount is along a line or lines or a surface.
33. The tolerance cancelation mechanism of embodiment 10 or 11, wherein the wall engaging arc surface has a gradually decreasing radii length, from a top portion to a bottom portion.
34. The tolerance cancelation mechanism of embodiment 10 or 11, wherein the wall engaging arc surface has a generally smooth surface.
35. The tolerance cancelation mechanism of embodiment 10 or 11, wherein the fastener member is a cam-like mechanism, displaceable between at least one locked position and an unlocked position.
36. The tolerance cancelation mechanism of embodiment 35, wherein the cam-like mechanism is continuously pivotally displaceable, between respective angular positions, whereby the wall engaging arc surface displaces over the wall surface to thereby tighten contact therebetween and cancel tolerances therebetween.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which.

DETAILED DESCRIPTION OF EMBODIMENTS

Figure 1:
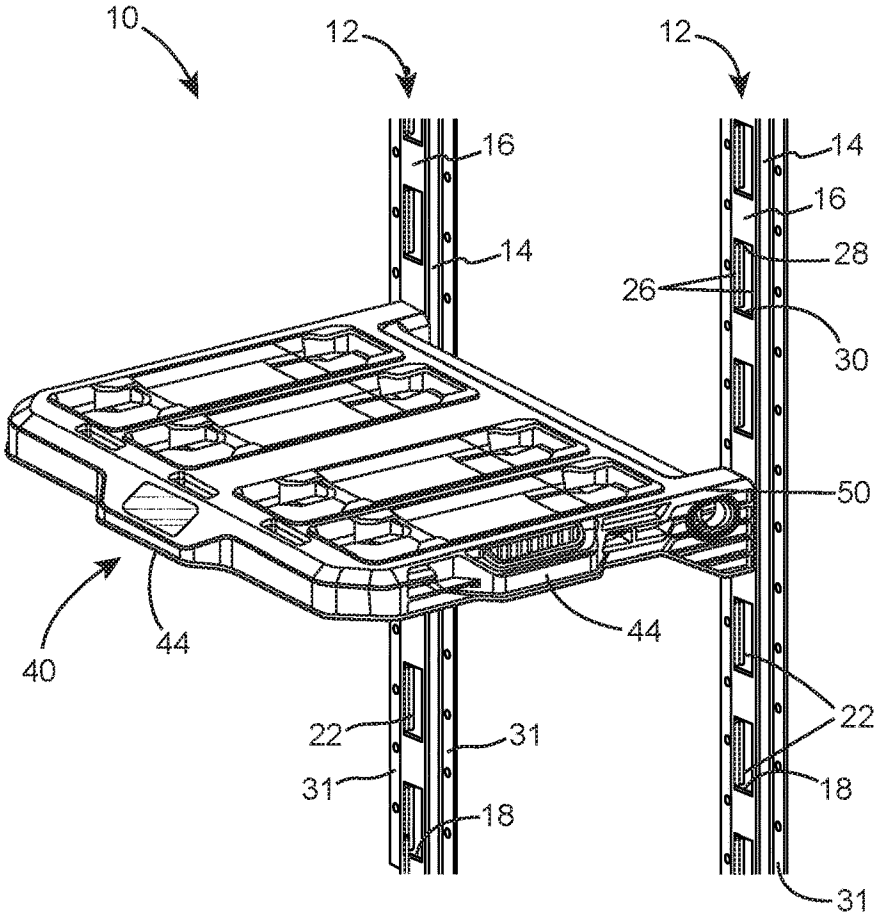
FIG. 1 is a perspective proximal (front) view of a rack system according to an example of the present disclosure.
Figure 3B:
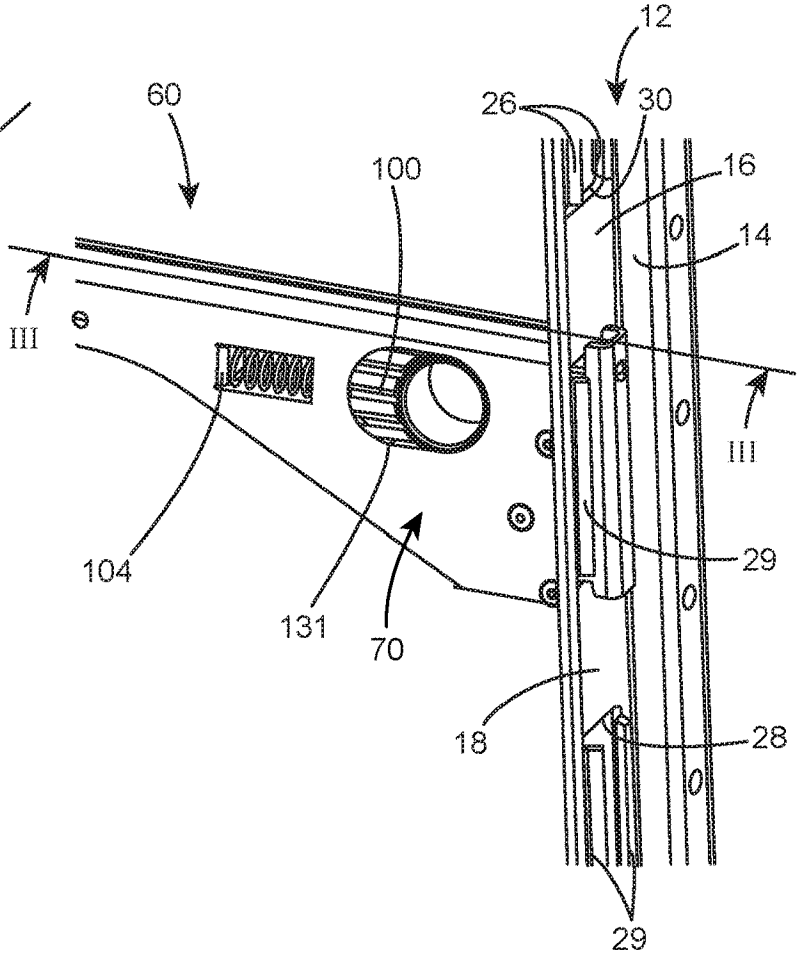
FIG. 3B is the same as FIG. 3A, with an enveloping shelve removed from the coupling member.
Figure 3A:
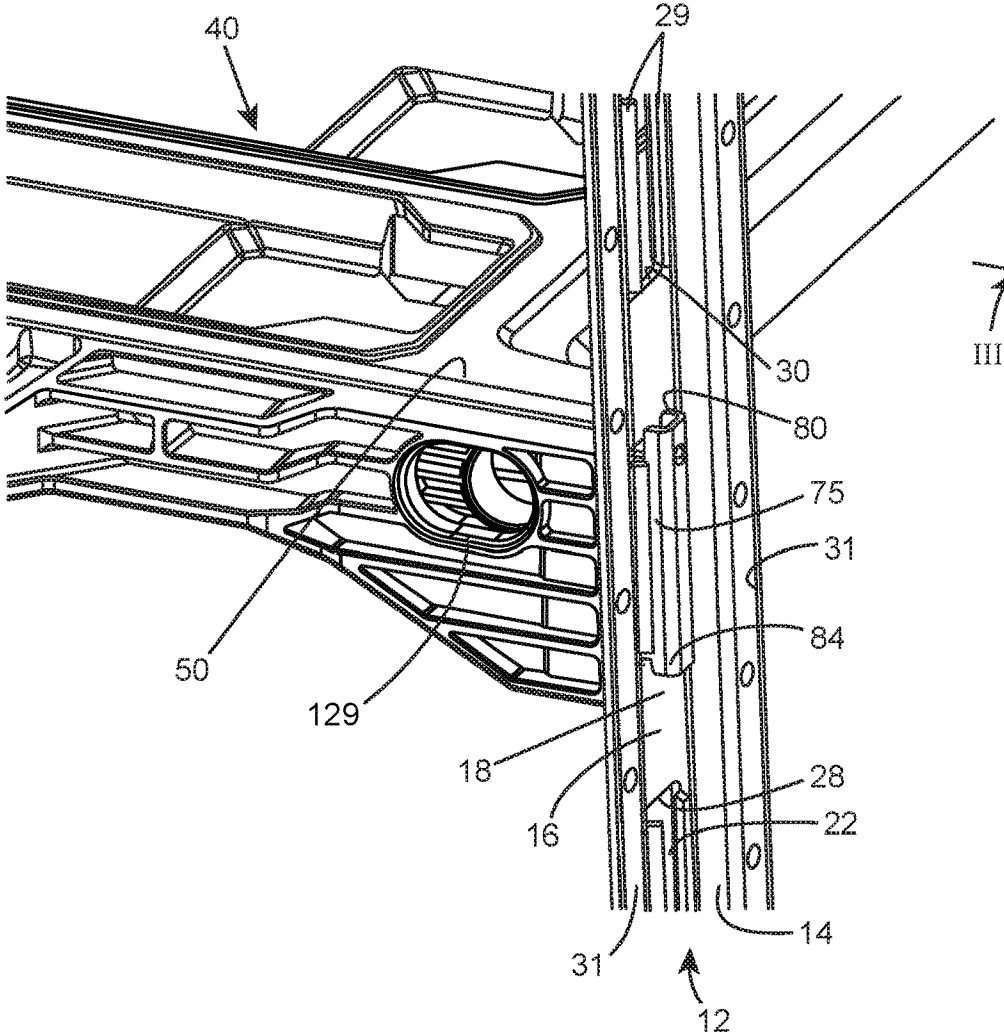
FIG. 3A is an enlarged perspective back view of a portion of the rack system, with the coupling member at a locked position.
Figure 3D:
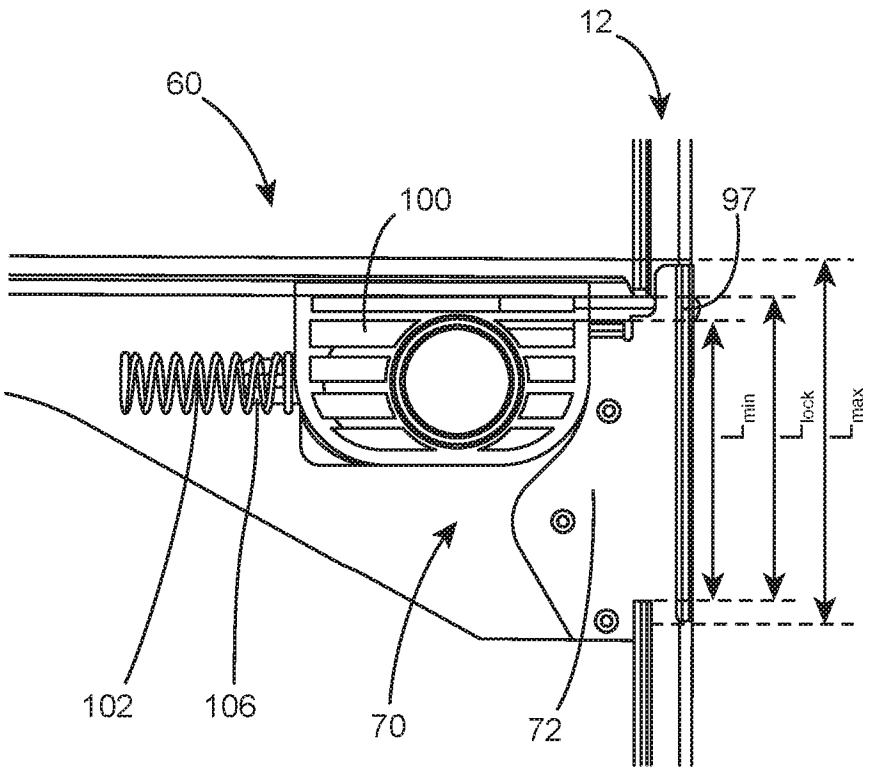
FIG. 3D is a planar view of FIG. 3C.
Figure 3C:
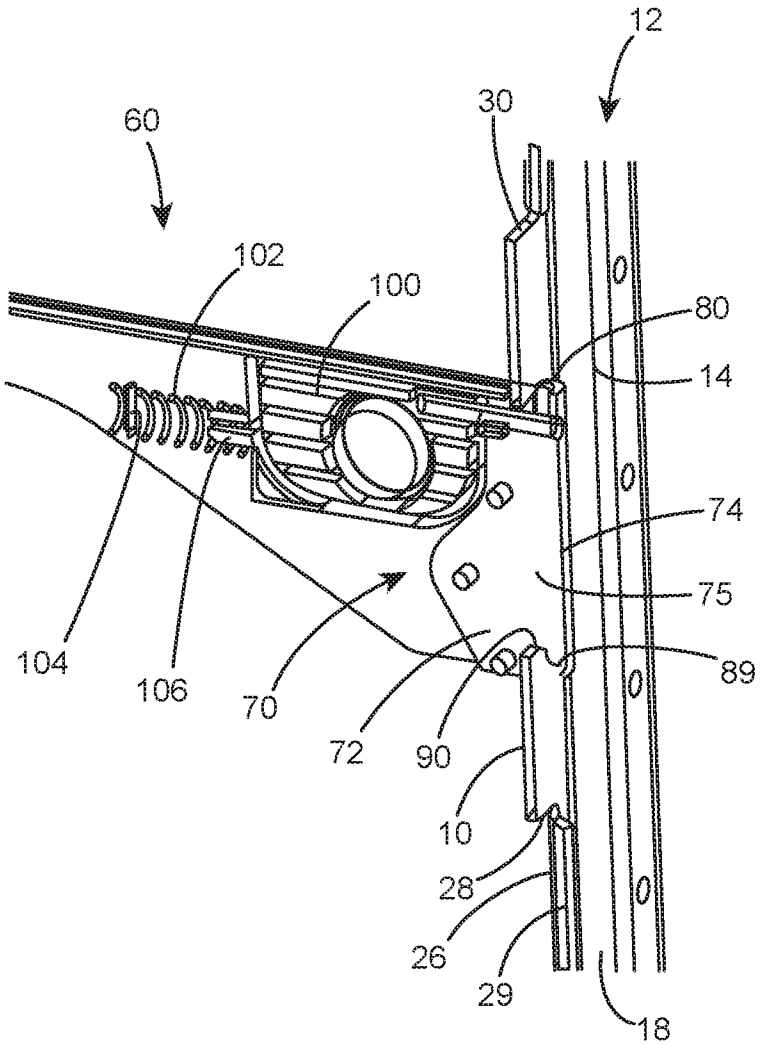
FIG. 3C is a cross section along line III-III in FIG. 3B.
Figure 3E:
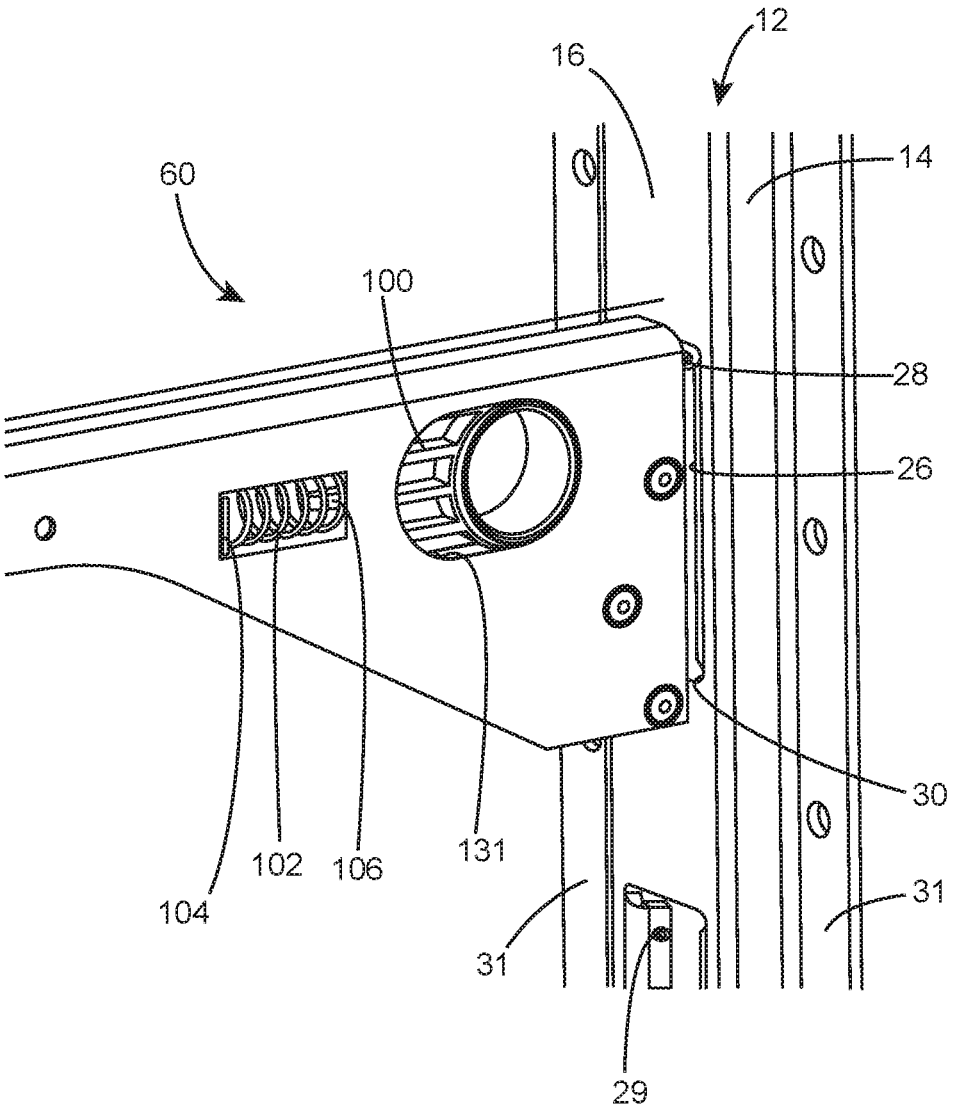
FIG. 3E is a close up perspective front view of a portion of the rack system, with the coupling member at a locked position.
Figure 4B:
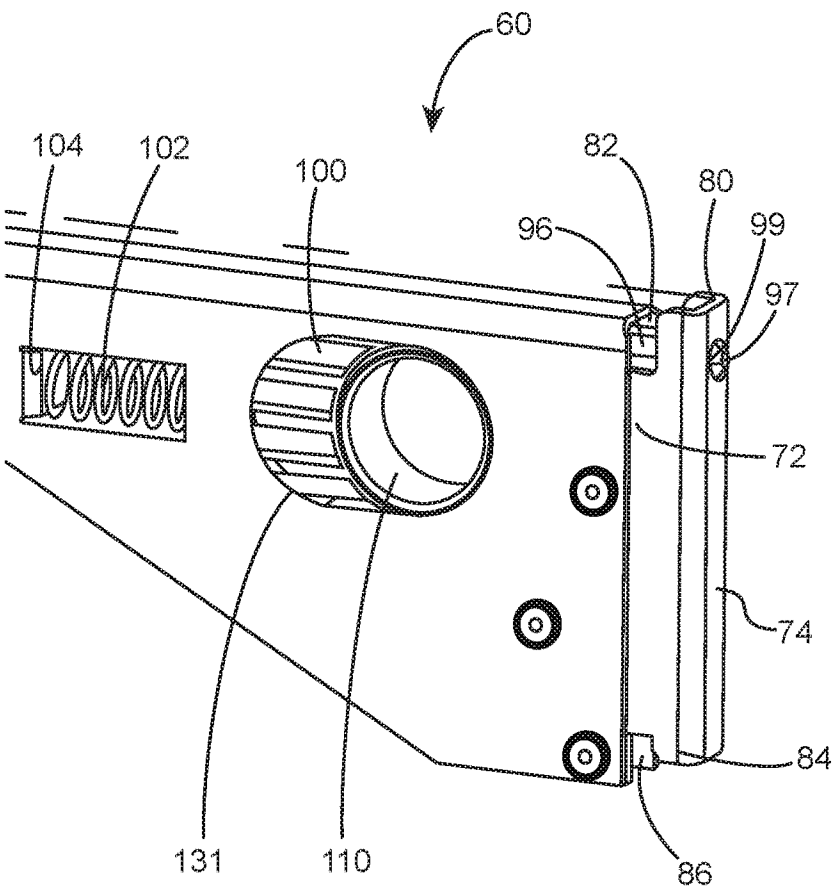
FIG. 4B is the same as FIG. 4A, with the enveloping shelve removed from the coupling member.
Figure 4A:
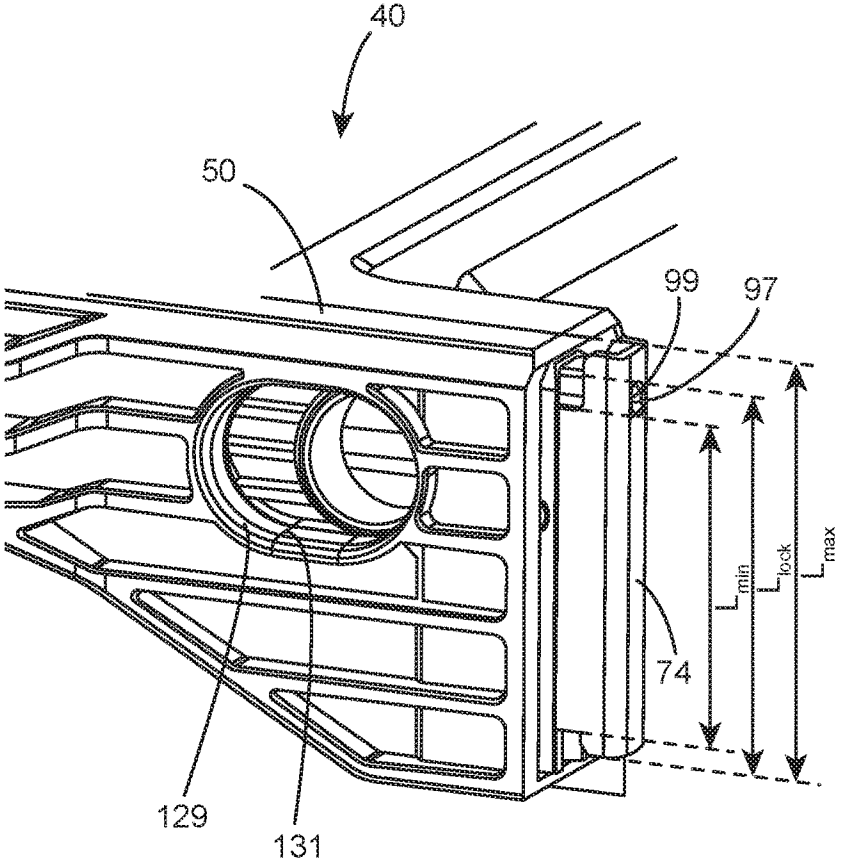
FIG. 4A is the same as FIG. 3A, with the wall mount rack removed.
Figure 4D:
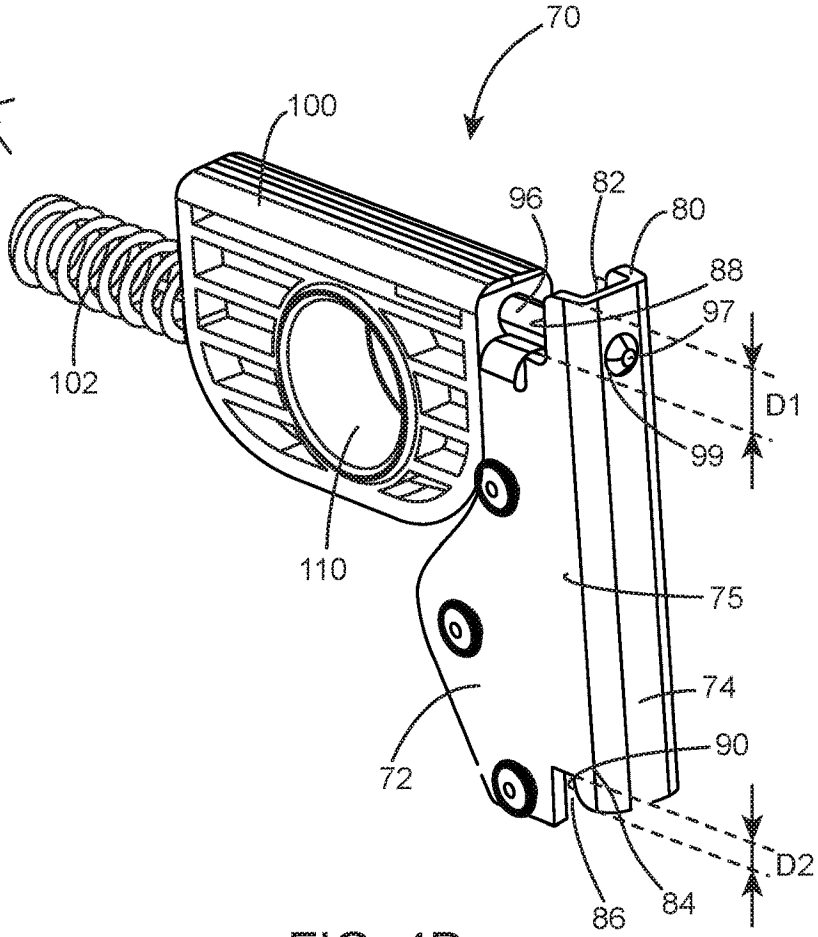
FIG. 4D is a back, top perspective view of FIG. 4C.
Figure 4C:
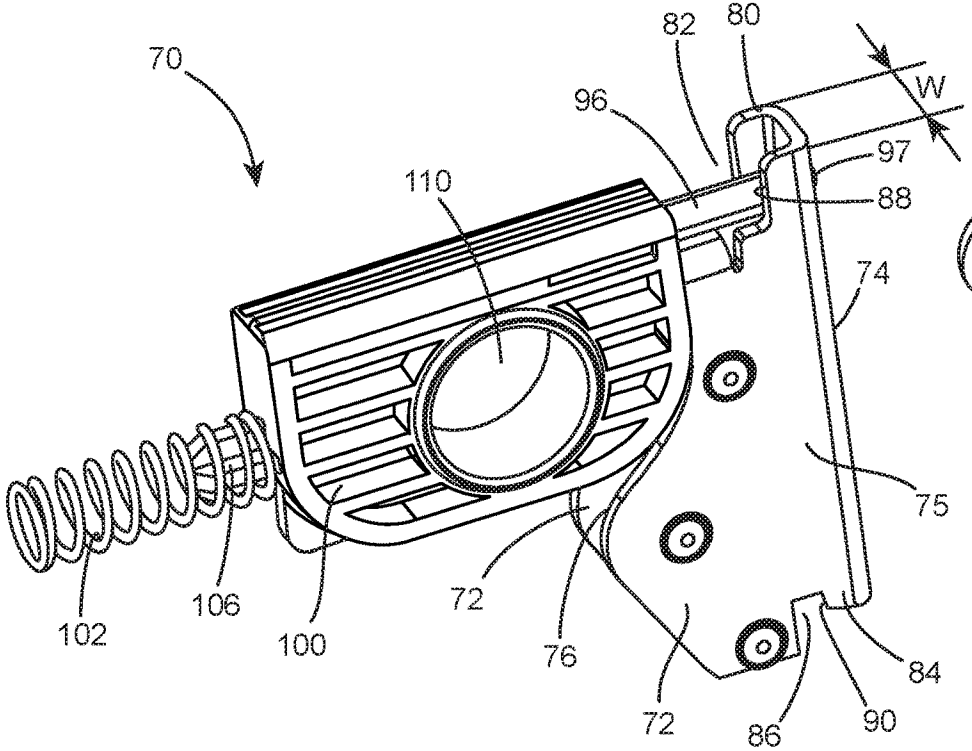
FIG. 4C is front, top perspective view of the coupling member of the present disclosure, at a locked position, isolated from other elements.

In FIG. 1 of the drawings there is illustrated a wall mounted rack system generally designated 10, comprising a pair of parallelly disposed wall mountable mounting racks 12 of the so-called E-Track configuration, each configured with a central longitudinal projection 14 having a front wall face 16 with a receiving space 18 there behind, and further said front wall face 16 is configured with a plurality of rectangle locking slots 22.

Each slot has a pair of longitudinal edges 26 (often folded in sheet material, e.g. parallel disposed flaps 29), and a first narrow edge 28 and a second narrow edge 30. The flaps 29 are spaced apart within the receiving space 18 and are disposed so as to snugly accommodate a locking portion of a coupling member, as will be described herein after. Side shoulders 31 of the mounting rack 12 facilitate articulation same to any surface.

Whilst in the illustrated example the wall mount is one of many locking slots 22 disposed on a vertically disposed mounting rack 12, it should be appreciated that other configurations are possible too, e.g. a single wall mount attachable to, or integral with any bearing wall surface. Furthermore, the wall mount, either a rack or a single mount, can be disposed at any desired orientation, e.g. vertical orientation, horizontal orientation, inclined orientation, ground mounted orientation and celling mounted orientation.

Figure 2:
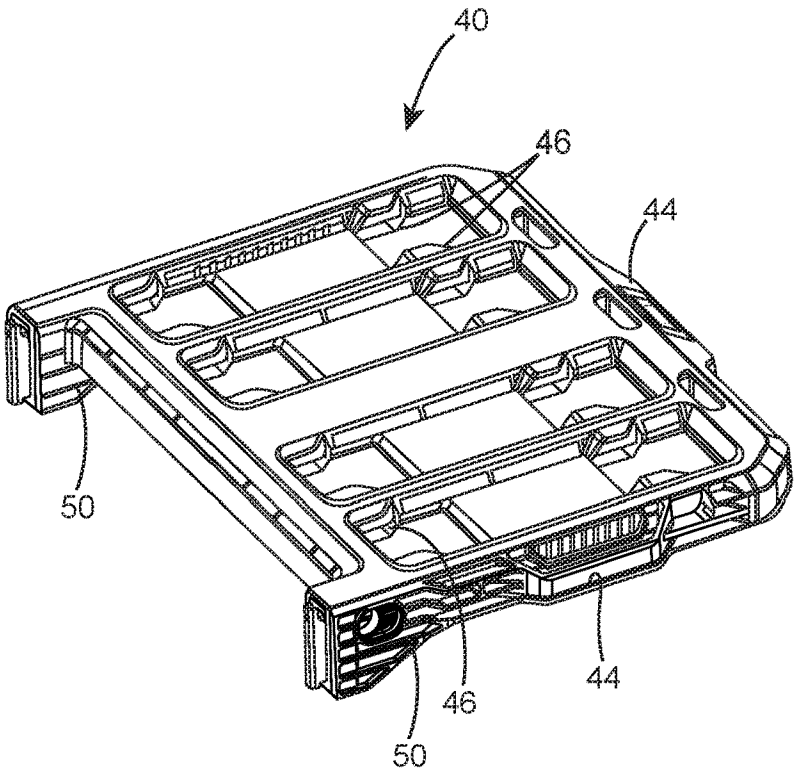
FIG. 2 is a perspective distal (back) view of a wall mount rack fitted with coupling members according to an embodiment of the disclosure.

An exemplary utility module is illustrated in FIGS. 1 and 2, namely a shelving/rack member generally designated 40, configured as a carry support member, thus provided with carrying handles 44 and at least at a top face thereof there is configured a multi-location modular articulating system 46. However, it is appreciated that a coupling member according to the present disclosure can be used in conjunction with a variety of utility modules, wherein the racking/shelve system disclosed herein is a mere example.

Disposed within side wall portion 50 of the shelve 40 there is a load bar 60 integrally configured with a coupling member 70, seen isolated in FIGS. 4C, 4D, 6F and 6G. The load bar 60 is a mere example and in the illustrated example it is removably received within the side wall portion 50 of the shelve 40, though it can just as well be used as a plain shelf support bar, mounting bar for different purposes, etc. Thus, load bar is a form of a utility module which in the illustrated example is integrally configured coupling member 70.

The coupling member 70 received within a distal end of the load bar 60, and comprises two parallelly disposed side walls 72 with a locking portion 75 at a distal end thereof, for snug insertion into any one of the rectangle locking slots 22 of the mounting racks 12, whereby the external width W of the side walls 72 corresponds with the distance between the flaps 29.

The side walls 72 are formed out, in the present example, as a uniform unit with a front wall portion 74 therebetween, imparting the structure a U-like cross section, with a space 76 disposed between the side walls 72.

The locking portion 75 is configured with a first locking lug 80 projecting upwards and associated with a first locking recess 82, and a second locking lug 84 projecting downward and associated with a second locking recess 86, where said first locking recess 82 and second locking recess 86 are disposed in register with one another, i.e. having a distal wall 88 and 90 respectively of each of the first locking lug 80 and the second locking lug 84 aligned with one another.

It is also seen that the first locking recess 82 has a depth $D_1$ deeper than the depth $D_2$ of said second locking recess 86 (when measured from the respective end most portion).

Figure 5B:
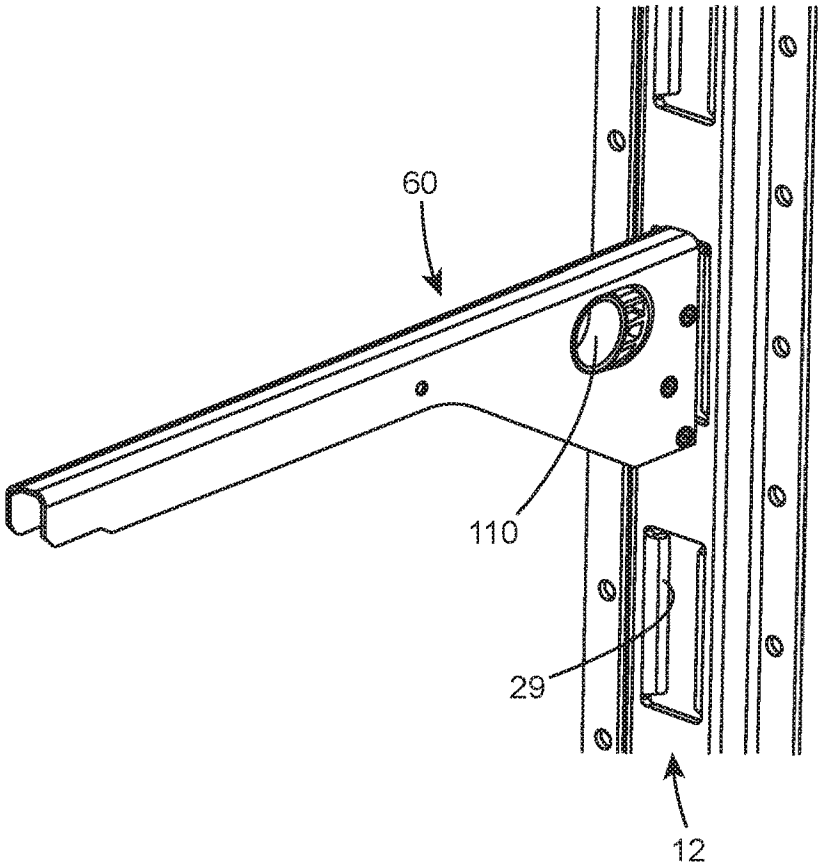
FIG. 5B is a front perspective view of FIG. 5A.
Figure 5A:
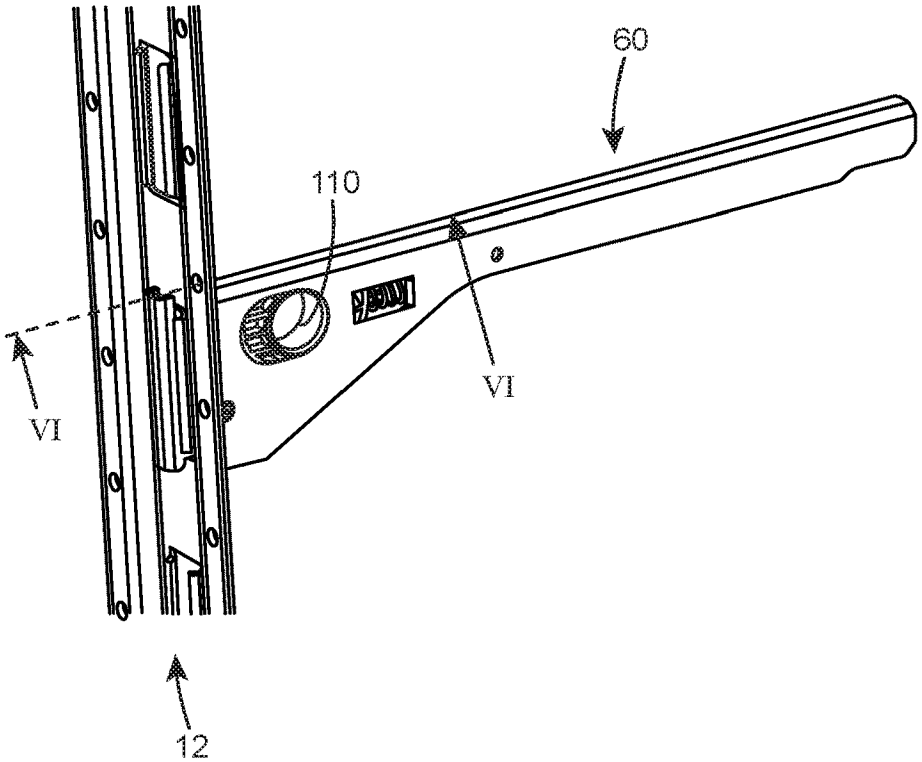
FIG. 5A is a perspective back view of a portion of the rack system, with the enveloping shelve removed from the coupling member, and with the coupling member at an unlocked position.
Figure 6B:
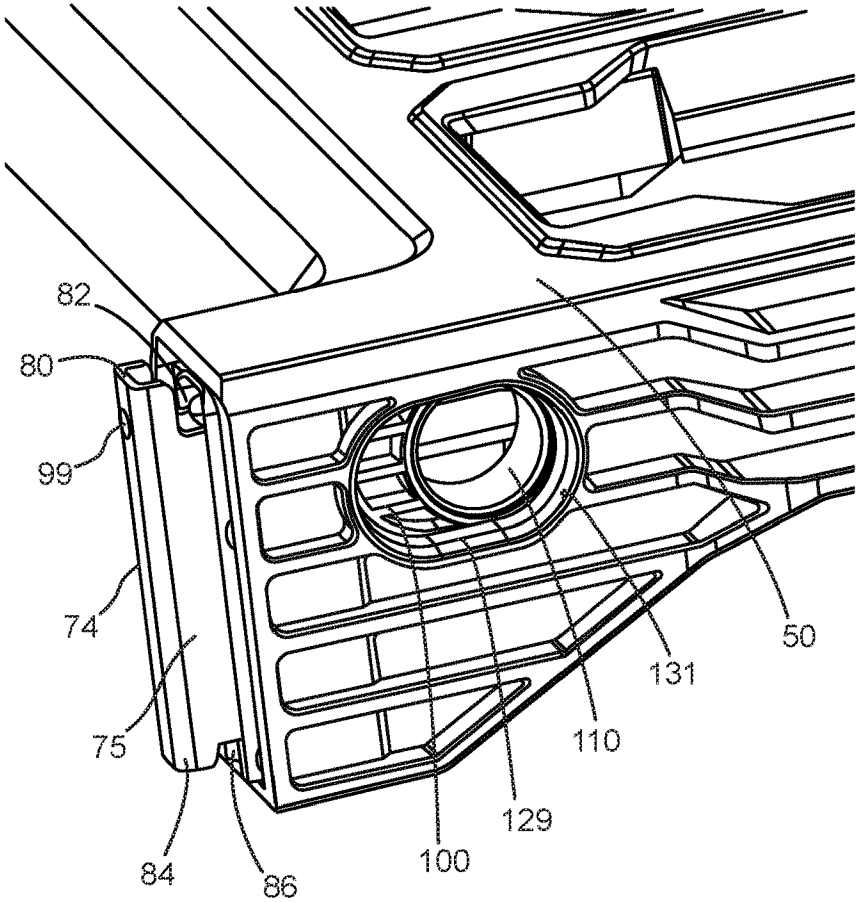
FIG. 6B is the same as FIG. 6A with the wall mount rack removed.
Figure 6A:
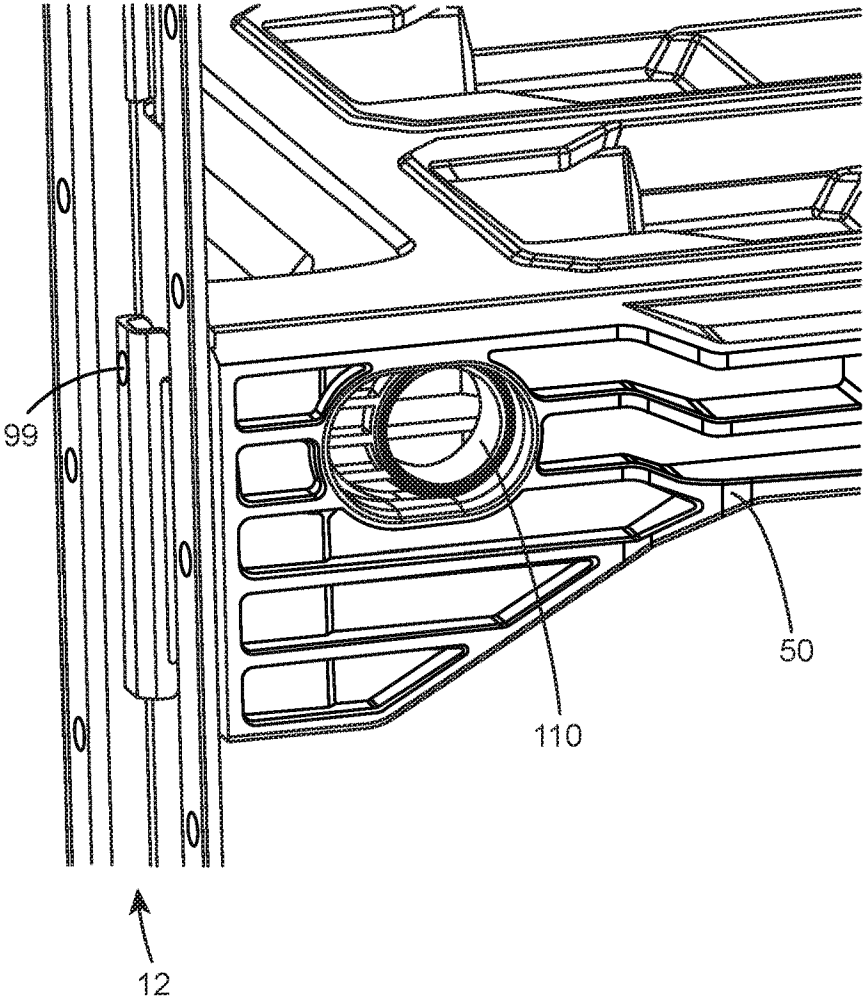
FIG. 6A is a an enlarged perspective back view of a portion of the rack system, with the coupling member at an unlocked position.
Figure 6D:
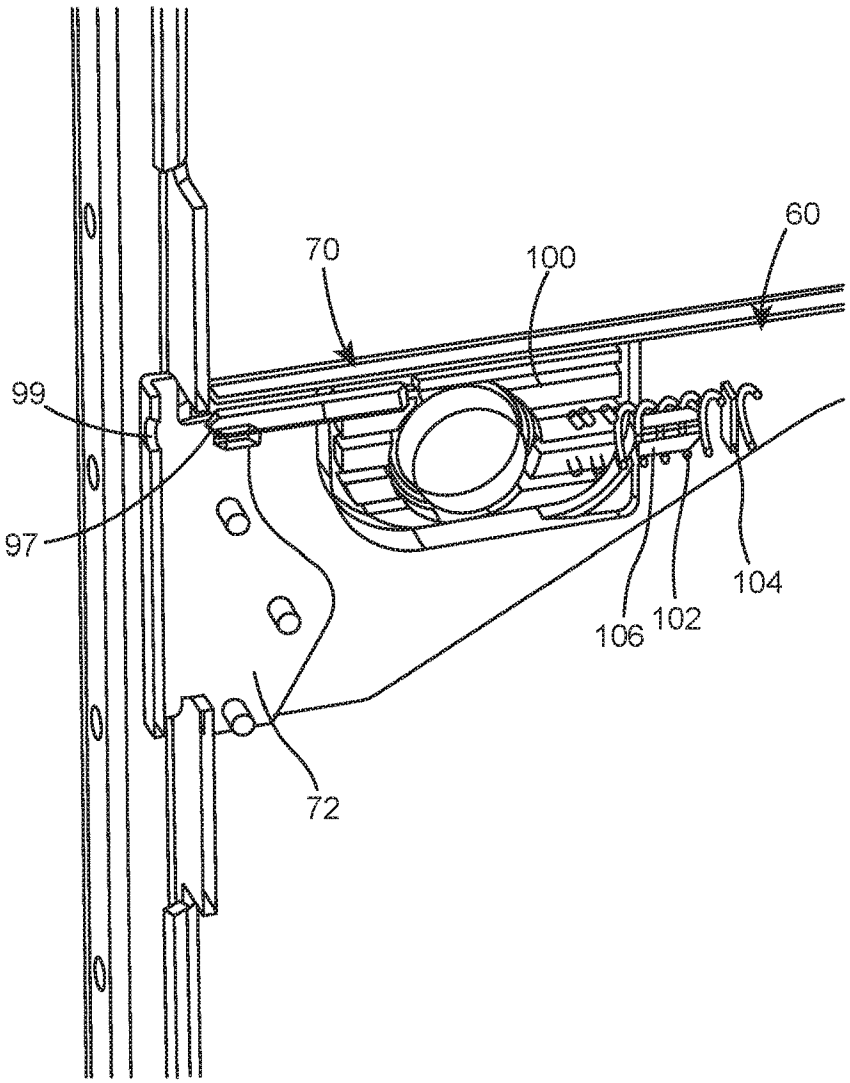
FIG. 6D is a back vertical section taken along line VI-VI in FIG. 5A.
Figure 6C:
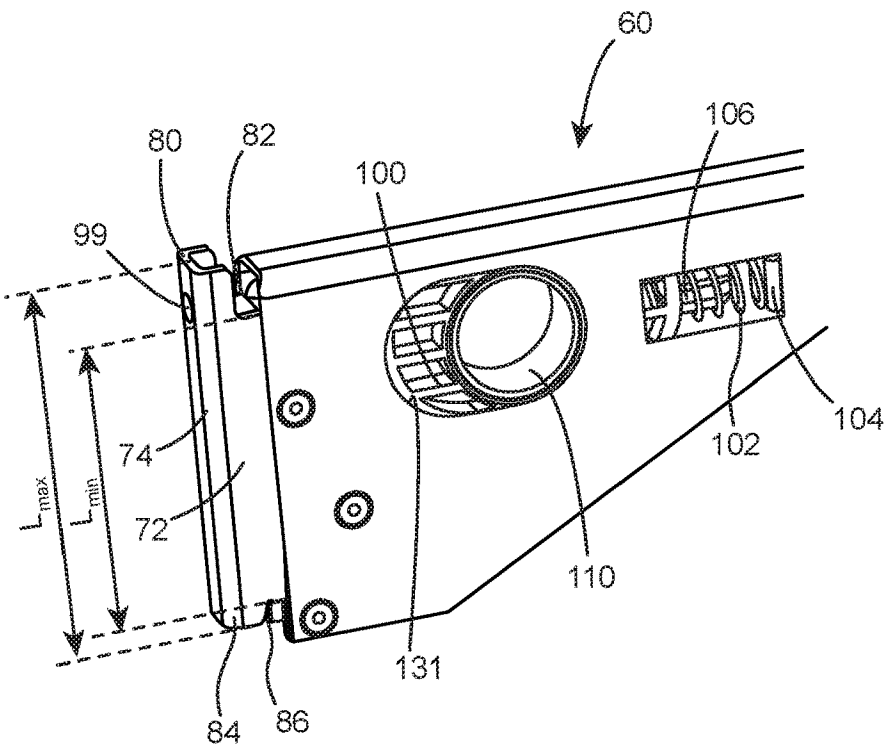
FIG. 6C is the same as FIG. 6B, with the enveloping shelve removed from the coupling member.
Figure 6F:
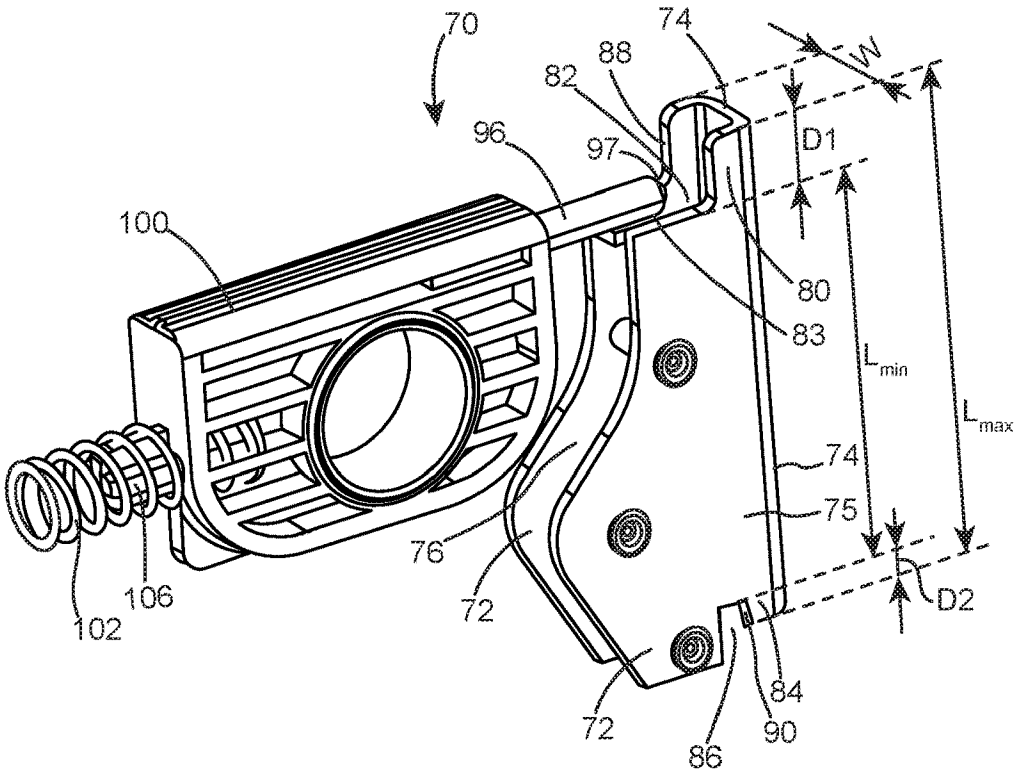
FIG. 6F is front, top perspective view of the coupling member of the present disclosure, at a locked position, isolated from other elements.
Figure 6E:
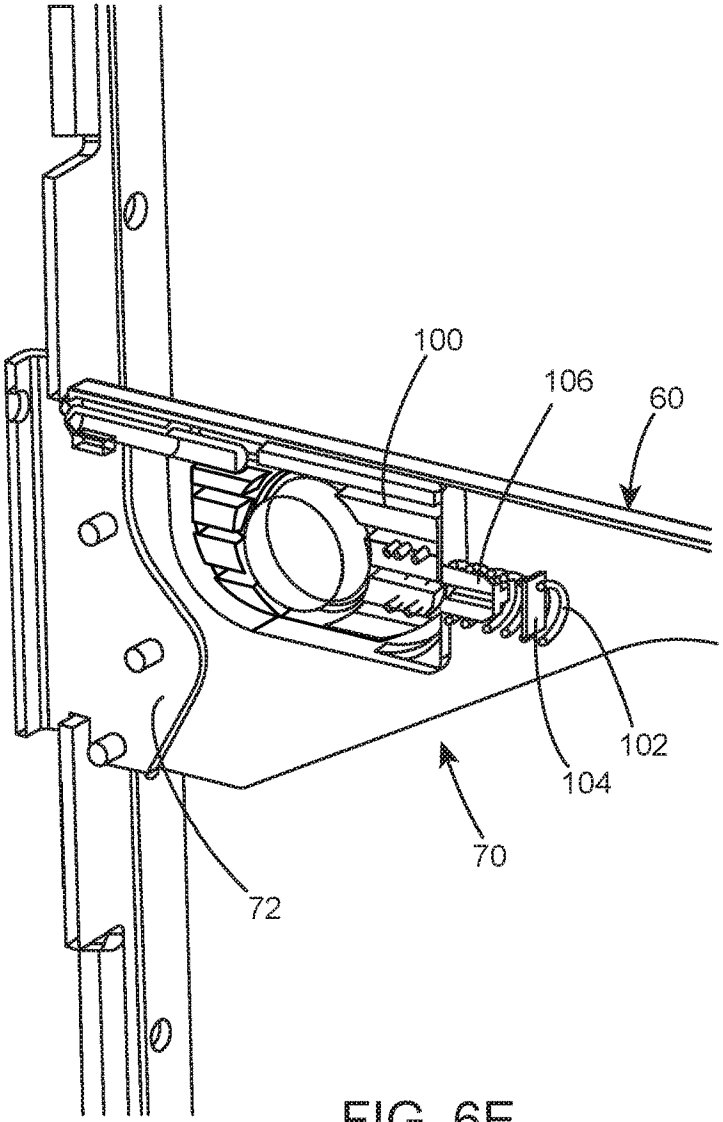
FIG. 6E is the same as FIG. 6D, however at a front view.
Figure 6G:
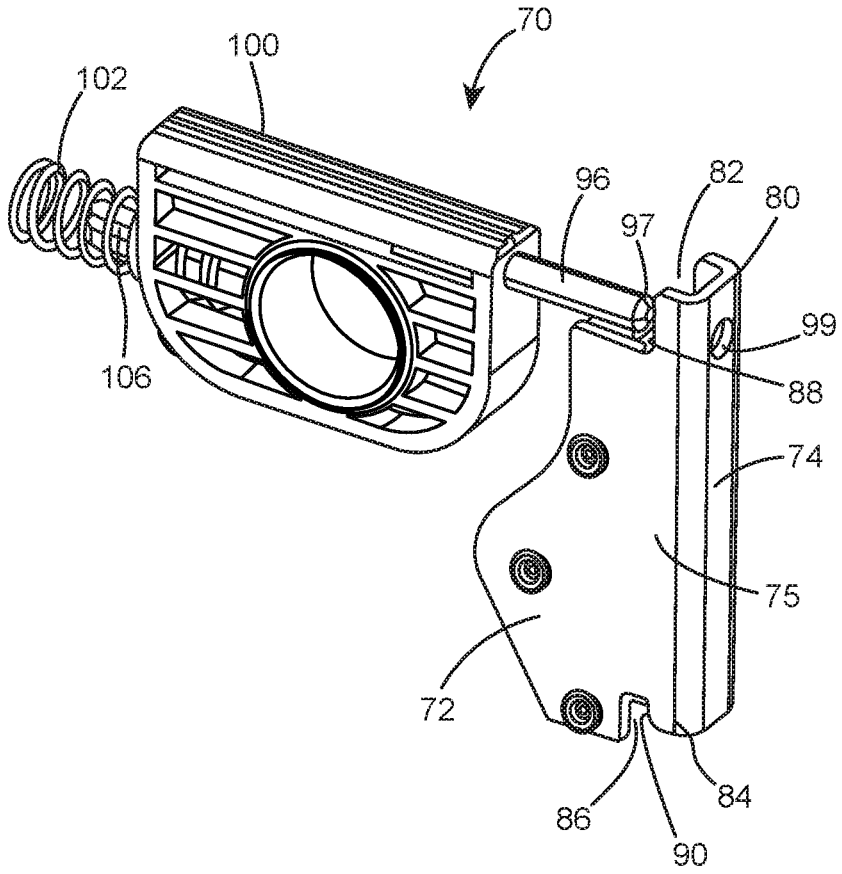
FIG. 6G is a back, top perspective view of FIG. 6F.

The coupling member 70 is further configured with an obstructing plunger 96 slidingly displaceable within the space 76 extending between the side walls 72, said obstructing plunger 96 being slidingly displaceable between a locked position (as in FIGS. 2, 3 and 4), and an unlocked position (as in FIGS. 5 and 6). At the locked position the obstructing plunger 96 projects into the first locking recess 82, above an innermost wall thereof 83, whilst at the an unlocked position the plunger is retracted into the space 76 and out of the first locking recess 82. At the locked position a chamfered distal end 97 of the obstructing plunger 96 projects through an opening 99 at the front wall portion 74, thereby supporting the plunger.

The obstructing plunger 96 is secured at a proximal end thereof within a closed trigger like manipulating member 100 fitted for only sliding displacement within the load bar 60 and comprises a biasing member in form of a coiled compression spring 102 bearing at a proximal end against a spring support 104 within the load bar 60, and at opposed, distal end, is mounted on a support boss 106 of the manipulating member 100 and bears there against. The like manipulating member 100 is configured with a secured/closed finger grip aperture 110, whereby sliding manipulating of the obstructing plunger 96 from its normally locked position to the open position is carried out by inserting one's finger into the finger grip aperture 110 of manipulating member 100 and pulling it backwards against the biasing effect of the spring 102. The secured/closed finger grip aperture 110 offers safety in the sense that the risk of pinching a user's finger is educed.

It is seen throughout the examples illustrated herein that at least a finger grip portion of the manipulating member 100 extends in register with a corresponding opening 129 in the side wall portion 50 of the shelve 40 and 131 in the coupling member 70

The minimal length $L_{min}$ between the respective inner most wall portions of the first and second locking recesses 82 and 86 is shorter than the maximal length $L_{max}$ between the ends of the first locking lug 80 and the second locking lug 84, however wherein the minimal length $L_{min}$ is smaller than the length of the locking slot 22, whilst the maximal length $L_{max}$ is greater than the length of the locking slot 22. Thus, the locking portion 75 cannot be inserted into a locking slot or removed therefrom by axial displacement, but special maneuvering is required, as will be described hereinafter with reference to FIGS. 7A to 7D.

Further appreciated, at the normally locked position, wherein the obstructing plunger 96 is disposed within the first locking recess 82, it in fact increase the minimal length, giving rise to an effectively 'locked length' $L_{lock}$ wherein $L_{min}<L_{lock}<L_{ma}$. Thus the arrangement is such that articulation or detaching of the coupling member 70 from the mounting racks 12 takes place by displacing the coupling member so that the first locking recess 82 encounters the first narrow edge 28 of the rectangle locking slot 22, thereby facilitating tilting of the coupling member 70 so that the second narrow edge 30 of the rectangle locking slot 22 can swing over the second locking lug 84, into or out of the second locking recess 86, i.e. into respective articulation or detaching from the wall mount. However, displacing the coupling member 70 such that the first locking recess 82 encounters the first narrow edge 28 of the rectangle locking slot 22 can be facilitated only when the obstructing plunger 96 is at the retracted, unlocked position.

The arrangement is such that at the locked position the obstructing plunger is disposed within the top locking recess thus preventing lateral displacement of coupling member so that the first locking recess displaces towards encountering with the edge of the locking slot of the wall mount, thus prohibiting engagement with or disengagement from, the wall mount, respectively.

Turning now to FIGS. 7A to 7D it will be explained how a shelve 40 is detached from a supporting mounting rack 12. It is appreciated that the shelve 40 is articulated to two mounting rack 12, whereby unlocking of the coupling member 70 members should be performed simultaneously, e.g. using the two index fingers of the individual. For sake of clarity reference hereinafter is made to manipulating a single coupling member 70.

At a first stage, the manipulating member 100 is retracted by introducing a finger into the finger grip aperture 110 and displacing it against the biasing effect, in direction of arrow 140, into the unlocked position (FIG. 7A), resulting in corresponding retraction of the obstructing plunger 96 into the unlocked position. Now only can detaching take place.

At a second stage, the shelve 40 is displaced upwards, in direction of arrow 144 (FIG. 7B), whereby an innermost wall thereof 83 of the first locking recess 82 encounters the first narrow edge 28 of the locking slot 22.

Figure 7A:
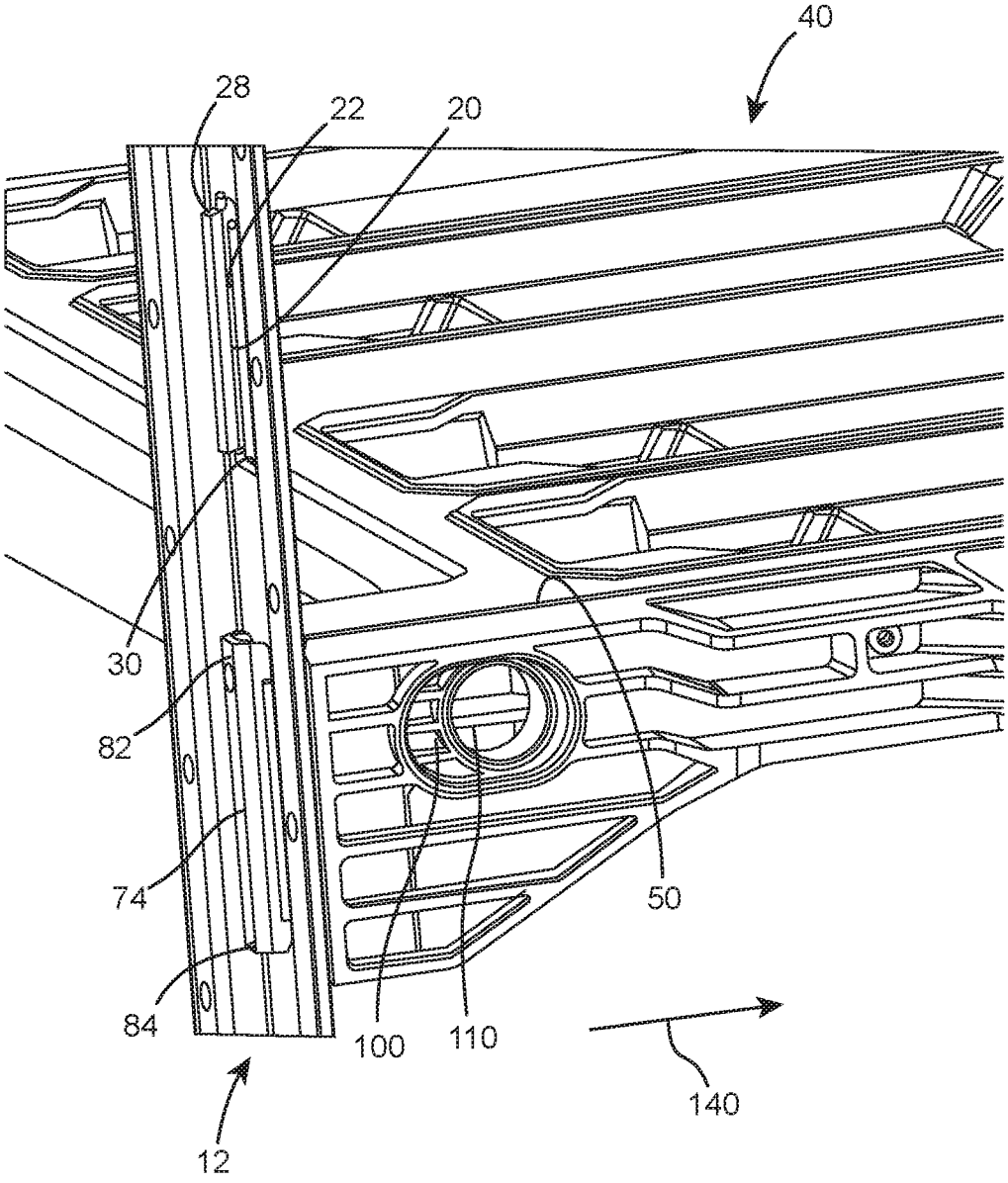
FIGS. 7A to 7D are perspective back views illustrating consecutive steps of detaching a utility module, namely a shelve system from a wall mount rack.
Figure 7B:
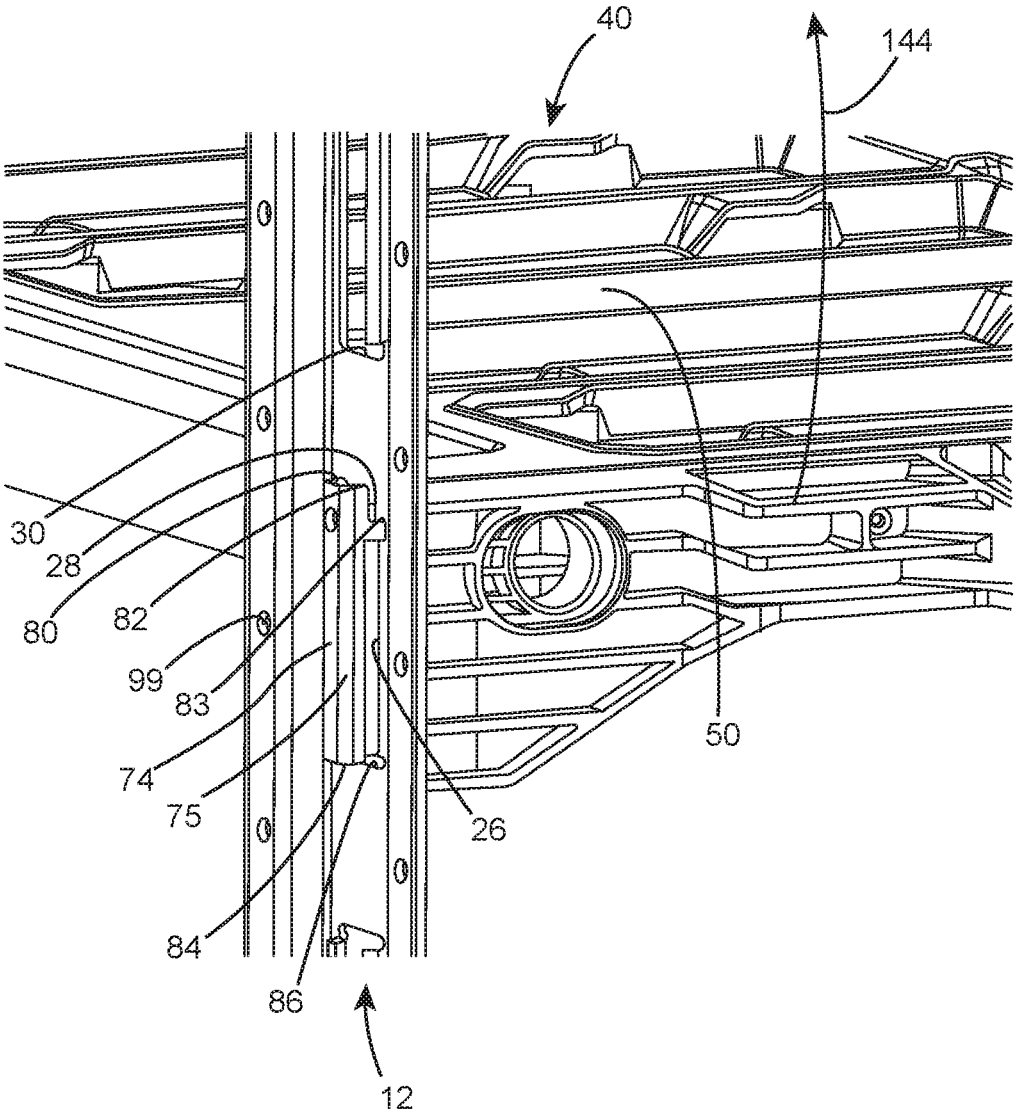
Figure 7D:
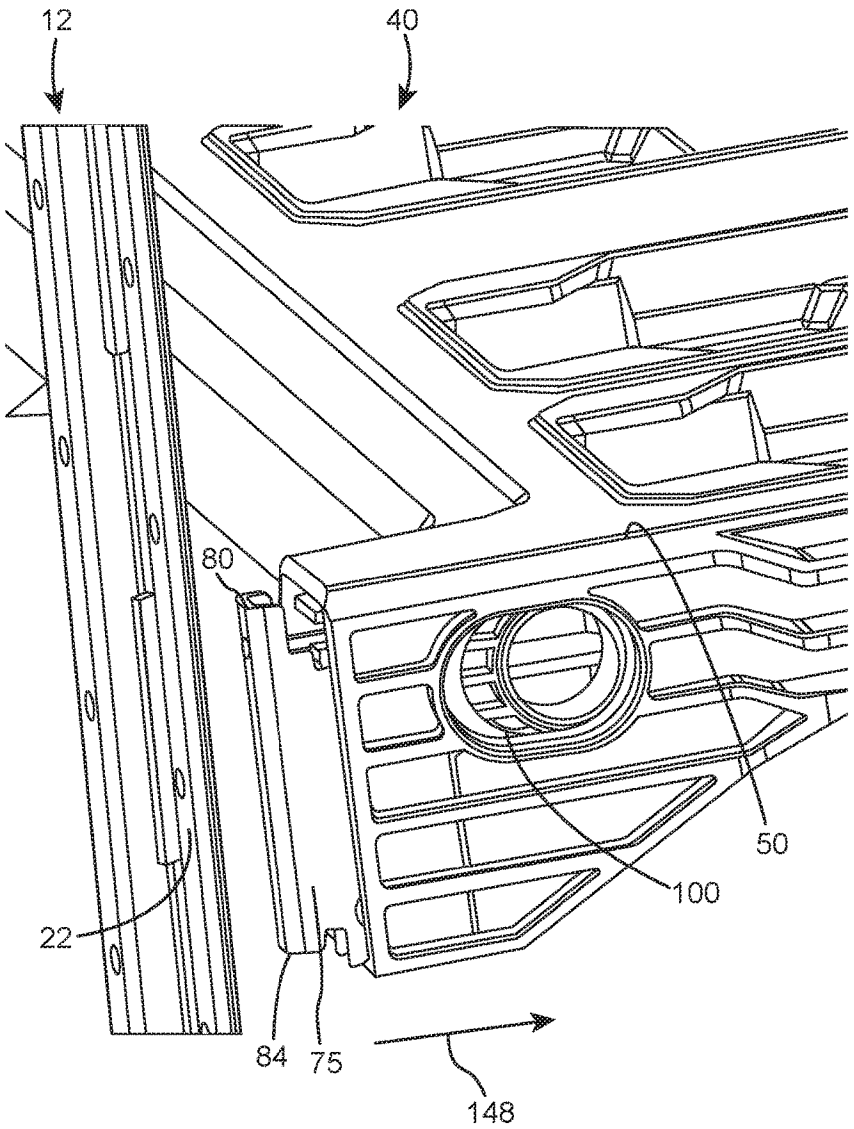
Figure 7C:
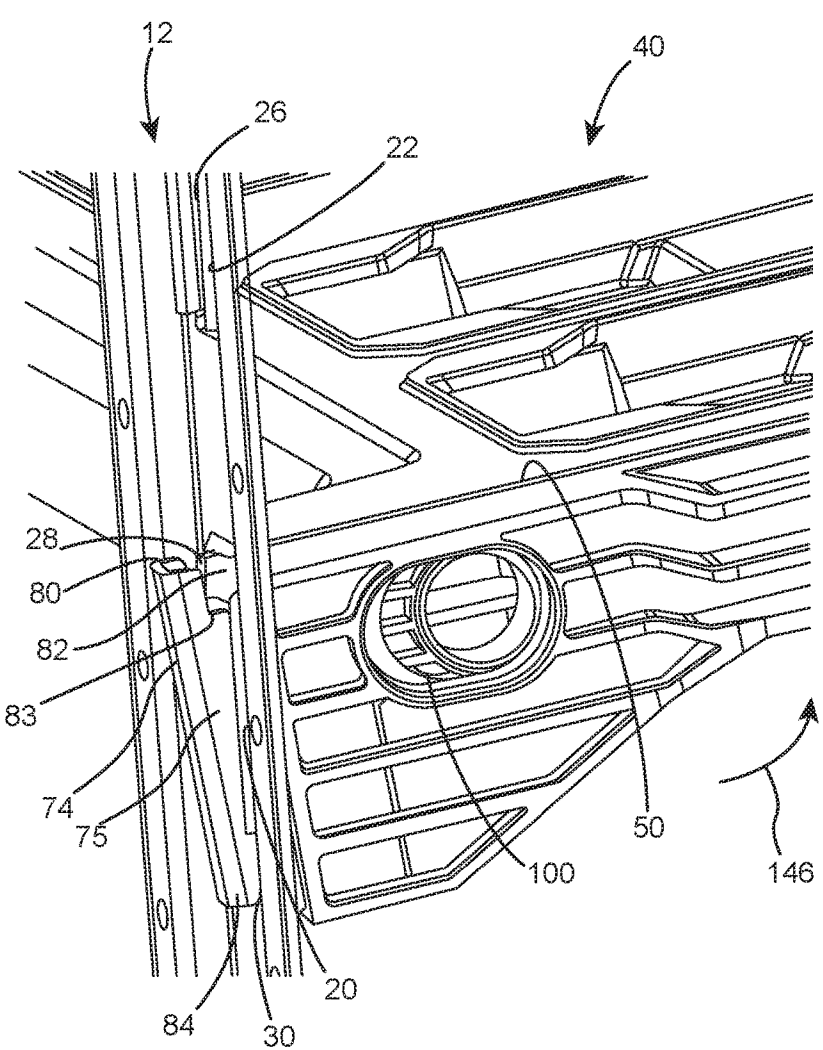

At a third stage, the shelve 40 is tilted upwards, in direction of arrow 146 (FIG. 7C) whereby the second locking lug 84 is free to swing out from the locking slot 22, from the second narrow edge 30 of locking slot 22, and finally wherein the shelve 40 can be removed (148 in FIG. 7D).

It is appreciated that mounting a shelve (or any other utility module configured with a coupling member according to the disclosure, takes place in a reverse sequence of operations, however wherein attaching the coupling member to the mounting rack or other wall mount, is possible only upon displacing the obstructing plunger into its retracted, unlocked position.

Figure 8B:
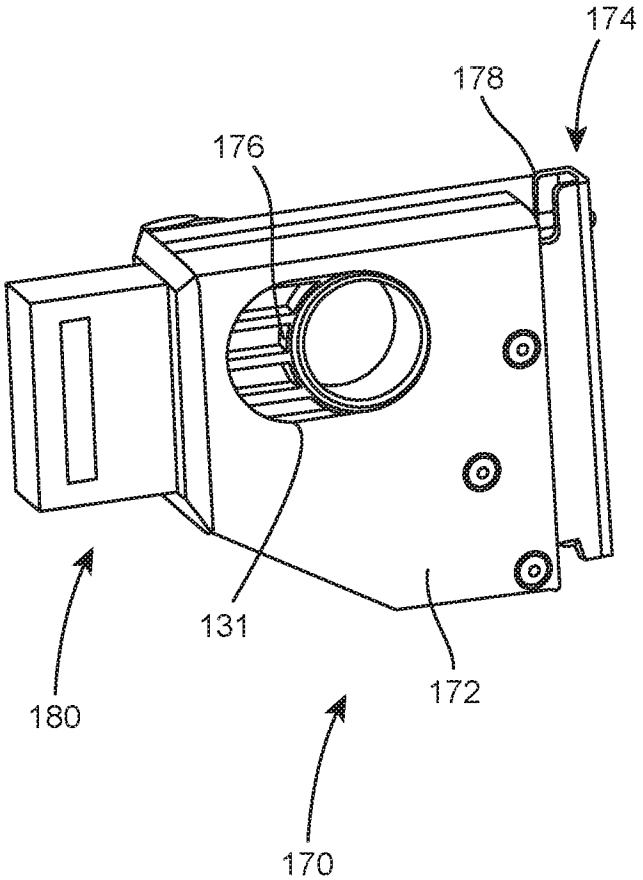
FIG. 8B is a perspective view of a coupling member according to the present disclosure, wherein the utility module is configured at a distal end with a utility module articulation member.
Figure 8A:
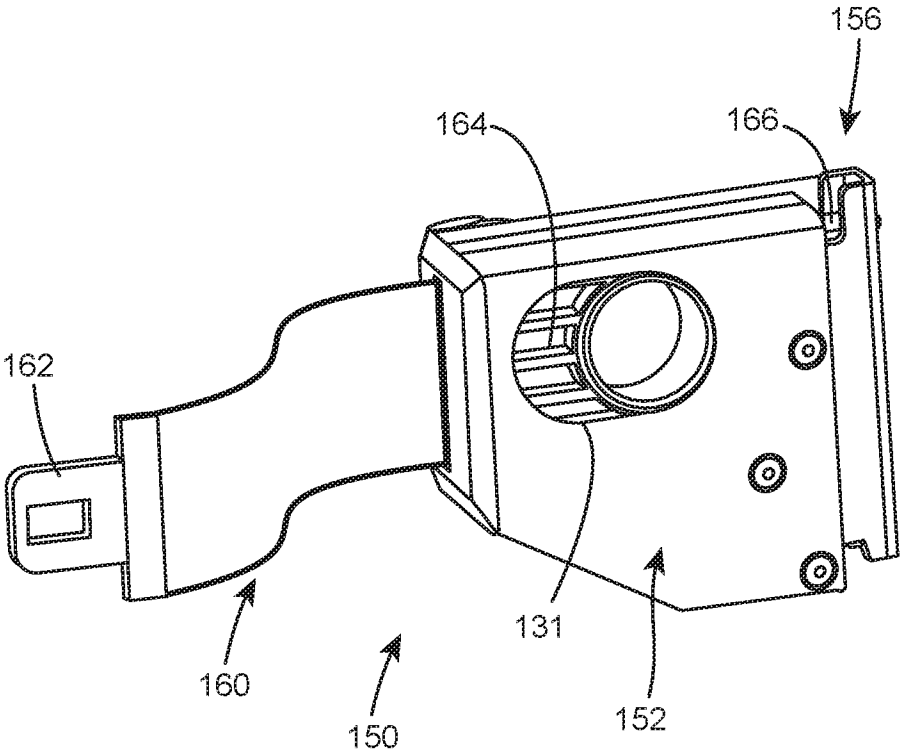
FIG. 8A is a perspective view of a coupling member according to the present disclosure, wherein the utility module is an integrated a fastening strap.

FIG. 8A illustrates a coupling member according to the present disclosure, generally designated 150, configured with a hosing portion 152 having at a distal end thereof a locking portion 156 similar to locking portion 75 disclosed hereinabove, and at a proximal end (utility portion) it is integrally configured with a securing belt 160 having a locking buckle 162 at its free end. A manipulating member 164 is configured for manipulating the obstructing plunger 166 as disclosed herein before.

In the example of FIG. 8B a coupling member according to the present disclosure, generally designated 170, is configured with a hosing portion 172 having at a distal end thereof a locking portion 174 similar to locking portion 75 disclosed hereinabove, with a manipulating member 176 is configured for manipulating the obstructing plunger 178 as disclosed herein before and at a proximal end (utility portion) it is integrally configured with a utility module attachment generally designated 180 and configured for articulation thereto any utility module (not shown).

Figure 9:
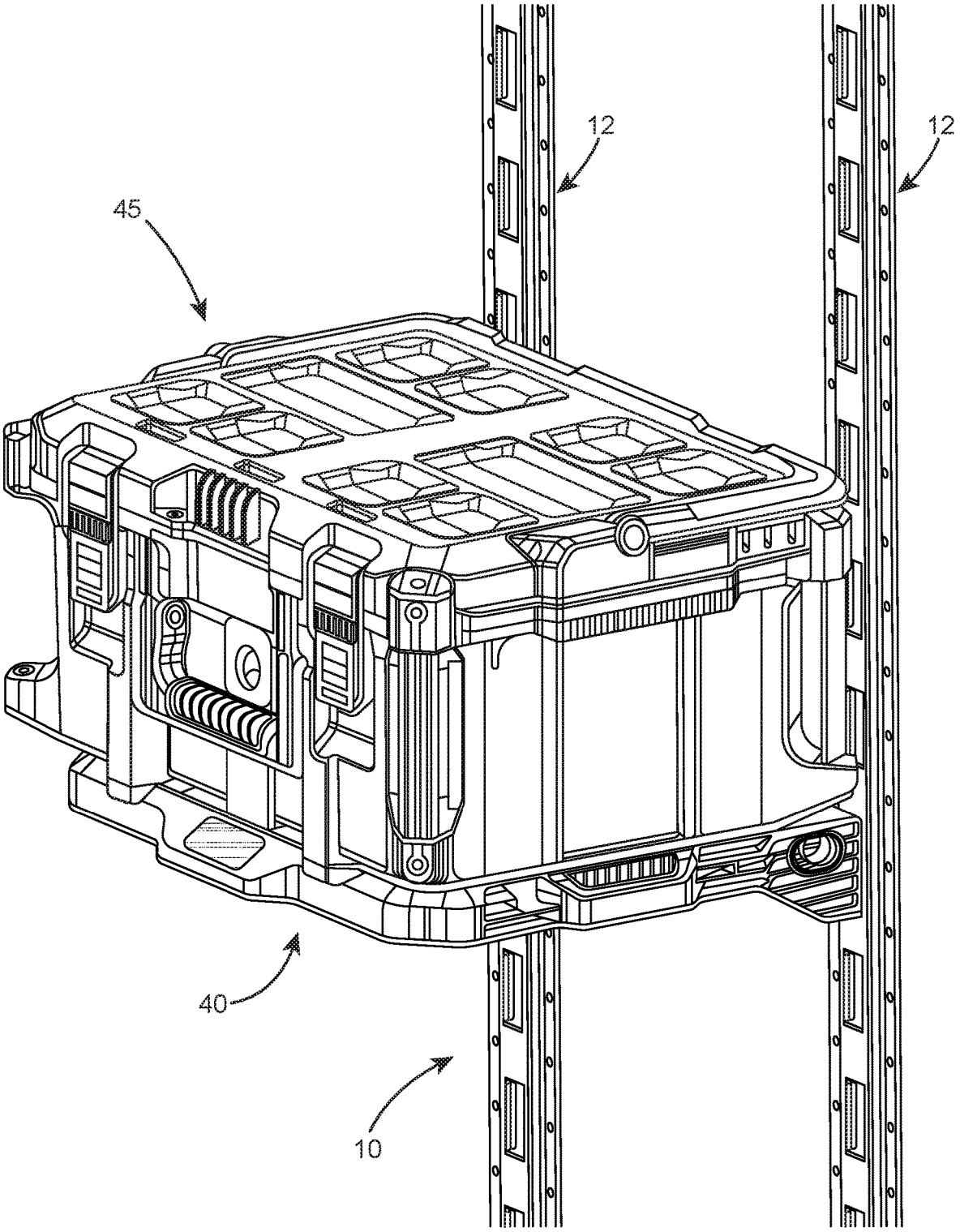
FIG. 9 illustrates the rack system of FIG. 1, with a utility module detachably attached to the rack system.
Figure 10B:
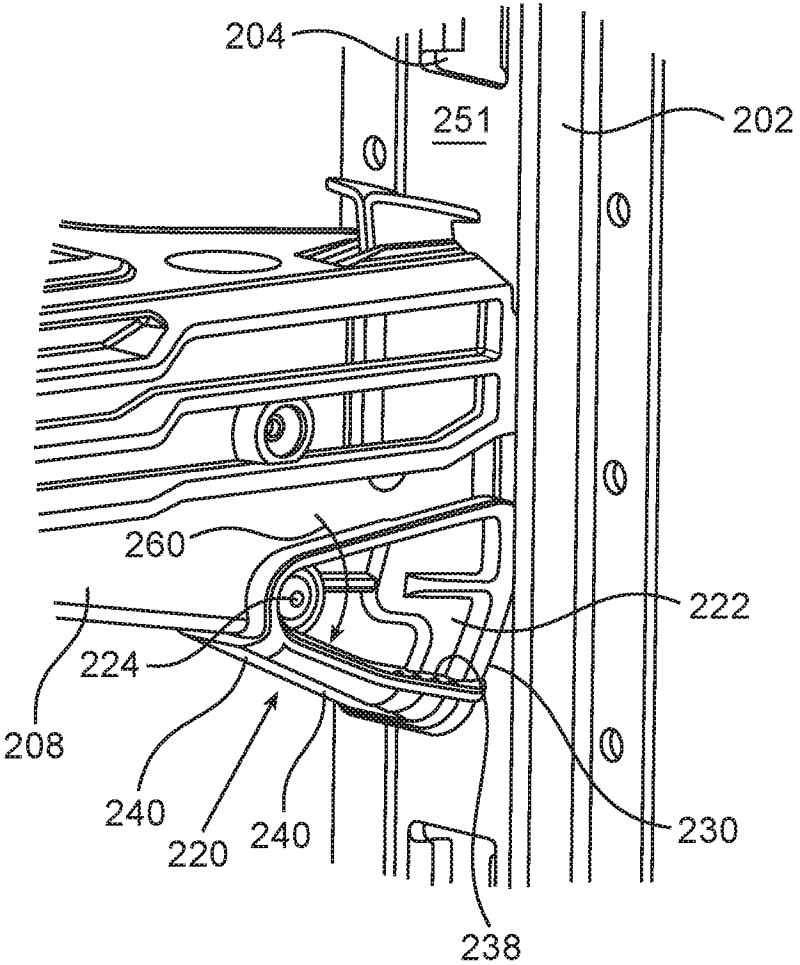
FIG. 10B is an enlargement of the portion marked 10B in FIG. 10A.
Figure 10A:
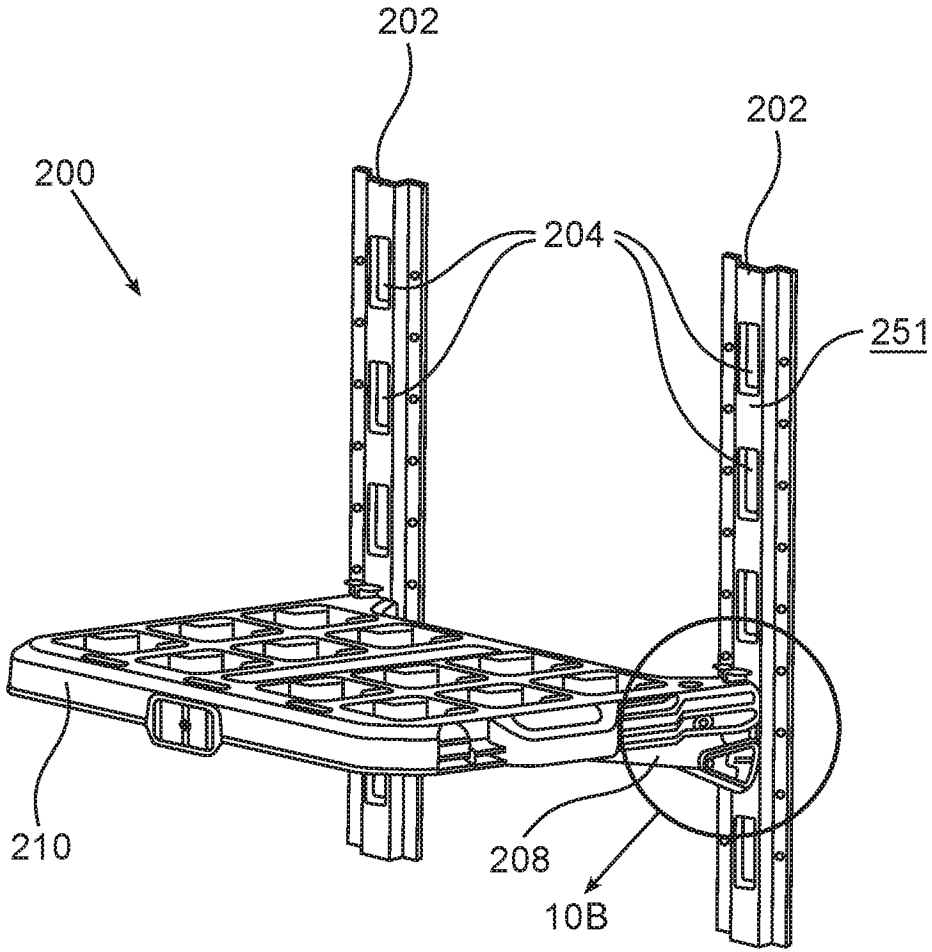
FIG. 10A is a perspective view of a rack system configured with a tolerance cancelation mechanism, according to an aspect of the disclosure, the system illustrated at a locked position.
Figure 10D:
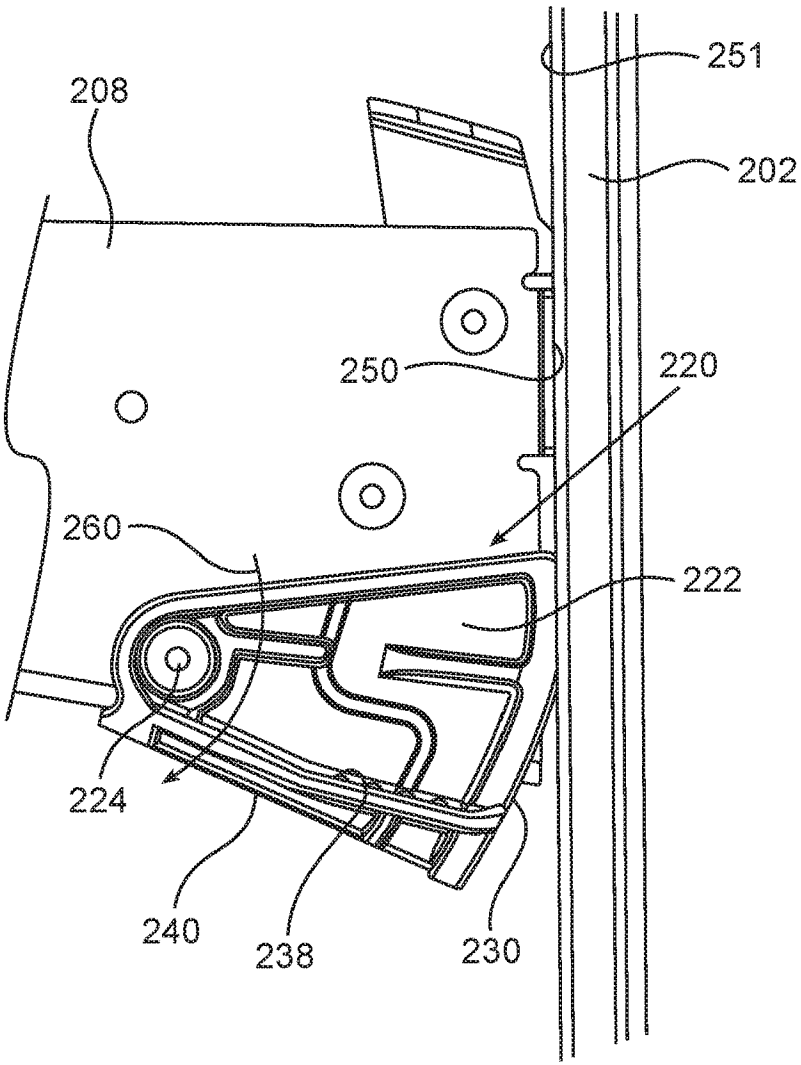
FIG. 10D is a planar side view of FIG. 10C.
Figure 10C:
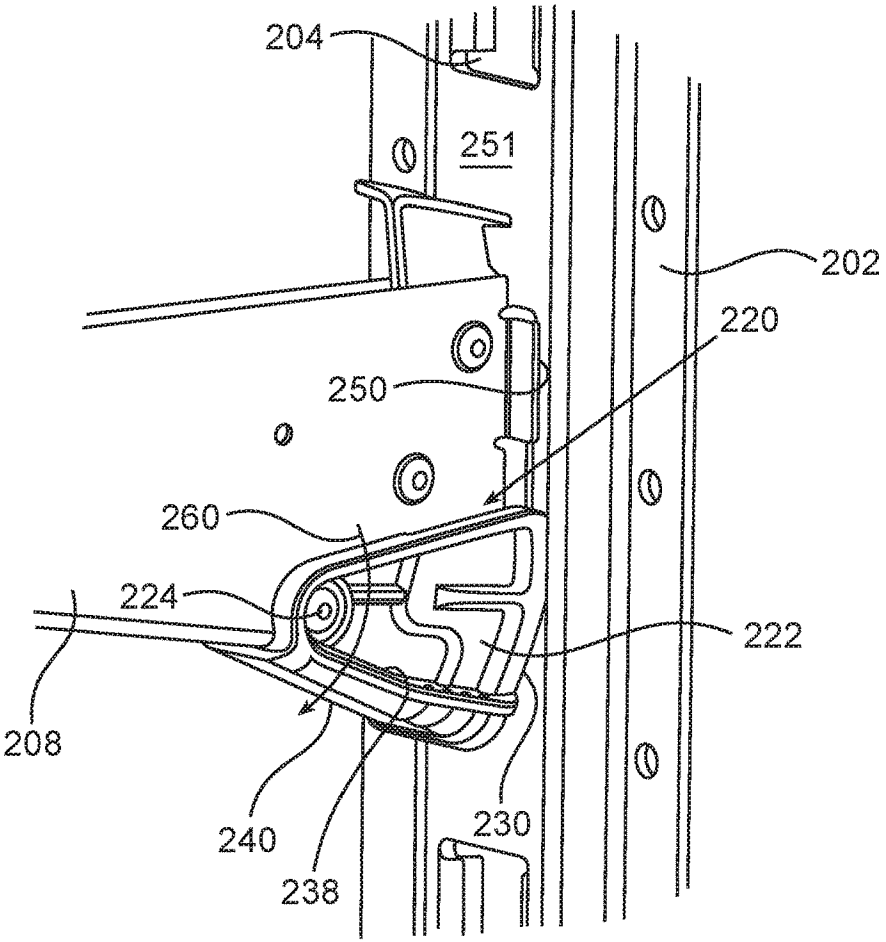
FIG. 10C is the same as FIG. 10B, with a support shelve removed for sake of clarity.
Figure 10F:
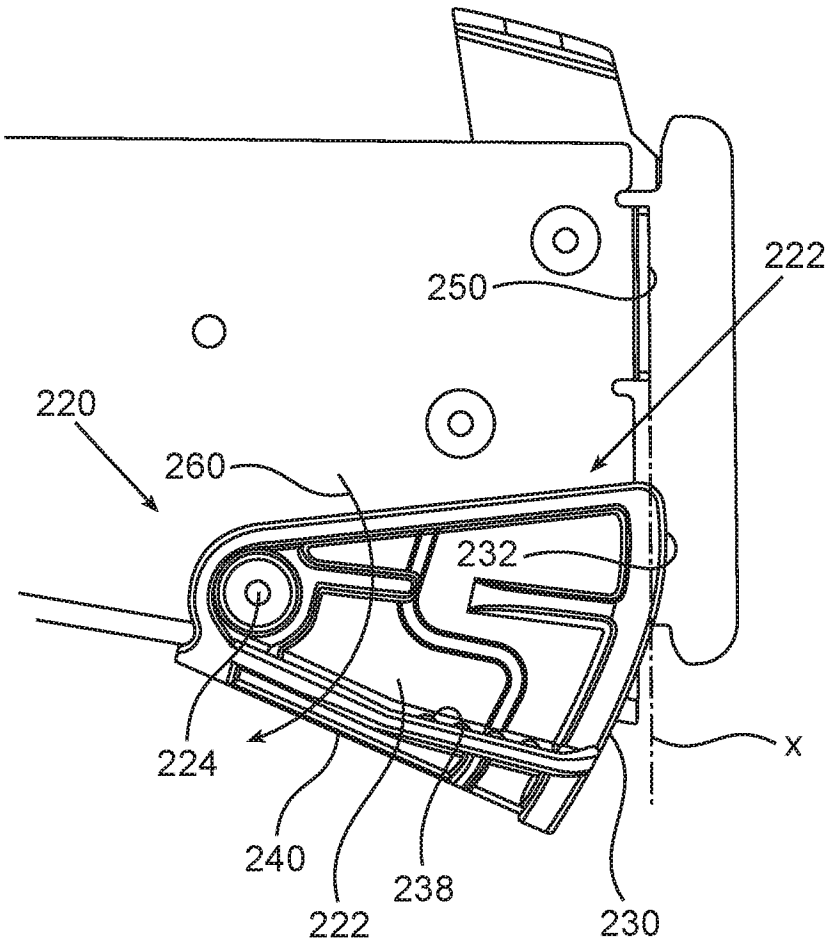
FIG. 10F is a planar side view of FIG. 10E.
Figure 10E:
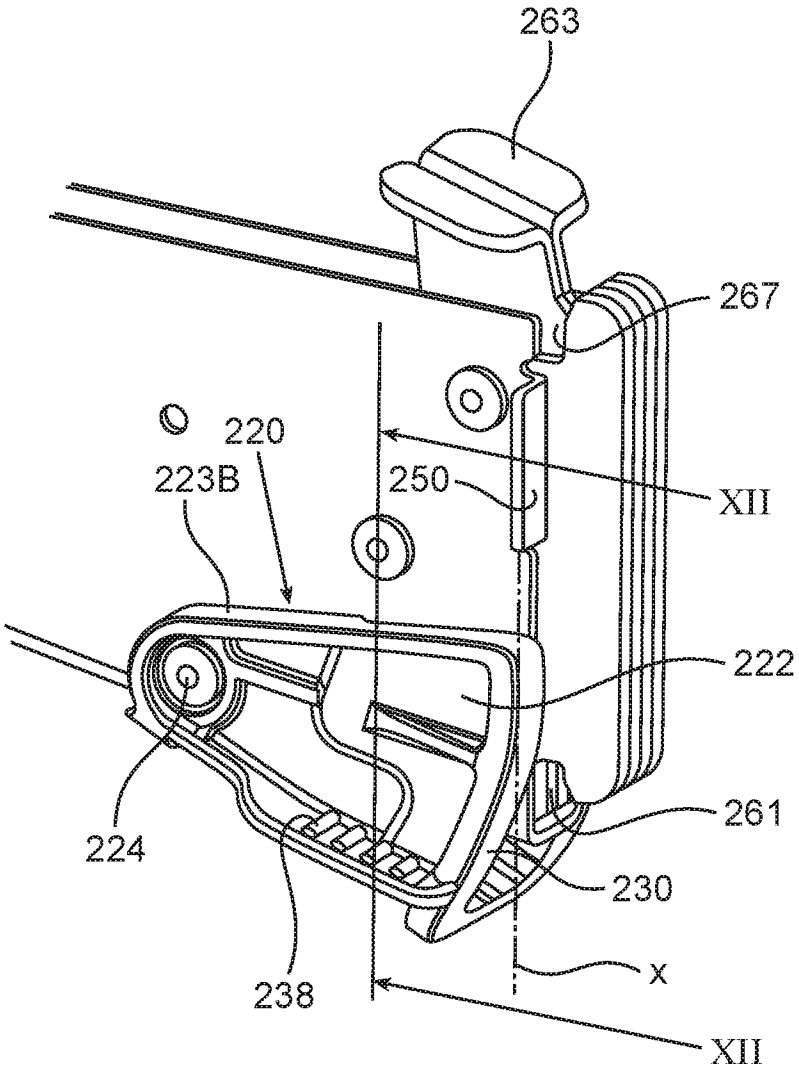
FIG. 10E is a proximal perspective view of a portion of only the wall coupling member with the tolerance cancelation mechanism at the locked position.

The example of FIG. 9 illustrates the wall mounted rack system 10 of FIG. 1, with a shelve 40 articulated to the mounting racks 12 and with a container 45 detachable articulated to the multi-location modular articulating system 46 at a top face of the shelve 40.

Further attention is now directed to FIGS. 10 to 15, directed to yet an aspect of the disclosure, concerned with a tolerance cancelation mechanism for use in conjunction with a coupling member of a rack system. Whilst the following drawings make reference to a particular rack system, it is appreciated that the tolerance cancelation mechanism of the present disclosure can be used with other rack systems as well, setting as an example the rack mounting system exemplified herein before with reference to the preceding drawings.

It is further appreciated that the wall mount can be of any shape and size, applicable over any surface, at any orientation, and can be configured with any one or more mounting/locking slots.

The wall mounting rack system generally designated 200 (FIG. 10A) comprises two parallelly disposed wall mountable racks 202, each configured with a plurality of elongate mounting slots 204. A pair of wall coupling members 208 is provided (FIG. 10G), one of which is articulated to the respective wall rack 202, and a support shelve 210 mounted over both wall coupling members 208 and secured thereto. U.S. Pat. No. 8,028,845 discloses a rack mounting system similar to that illustrated in FIGS. 10 to 15, however is devoid of the tolerance cancelation mechanism as will be disclosed hereinafter.

Figure 11B:
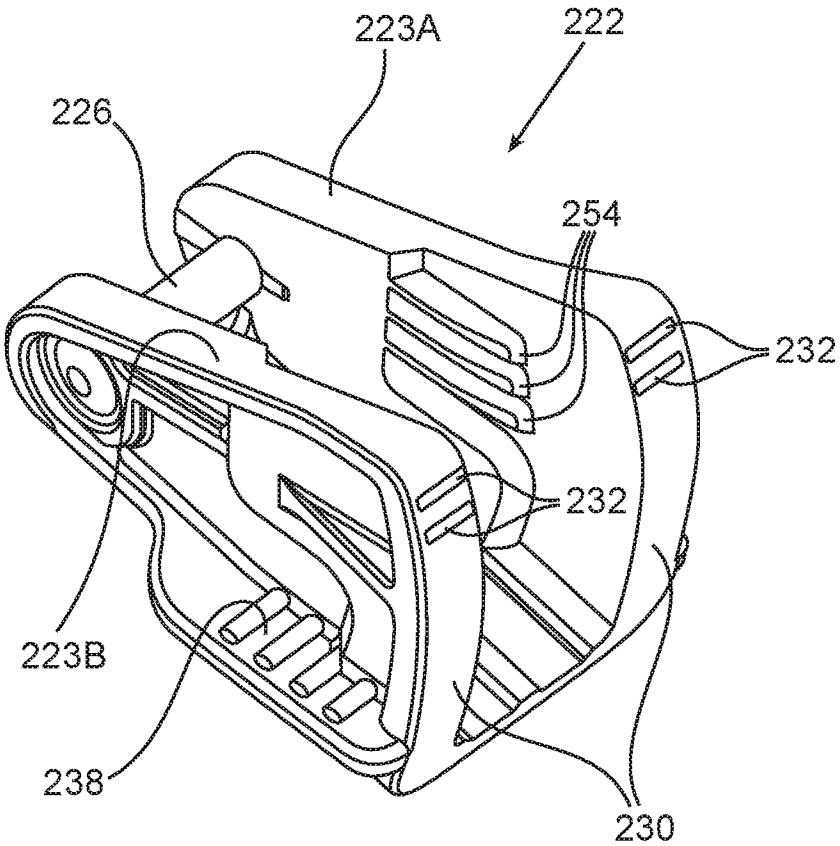
FIG. 11B is a perspective view of a fastener member of the tolerance cancelation mechanism.
Figure 10G:
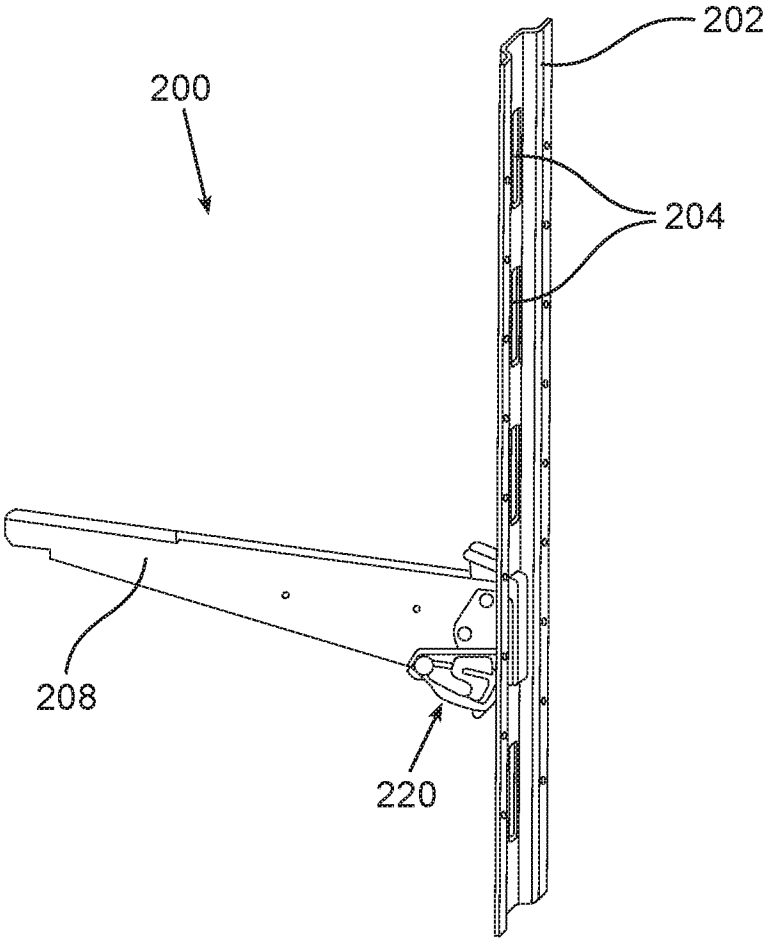
FIG. 10G is a proximal perspective view of one only the wall coupling member articulated to a wall mount.

A tolerance cancelation mechanism generally designated 220 is provided, comprising a fastener member 222 pivotally articulated at 224 to the wall coupling member 208 about a horizontally disposed axle 226 (FIG. 11B).

Figure 11A:
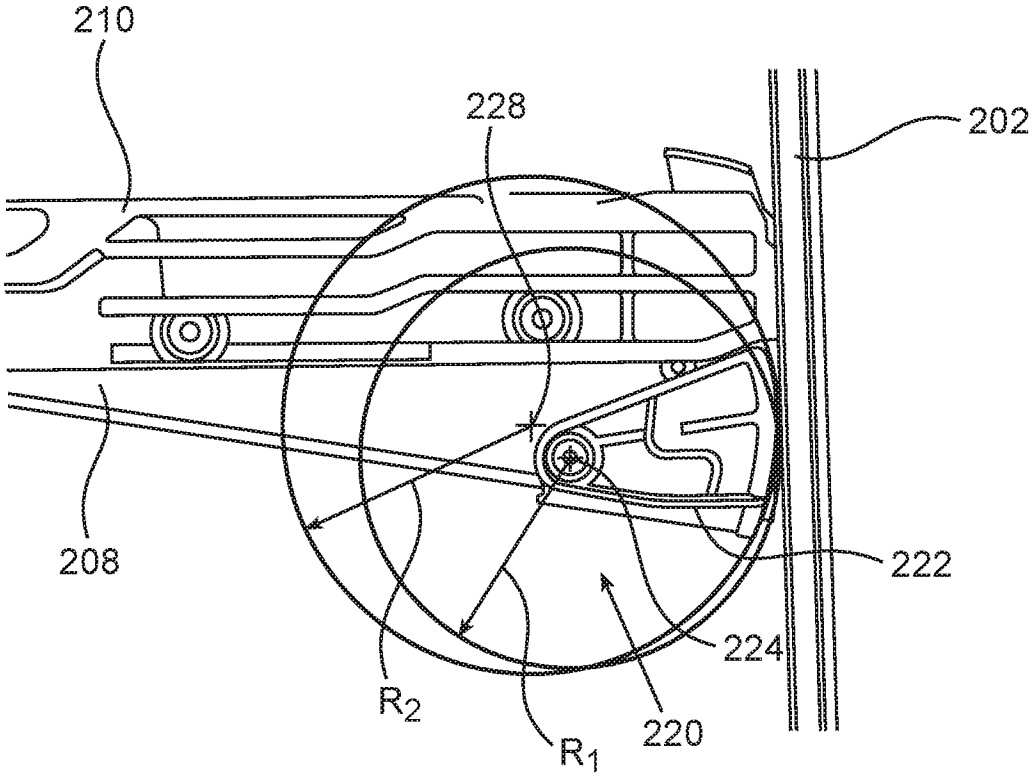
FIG. 11A is a side, partial image, of the rack system configured with a tolerance cancelation mechanism, at an open position.
Figure 13A:
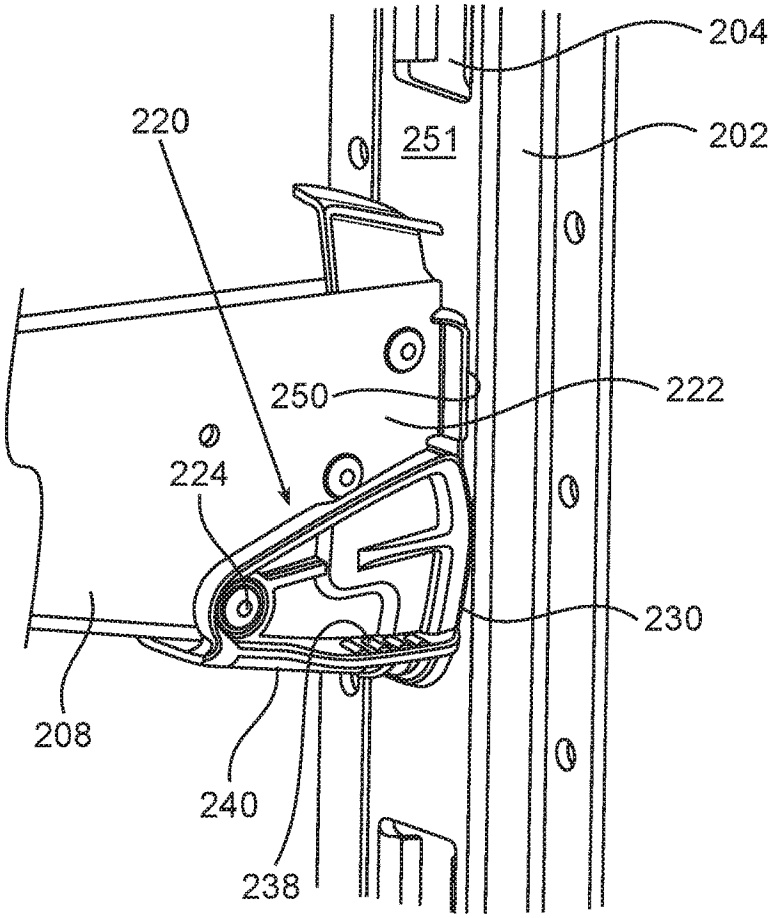
FIG. 13A is the same as FIG. 10C, however with the tolerance cancelation mechanism at the unlocked position.
Figure 12:
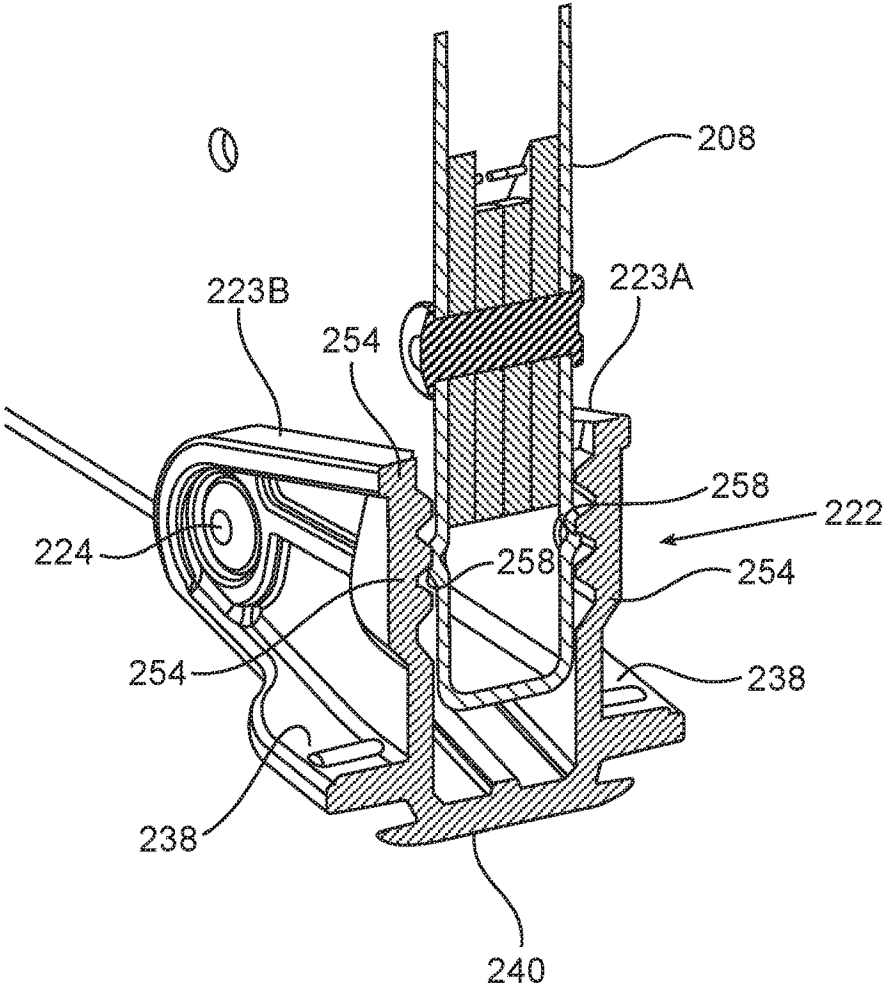
FIG. 12 is a sectioned view along line XII-XII in FIG. 10E.
Figure 13C:
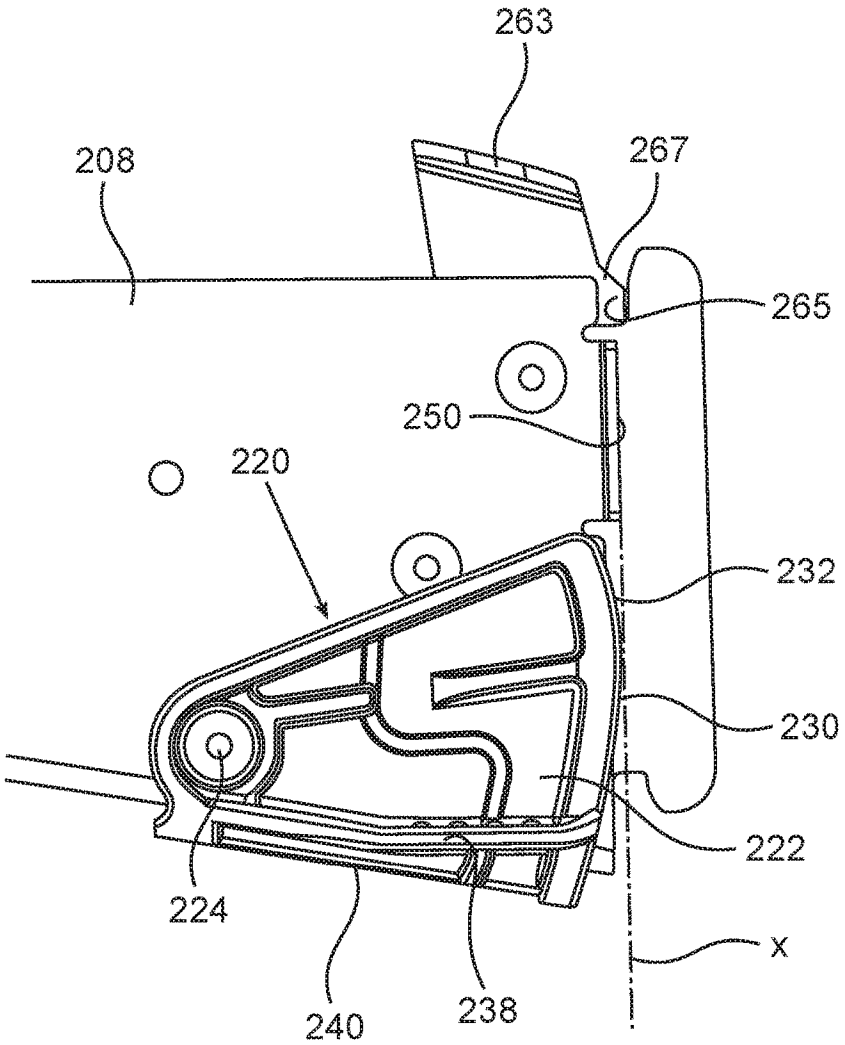
FIG. 13C is the same as FIG. 13B, with the mounting rack removed.
Figure 13B:
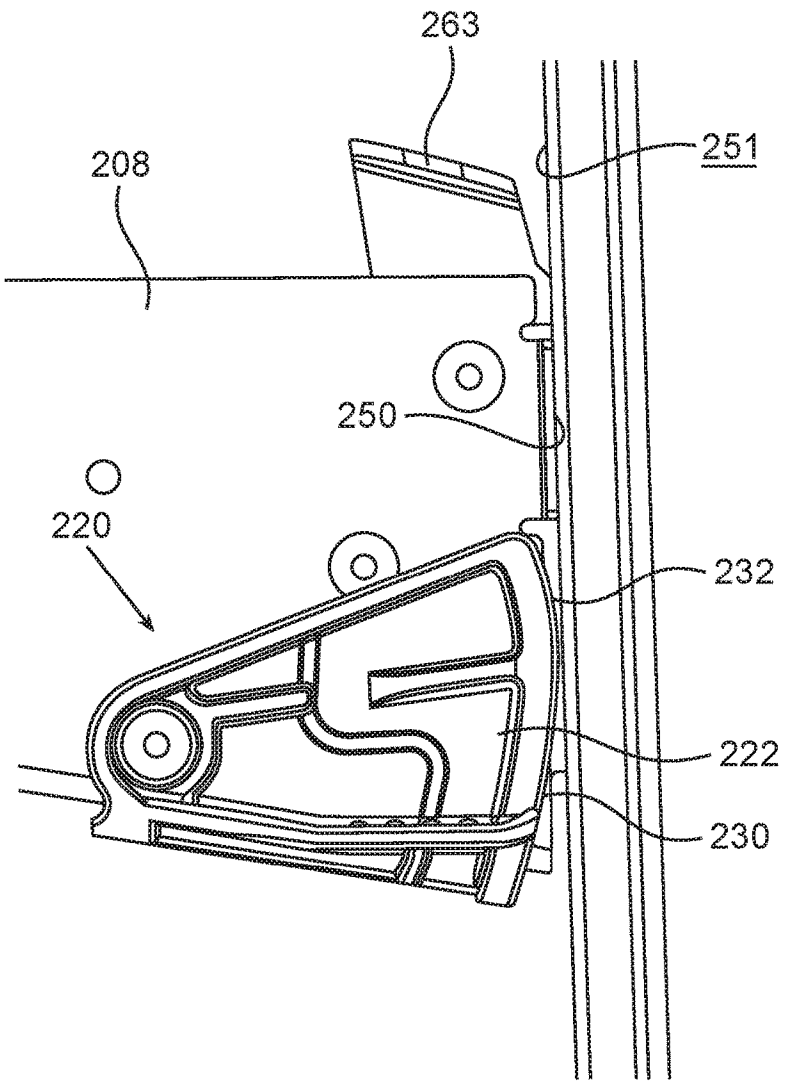
FIG. 13B is a planar side view of FIG. 13A.
Figure 14A:
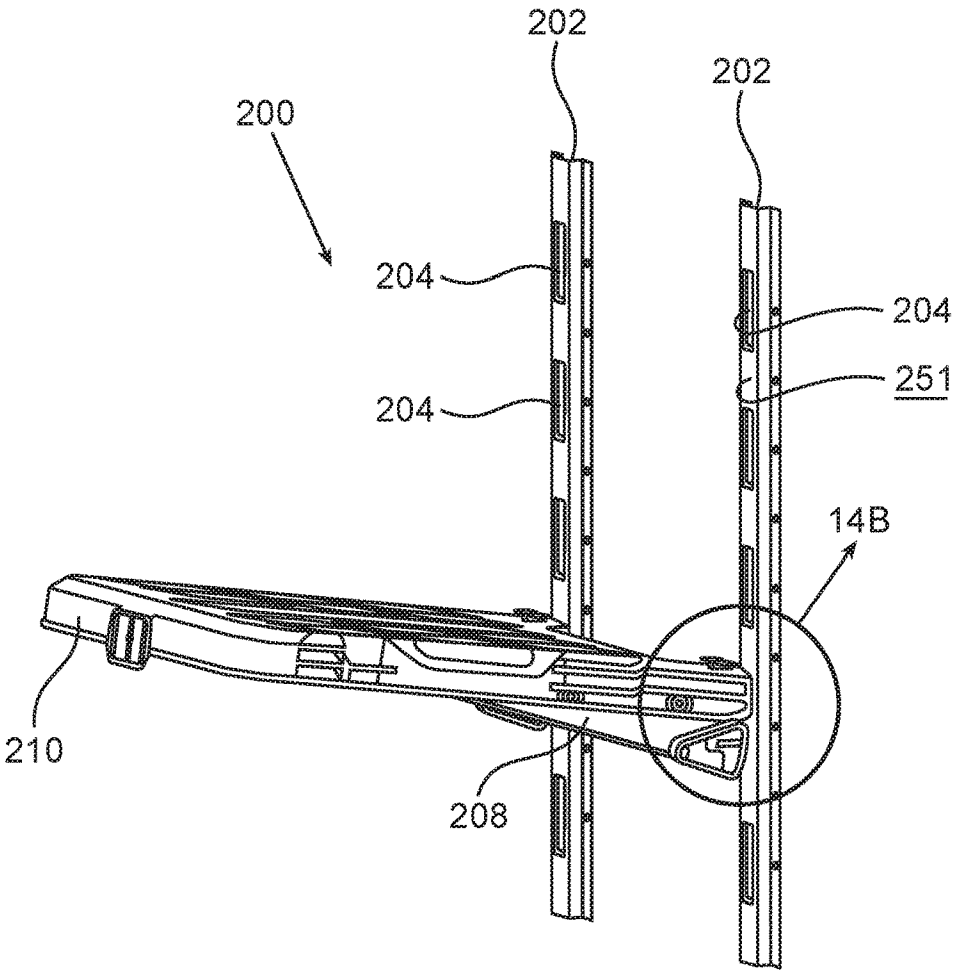
FIG. 14A is a perspective view of a rack system configured with a tolerance cancelation mechanism, the system illustrated at a rack-mounting position.
Figure 13D:
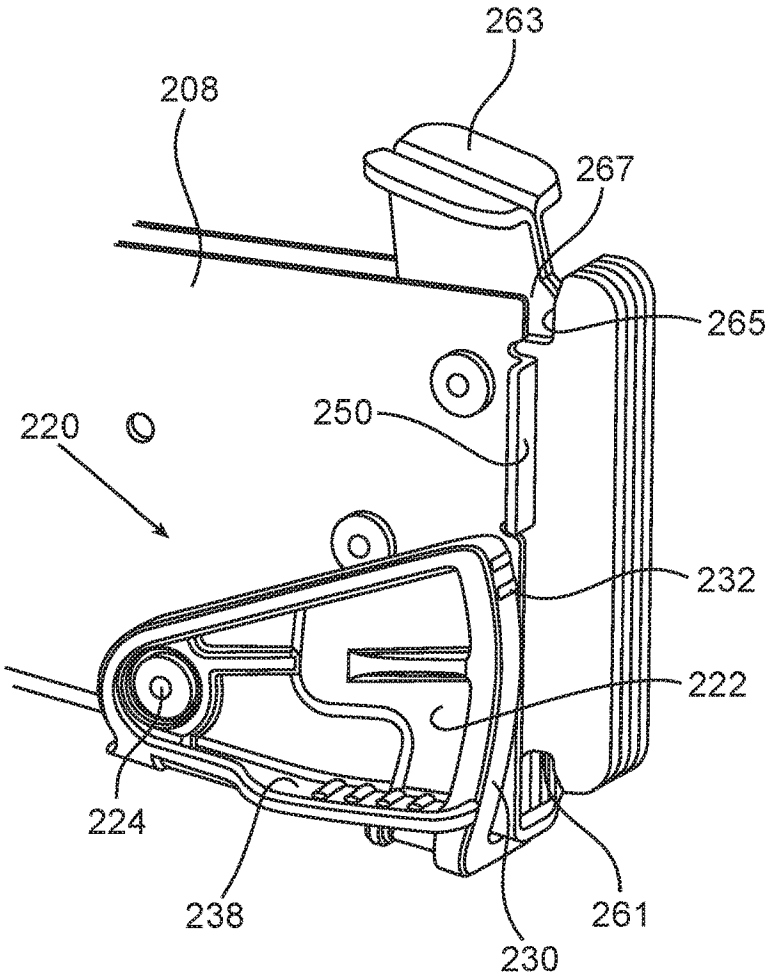
FIG. 13D is a proximal perspective view of a portion of only the wall coupling member with the tolerance cancelation mechanism at the unlocked position.
Figure 14C:
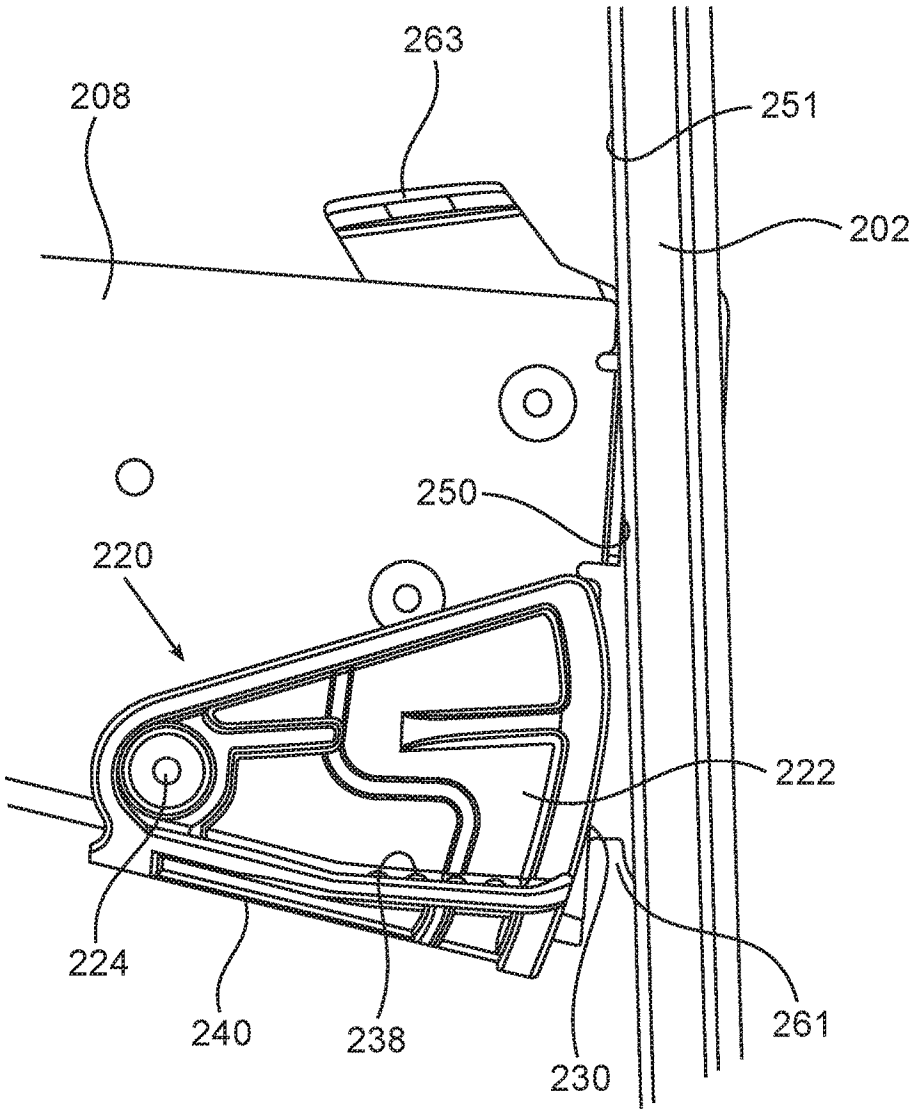
FIG. 14C is a planar side view of FIG. 14B.
Figure 14B:
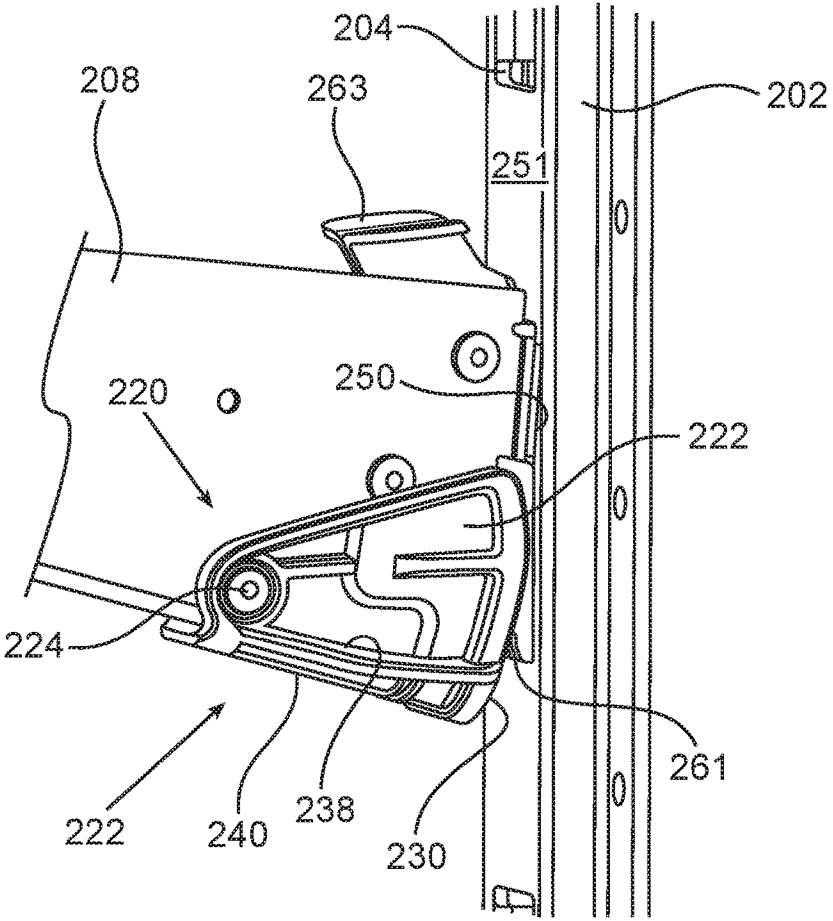
FIG. 14B is an enlargement of the portion marked 14B in FIG. 14A, with a support shelve removed for sake of clarity.
Figure 15A:
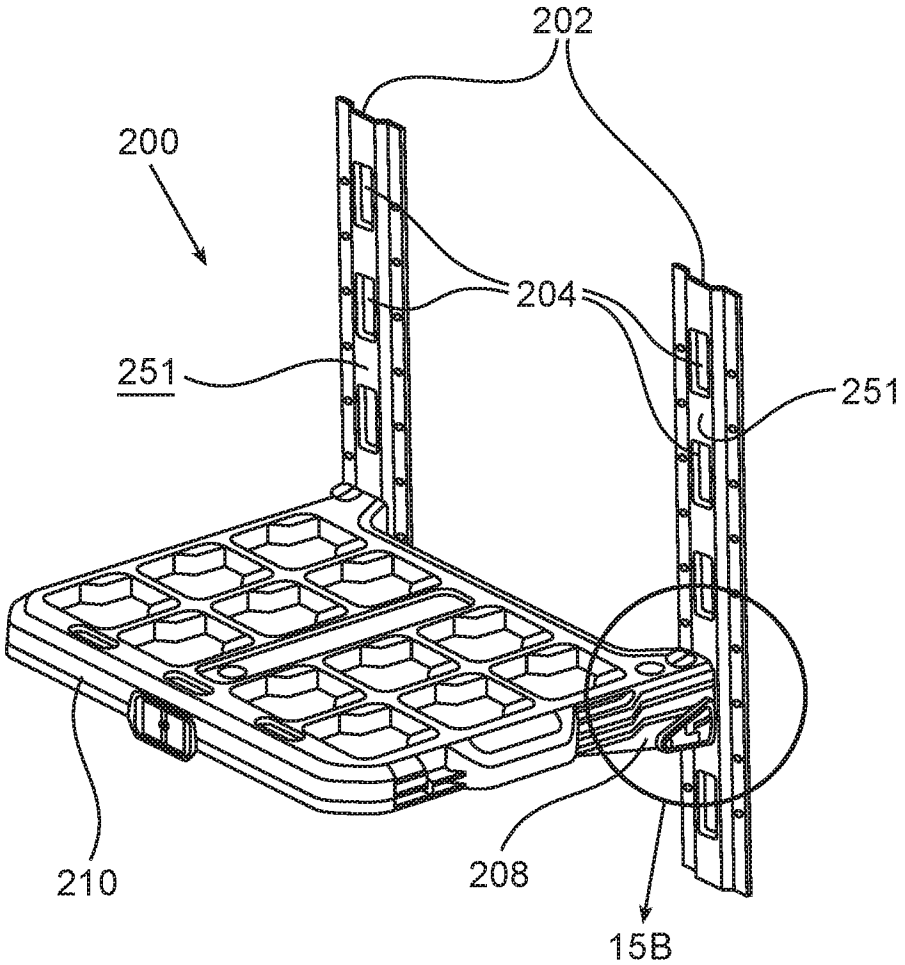
FIG. 15A is a perspective view of a rack system configured with a tolerance cancelation mechanism, the system illustrated at a rack unmounting position.
Figure 14D:
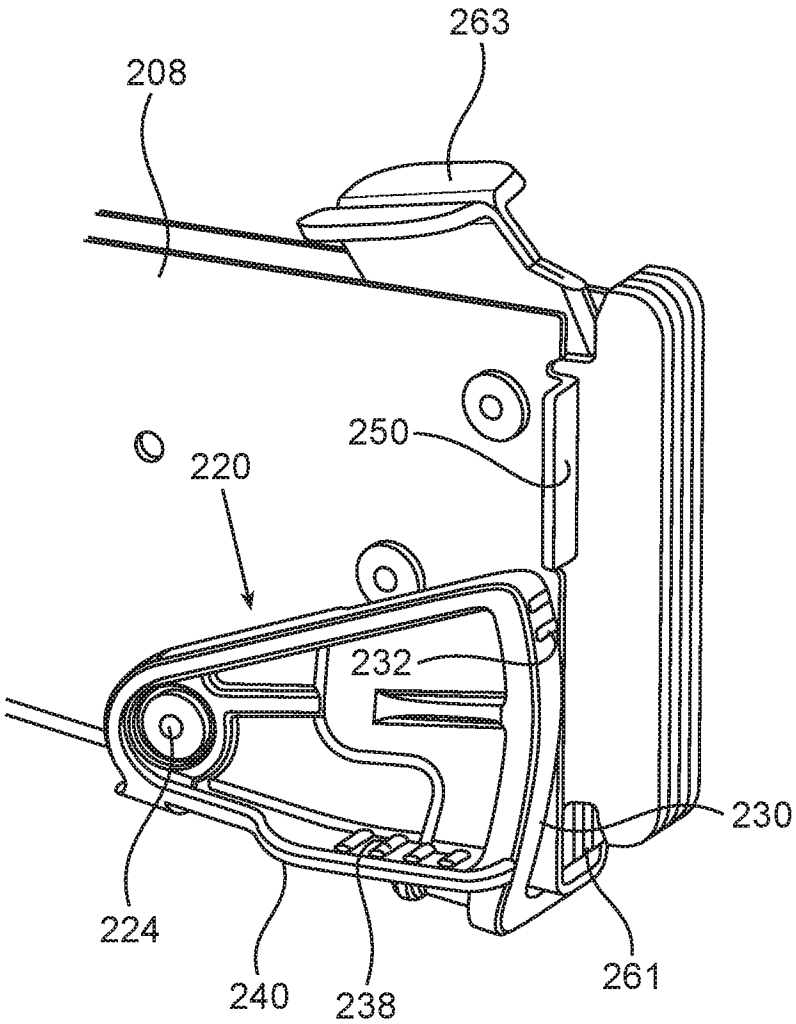
FIG. 14D is a proximal perspective view of a portion of only the wall coupling member with the tolerance cancelation mechanism at the rack-mounting position.
Figure 15C:
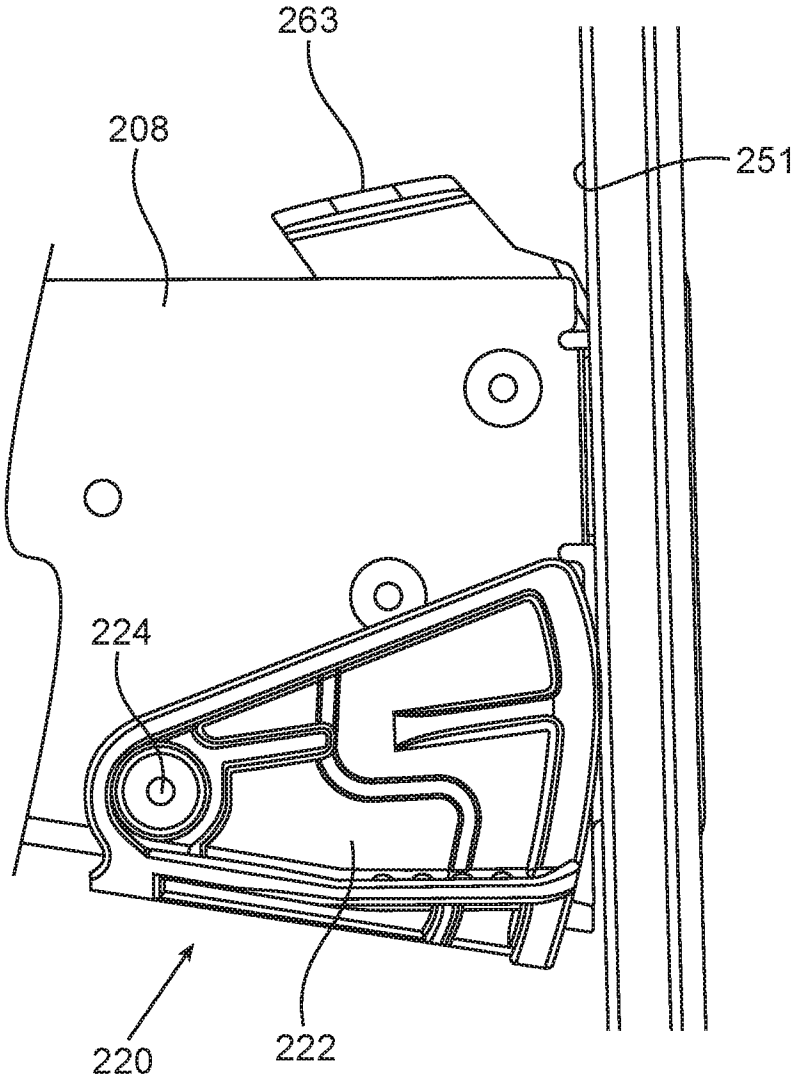
FIG. 15C is a planar side view of FIG. 15B.
Figure 15B:
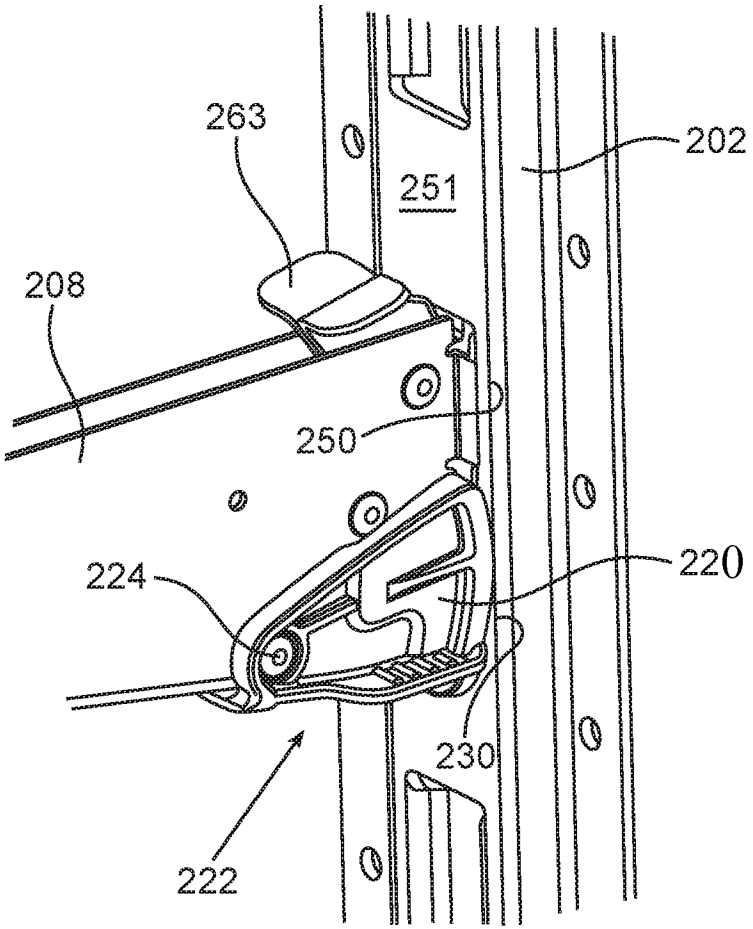
FIG. 15B is an enlargement of the portion marked 15B in FIG. 15A, with a support shelve removed for sake of clarity.
Figure 15E:
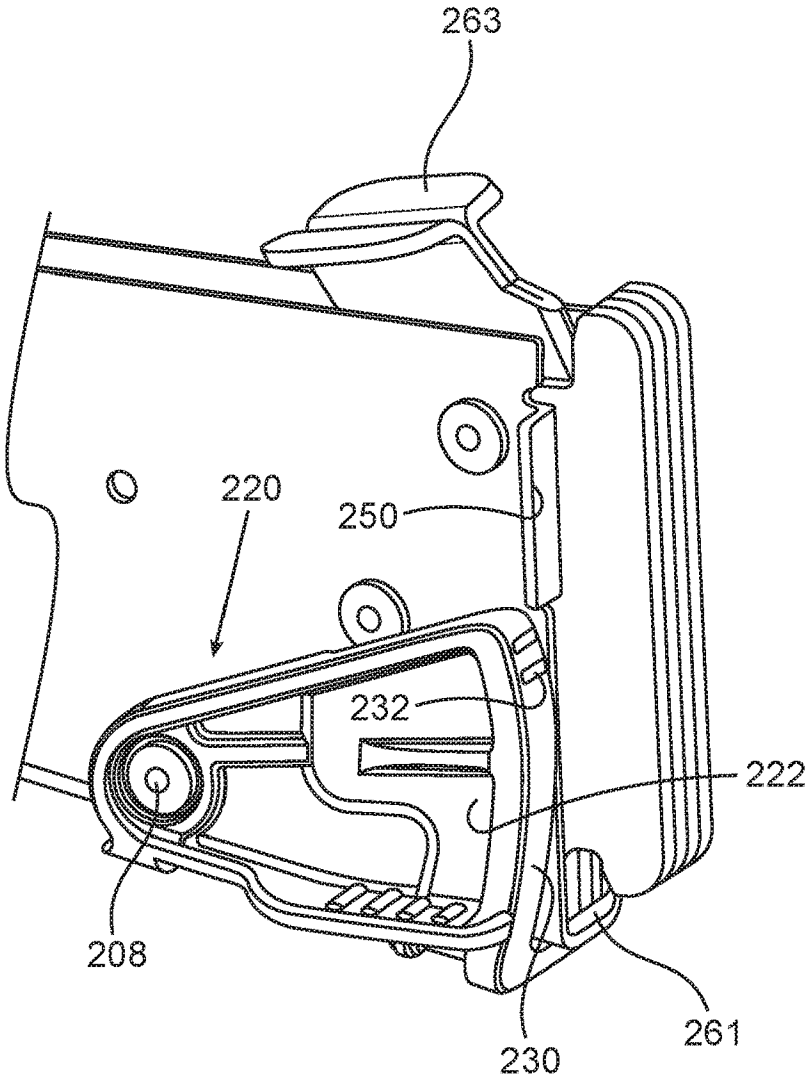
FIG. 15E is a proximal perspective view of a portion of only the wall coupling member with the tolerance cancelation mechanism at the rack unmounting position.
Figure 15D:
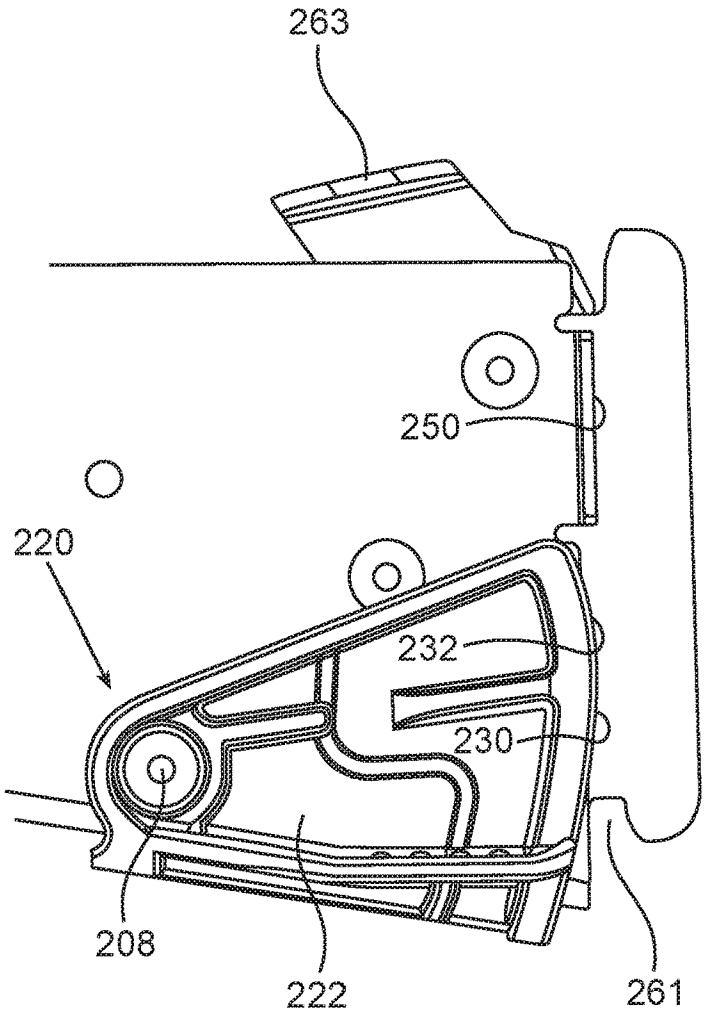
FIG. 15D is the same as FIG. 15C, with the mounting rack removed.

The fastener member 222 is a bifurcated-like element (best seen in FIG. 11B), embracing between its two parallelly extending side walls 223A and 223B a portion of the wall coupling members 208.

configured with an asymmetric sector-like shape, defined between at least a first radii $R_1$ and a second, greater radii $R_2$ ($R_2>R_1$) shown in FIG. 11A, wherein the first radii $R_1$ extends from the pivot point 224, and the second radii $R_2$ extends from an imaginary location 228 behind (and above) the pivot point 224.

The fastener member 222 is configured with a wall engaging arc surface 230 (an arc, though non symmetric and disposed along said at least one pivot radii 224 and at least one imaginary radii extending from an imaginary origin 228), such that a top portion of the wall engaging arc surface 230 has a longer radii than a lower portion thereof. Further, the wall engaging arc surface 230 is generally smooth and however has a locking portion of the arc surface configured with several friction/grip enhancing ribs 232 projecting from the smooth surface 230, the purpose of which will be discussed hereinafter.

It is further seen that the fastener member 222 comprises on its side wall with a manipulating grip in the form of a lateral projection 238 (on both sides thereof) with roughened top portion, for manually pivotal displacing it between the respective closed and open position, to be discussed hereinafter. More so, a bottom wall surface 240 of the fastener member 222 is configured with roughening, so as to form an under-grip for manipulation the fastener member 222 into the unlocked position (to be discussed hereinafter).

The fastener member 222 is pivotally articulated to the wall coupling members 208 and is so positioned that it is pivotable between a locked position (FIGS. 10A to 10G; 12) and an unlocked position (FIGS. 13 to 115). At the locked position a locking portion (friction enhancing ribs 232) of the arc surface 230 extends beyond a proximal bearing wall portion 250 of the wall coupling member 208 (best appreciated in FIG. 10F, wherein the dashed line marked X is an imaginary extension of the proximal bearing wall portion 250) and an unlocked position at which the locking portion does not exceed said proximal wall portion. At the unlocked position the locking portion (friction enhancing ribs 232) of the arc surface 230 extends behind (or flush with) the proximal bearing wall portion 250 (best appreciated in FIGS. 13B and 13C, wherein the dashed line marked X is an imaginary extension of the proximal bearing wall portion 250).

The proximal bearing wall portion 250 of the wall coupling member 208 is a surface which at an assembled position can bare against a wall surface 251 of the wall mountable racks 202. Also noted, in FIG. 11B, an inside surface of the side walls 223A and 223B is configured with ribs 254 which at the assembled position are disposed in tight proximity over a laterally projecting bulge 258 projecting from side wall surface of the wall coupling member 208, such that pivotal swinging of the fastener member 222 between its respective locked position and unlocked position entails a clicking sound associated with mild distinct angular positions.

The arrangement is such that the fastener member 222 acts as a cam-like mechanism, wherein the wall engaging arc surface 230 is configured for following the wall surface 251 of the wall mountable rack 202, whereby the arc surface 230 roles over the wall surface 251, until obtaining maximum angular pivot thereof, obtaining maximum tolerance cancelation. Any such location, where the fastener member 222 is barred from further pivotal displacement is referred to as a locked position. However, wherein each such locked position is a relevant location and can change depending on clearance between the coupling member 208 and the wall mountable rack 202.

In the illustrated example the cam-like mechanism (i.e. wall engaging arc surface 230) is continuously pivotally displaceable, between respective angular positions, whereby the wall engaging arc surface displaces over the wall surface to thereby tighten contact therebetween and cancel tolerances therebetween.

The tolerance cancelation mechanism is provided so as to eliminating or substantially reducing freedom between the wall coupling members 208 (and respectively any element supported thereby, such as a rack/shelve 210 or any other utility) and between the wall mount (racks 202), thus to provide a stable a shake free articulation therebetween.

The arrangement is such that upon articulating of a coupling member 208 with a locking slot 204 of a wall mount 202, the tolerance cancelation mechanism 222 is activated, allowing the wall engaging arc surface 230 so slide over the front wall surface 251 of the wall mount 202, bearing against it and thus eliminating or substantially reducing freedom degree between therebetween, wherein further the eccentric wall engaging arc surface 230 is pivoted into the locked position (i.e. in a downwards direction as indicated by arrow 260) entails greater contact force and enhanced tolerance cancelation.

Mounting a coupling member 208 over a wall mount rack 202 takes place by positioning a bottom indent 261 over a bottom edge of the elongate mounting slot 204. Then, while pressing an arresting clip 263 (FIGS. 14A to 14D), the top locking recess 265 (now vacant from obstructing portion 267) is introduced into the elongate mounting slot 204, and the arresting clip 263 is released. Once the coupling members 208 are leveled into the horizontal position, the tolerance cancelation mechanism 220 is automatically activated and drops down (in direction of arrow 260) into the locked position, whereby the friction enhancing ribs 232 encounter the wall surface 251 of the wall mountable racks 202 and bear there against. Enhanced tolerance cancelation cab be facilitated by further pressing the friction enhancing ribs 232 against the wall surface 251 by applying downwards directed force over the lateral projection 238. Once the fastener member 222 bears against the wall surface 251, at the locked position, any tolerances ('freedom of motion') between the coupling members 208 and the wall mount rack 202 is eliminated.

Disengaging a coupling member 208 from the wall mount rack 202 takes place in a reverse sequence of operations. Namely, first the tolerance cancelation mechanism 220 is deactivated into its unlocked position, by pivotal displacing the fastener member 222 in a counter clockwise direction (i.e. against the direction indicated by arrow 260). This is facilitated by pressing upwards against the bottom wall surface 240 of the fastener member 222 or by elevating the fastener member 222 through lateral projection 238, whereby the locking portion 232 of the arc surface 230 unlocks and disengages from the wall surface 251, enabling detaching the wall coupling member 208 from the wall mountable racks 202.

The invention claimed is:

1. A coupling member having a utility portion at a proximal side thereof that is attachable to a utility module, and a mounting portion at a distal side thereof that is attachable to a wall mount, said mounting portion comprises two parallelly disposed side walls, with a locking portion at a distal end of the mounting portion, configurable for snug arresting within a locking slot of the wall mount; said side walls comprise a first locking lug with an associated first locking recess, and a second locking lug with an associated second locking recess, the first and second locking recesses being disposed in register with one another, said first locking recess is deeper than said second locking recess;

wherein the coupling member is configured with an obstructing plunger slidingly displaceable within a space between the side walls, between a locked position, at which the plunger at least partially projects into the first locking recess, and an unlocked position at which the plunger is retracted into the space and out of the first locking recess; and wherein at the locked position, a distal end portion of the obstructing plunger projects into a support opening configured at a front wall portion extending between side walls of the coupling member.

2. The coupling member of claim 1, wherein the coupling member is configured for displacement to permit articulation of the coupling member from the wall mount or detachment therefrom, so that the first locking recess encounters a first narrow edge of a rectangle locking slot of the wall mount, thereby facilitating tilting of the coupling member, as to permit the second locking lug to pass over an opposite narrow edge of the rectangle locking slot, into or out of the second locking recess, into articulation or detaching from the wall mount, respectively.

3. The coupling member of claim 2, wherein, only when the plunger is at the retracted, unlocked position, displacement of the coupling member to encounter the first narrow edge of the rectangle locking slot is permitted.

4. The coupling member of claim 2, wherein respective edges of the first locking lug and the second locking lug define a distance therebetween that is greater than a length of the rectangle locking slot, to thereby bar the coupling member from axial displacement.

5. The coupling member of claim 1, wherein, at an articulated position, the first and second narrow edges of the rectangular locking slot are received within the first locking recess and the second locking recess, respectively, wherein a portion of a front wall face and a portion of a back wall face of the mounting wall are disposed between respective walls of the first locking recess and the second locking recess, thereby providing axial support oriented in both forward and backward direction.

6. The coupling member of claim 1, wherein configured for use in conjunction with an E-track mounting system.

7. The coupling member of claim 1, being configured for attaching to the wall mount, the wall mount being disposed at an orientation selected from the group consisting of vertical orientation, horizontal orientation, inclined orientation, ground mounted orientation and ceiling mounted orientation.

8. The coupling member of claim 1, wherein the second locking lug has a length that is similar to an obstruction depth of the obstructing plunger.

9. The coupling member of claim 1, wherein the second locking lug and the first locking recess define a distance therebetween that is similar to a distance defined between the second locking recess and an obstruction depth of the obstructing plunger.

10. The coupling member of claim 1, wherein a lateral face of the obstructing plunger extends between the first locking lug and the first locking recess when the obstructing plunger is at the locked position.

11. The coupling member of claim 1, wherein the obstructing plunger is configured as a sliding rod having a round cross section.

12. The coupling member of claim 1, wherein the obstructing plunger is configured with a chamfered distal end.

13. The coupling member of claim 1, wherein the obstructing plunger is slidingly supported over a support surface within the space defined between the side walls of the coupling member.

14. The coupling member of claim 1, wherein the obstructing plunger is configured for displacing substantially normal to the mounting wall of the wall mount.

15. The coupling member of claim 1, wherein the obstructing plunger is biased into the locked position.

16. The coupling member of claim 1, wherein the obstructing plunger is manipulable by an axially displaceable manipulating member that is disposed at a distal portion of the coupling member.

17. The coupling member of claim 1, wherein the side walls of the coupling member are configured with a front wall portion, defining together a U-like shaped section.

18. The coupling member of claim 1, wherein the side walls of the coupling member are integral with one another.

19. The coupling member of claim 1, wherein at least proximal facing edges of one or both of the first locking lug and the second locking lug are chamfered.

20. The coupling member of claim 1, wherein the obstructing plunger is normally biased into the locked position.

* * * * *